US010471493B2

(12) United States Patent
Suzuki et al.

(10) Patent No.: US 10,471,493 B2
(45) Date of Patent: Nov. 12, 2019

(54) PRESSED COMPONENT MANUFACTURING METHOD, PRESS, AND PRESS LINE

(71) Applicant: NIPPON STEEL & SUMITOMO METAL CORPORATION, Tokyo (JP)

(72) Inventors: Toshiya Suzuki, Tokyo (JP); Yoshiaki Nakazawa, Tokyo (JP); Masahiro Nakata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/781,651

(22) PCT Filed: Dec. 7, 2016

(86) PCT No.: PCT/JP2016/086396
§ 371 (c)(1),
(2) Date: Jun. 5, 2018

(87) PCT Pub. No.: WO2017/099128
PCT Pub. Date: Jun. 15, 2017

(65) Prior Publication Data

US 2019/0176204 A1 Jun. 13, 2019

(30) Foreign Application Priority Data

Dec. 8, 2015 (JP) ..... 2015-239425
Mar. 25, 2016 (JP) ..... 2016-061993

(51) Int. Cl.
*B21D 22/20* (2006.01)
*B21D 22/26* (2006.01)
(Continued)

(52) U.S. Cl.
CPC ..... *B21D 22/26* (2013.01); *B21D 5/01* (2013.01); *B21D 22/24* (2013.01); *B21D 24/06* (2013.01);
(Continued)

(58) Field of Classification Search
CPC ..... B21D 22/26; B21D 5/01; B21D 22/24; B21D 53/88; B21D 24/04; B21D 24/16; B21D 24/06; B21D 47/01
(Continued)

(56) References Cited

U.S. PATENT DOCUMENTS 9,718,113 B2 * 8/2017 Nakata ..... B21D 22/26
2014/0182349 A1 * 7/2014 Yonemura ..... B21D 22/26 72/349
(Continued)

FOREIGN PATENT DOCUMENTS

JP 50-146562 A 11/1975
JP 2012-51005 A 3/2012
(Continued)

OTHER PUBLICATIONS

Decision to Grant a Patent for JP 2017-514718 dated Jun. 20, 2017.
(Continued)

*Primary Examiner* — David B Jones
(74) *Attorney, Agent, or Firm* — Birch, Stewart, Kolasch & Birch, LLP

(57) ABSTRACT

Disclosed is a method to manufacture a pressed component from an intermediate stock, which includes two bent portions with a spacing thereof narrower than a width of a top plate of the pressed component, by employing a press including a die having a die pad and a punch having an inner pad, the method including: gripping a portion between the bent portions with the inner pad and the die pad in a state in which the inner pad projects from the punch and the die pad projects from the die; moving the die toward the punch side to form vertical walls of the pressed component with the die and the punch; and integrating the die and the die pad and then moving the die, the die pad and the inner pad toward the punch side to form the top plate.

18 Claims, 35 Drawing Sheets

(51) Int. Cl.

| | |
|---|---|
| ***B21D 53/88*** | (2006.01) |
| ***B21D 24/06*** | (2006.01) |
| ***B21D 47/01*** | (2006.01) |
| ***B21D 5/01*** | (2006.01) |
| ***B21D 22/24*** | (2006.01) |
| *B21D 24/04* | (2006.01) |
| *B21D 24/16* | (2006.01) |

(52) U.S. Cl.
CPC ..... *B21D 47/01* (2013.01); *B21D 53/88* (2013.01); *B21D 24/04* (2013.01); *B21D 24/16* (2013.01)

(58) Field of Classification Search
USPC ..... 72/349
See application file for complete search history.

(56) References Cited

U.S. PATENT DOCUMENTS

2014/0356643 A1* 12/2014 Nakata ..... B21D 22/26 428/603
2015/0367392 A1 12/2015 Nishimura et al.
2017/0291208 A1* 10/2017 Nishimura ..... B21D 5/01
2018/0078986 A1 3/2018 Suzuki et al.

FOREIGN PATENT DOCUMENTS

| | | | |
|---|---|---|---|
| JP | 5079655 | B2 | 11/2012 |
| JP | 6179696 | B1 | 8/2017 |
| WO | WO 2014/148618 | A1 | 9/2014 |
| WO | WO 2016/140287 | A1 | 9/2016 |

OTHER PUBLICATIONS

International Search Report for PCT/JP2016/086396 dated Feb. 28, 2017.
Written Opinion of the International Searching Authority for PCT/JP2016/086396 (PCT/ISA/237) dated Feb. 28, 2017.

* cited by examiner

PRESSED COMPONENT MANUFACTURING METHOD, PRESS, AND PRESS LINE

TECHNICAL FIELD

The present disclosure relates to a pressed component manufacturing method, a press, and a press line.

BACKGROUND ART

The specification of Japanese Patent No. 5079655 (Patent Document 1), and Japanese Patent Application Laid-Open (JP-A) No. 2012-51005 (Patent Document 2), for example, describe methods for manufacturing pressed components with substantially U-shaped (gutter-shaped) cross-section profiles using a press including a punch provided with a punch-side pad (inner pad) and a die provided with a die-side pad (die pad). In these pressed component manufacturing methods, a pressed component is formed by gripping a metal stock sheet with the punch-side pad projecting from the punch and the die-side pad projecting from the die, and pressing the die toward the punch side in this state. This suppresses the occurrence of spring-back in the pressed component.

Namely, in these pressed component manufacturing methods, when the die is pressed toward the punch side to form a vertical wall, since the punch-side pad projects from the punch, an inclined slack portion (linear excess portion) arises at a portion of the metal stock sheet between a shoulder of the punch-side pad and a shoulder of the punch. Specifically, the slack portion (linear excess portion) deforms in a convex curve toward a front face side of the metal stock sheet. The die-side pad and the die are then pressed further toward the punch side to form a top plate of the pressed component. When this is performed, a portion of the metal stock sheet bent by the shoulder of the punch is formed into a vertical wall pressed out toward a base end side of the vertical wall. A first moment toward the pressed component inside therefore arises at the base end side of the vertical wall of the pressed component prior to demolding (see the arrow in FIG. 5(*b*) of Patent Document 2).

The slack portion (linear excess portion) is ultimately squashed between the punch and the die. However, prior to being squashed, the slack portion (linear excess portion) curves and deforms into a convex curve toward the front face side of the metal stock sheet. Accordingly, after being squashed, a second moment toward the inside of the pressed component arises at both width direction edges of the top plate of the pressed component (see the arrow in FIG. 5(*b*) of Patent Document 2).

Moreover, prior to demolding, a third moment toward the pressed component outside arises at a ridge line portion of the pressed component (see the arrow in FIG. 5(*b*) of Patent Document 2). The third moment cancels out (balances out) the first and second moments, thereby suppressing spring-back in the pressed component.

SUMMARY OF INVENTION

Technical Problem

However, in the pressed component manufacturing methods described above, the greater the projection amount of the punch-side pad from the punch, the greater the first and second moments become. There is therefore a tendency for a displacement amount (a spring-go amount) of the vertical wall toward the inside to become large. In other words, as the magnitude of the first and second moments change, there is a tendency for a width direction dimension of the vertical wall to change excessively with respect to the projection amount of the punch-side pad from the punch. Therefore, a range of projection amounts of the punch-side pad in which the width direction dimension of the vertical wall can be kept within a set tolerance becomes comparatively restrictive. This necessitates precise adjustment of the punch-side pad projection amount when forming pressed components. From the perspective of productivity, there is demand for a pressed component manufacturing method enabling a pressed component to be formed such that the dimensions of vertical walls stay within a tolerance even with an expanded range of punch-side pad projection amounts.

In consideration of the above circumstances, the present disclosure provides a pressed component manufacturing method and a press capable of securing dimensional precision in a pressed component, even with an expanded range of projection amounts of an inner pad from a punch.

Solution to Problem

A method to manufacture a pressed component from an intermediate stock by employing a press including a die that is provided with a die pad, and a punch that is disposed opposing the die and that is provided with an inner pad, the pressed component including a top plate, a pair of ridge line portions positioned on both width direction sides of the top plate, and a pair of vertical walls extending from the ridge line portions toward one plate thickness direction side of the top plate, and the pressed component manufacturing method comprising:

providing the intermediate stock including a pair of bent portions inflected toward the one plate thickness direction side, with a spacing between the pair of bent portions set as a narrower spacing than a width of the top plate;

gripping a portion of the intermediate stock between the pair of bent portions with the inner pad and the die pad, with the one plate thickness direction side of the intermediate stock on the side of the inner pad, in a state in which the inner pad projects from the punch toward the die side and the die pad projects from the die toward the punch side;

moving the die toward the punch side relative to the die pad, the inner pad, and the punch, and forming the pair of vertical walls with the die and the punch; and integrating the die and the die pad into a single unit, and then moving the die and the die pad, and the inner pad, toward the punch side relative to the punch to form the top plate.

In the pressed component manufacturing method addressing the above issue, the pressed component is manufactured using the intermediate stock. The pressed component includes the top plate, the pair of ridge line portions positioned on both width direction sides of the top plate, and the pair of vertical walls extending from the ridge line portions toward the one plate thickness direction side of the top plate. The intermediate stock includes the pair of bent portions inflected toward the one plate thickness direction side, and the spacing between the pair of bent portions is set as a narrower spacing than the width of the top plate of the pressed component.

The inner pad projects from the punch toward the die side, and the die pad projects from the die toward the punch side. In this state, the portion of the intermediate stock between the pair of bent portions is gripped by the inner pad and the die pad, with the one plate thickness direction side of the intermediate stock on the side of the inner pad.

Then the die is moved toward the punch side relative to the die pad, the inner pad, and the punch, such that the die and the punch form the vertical walls. Then, the die and the die pad are integrated into a single unit, and then the die and the die pad, and the inner pad are moved toward the punch side relative to the punch to form the top plate. The pressed component is formed in this manner.

In the pressed component manufacturing method of the present disclosure, as described above, the pressed component is formed employing the intermediate stock that includes the pair of bent portions. Accordingly, after forming (and prior to demolding), the second moment described above can be suppressed from arising in the pressed component. Namely, in the state in which the intermediate stock has been gripped by the inner pad and the die pad portions on both width direction sides of the intermediate stock are pre-bent in a direction approaching shoulders of the punch.

Accordingly, when the die is moved relatively toward the punch side portions of the intermediate stock (portions corresponding to the slack portion described above) located between the shoulders of the punch and shoulders of the inner pad are suppressed from deforming in a convex curve toward the outside of the punch (the other plate thickness direction side of the intermediate stock). Accordingly, the second moment described above is suppressed from arising in the pressed component prior to demolding. Moment arising in the pressed component can be configured mainly by a first moment toward the pressed component inside at base end portions of the vertical walls, and a third moment toward the pressed component outside at the ridge line portions.

Namely, the second moment is suppressed from influencing a width direction displacement amount of the vertical walls, thereby enabling the width direction displacement amount of the vertical walls to be regulated using mainly the first moment alone. The width direction dimensions of the vertical walls are thus suppressed from changing excessively with respect to the projection amount of the inner pad from the punch, enabling the range of projection amounts of the inner pad from the punch to be expanded. This thereby enables the displacement amount of the vertical walls toward the pressed component inside to be suppressed from becoming inordinately large as the projection amount of the inner pad increases.

This thereby enables a pressed component to be formed with dimensional precision of the vertical walls secured to within a tolerance, even with an expanded range of projection amounts of the inner pad from the punch.

Advantageous Effects of Invention

The pressed component manufacturing method of the present disclosure is capable of securing dimensional precision in a pressed component, even with an expanded range of projection amounts of the inner pad from the punch.

DESCRIPTION OF EMBODIMENTS

First Exemplary Embodiment

Figure 1:
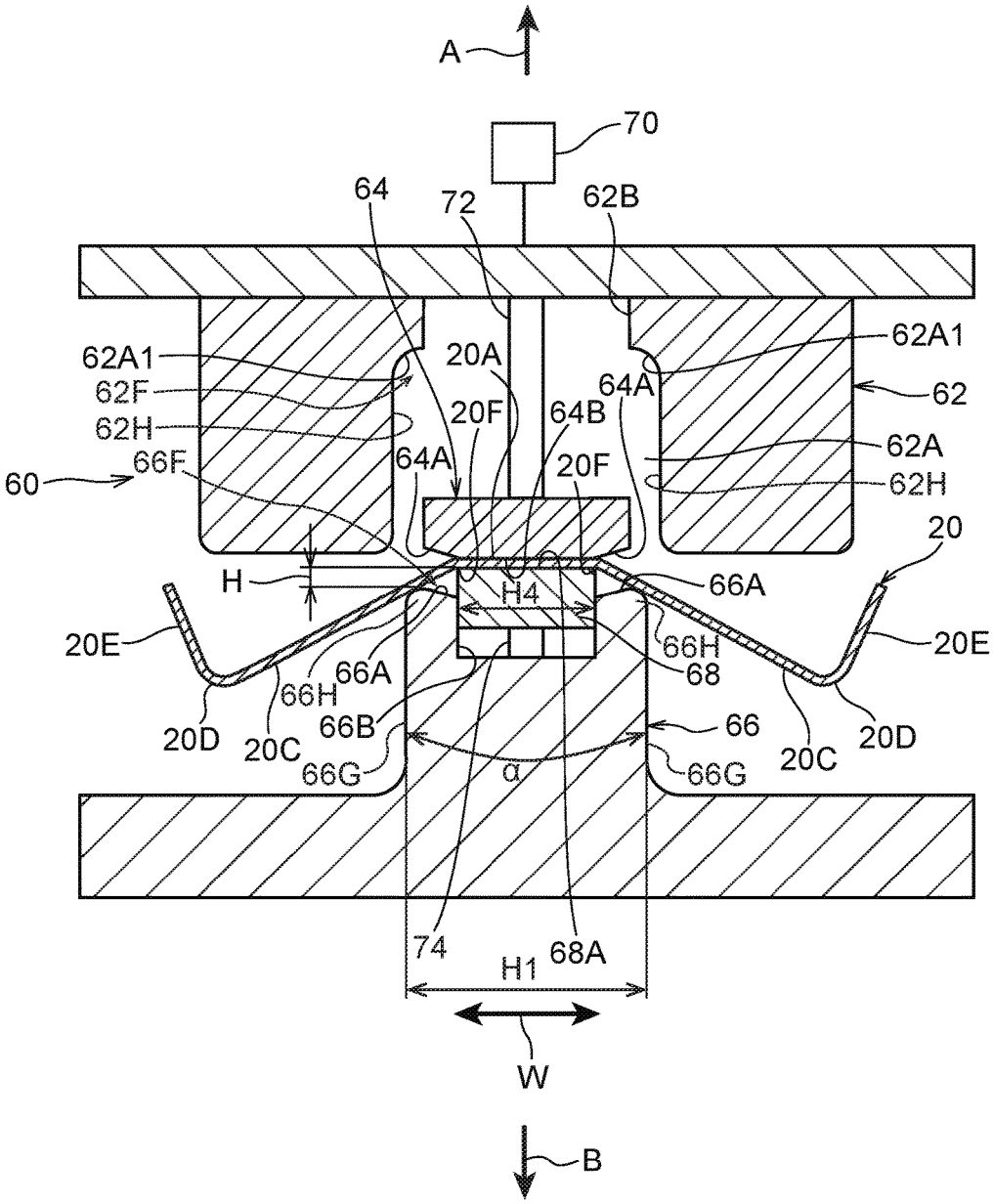
FIG. 1 is a front view cross-section of a press, illustrating a state of a first step of a pressed component manufacturing method according to a first exemplary embodiment.

Explanation follows regarding a pressed component manufacturing method according to a first exemplary embodiment, with reference to FIG. 1 to FIG. 12. In this pressed component manufacturing method, a metal stock sheet is pre-processed to configure an intermediate formed component 20, serving as an intermediate stock. The intermediate formed component 20 is used to form a pressed component 10, this being a final formed component.

First, explanation follows regarding a press line 100, followed by explanation regarding the configuration of the pressed component 10, the configuration of the intermediate formed component 20, the pre-processing of the intermediate formed component 20, and the pressed component manufacturing method. Note that in the drawings, equivalent members and the like are allocated the same reference numerals, and subsequent explanation will be omitted as appropriate where equivalent members have already been described.

Press Line 100

Figure 33:
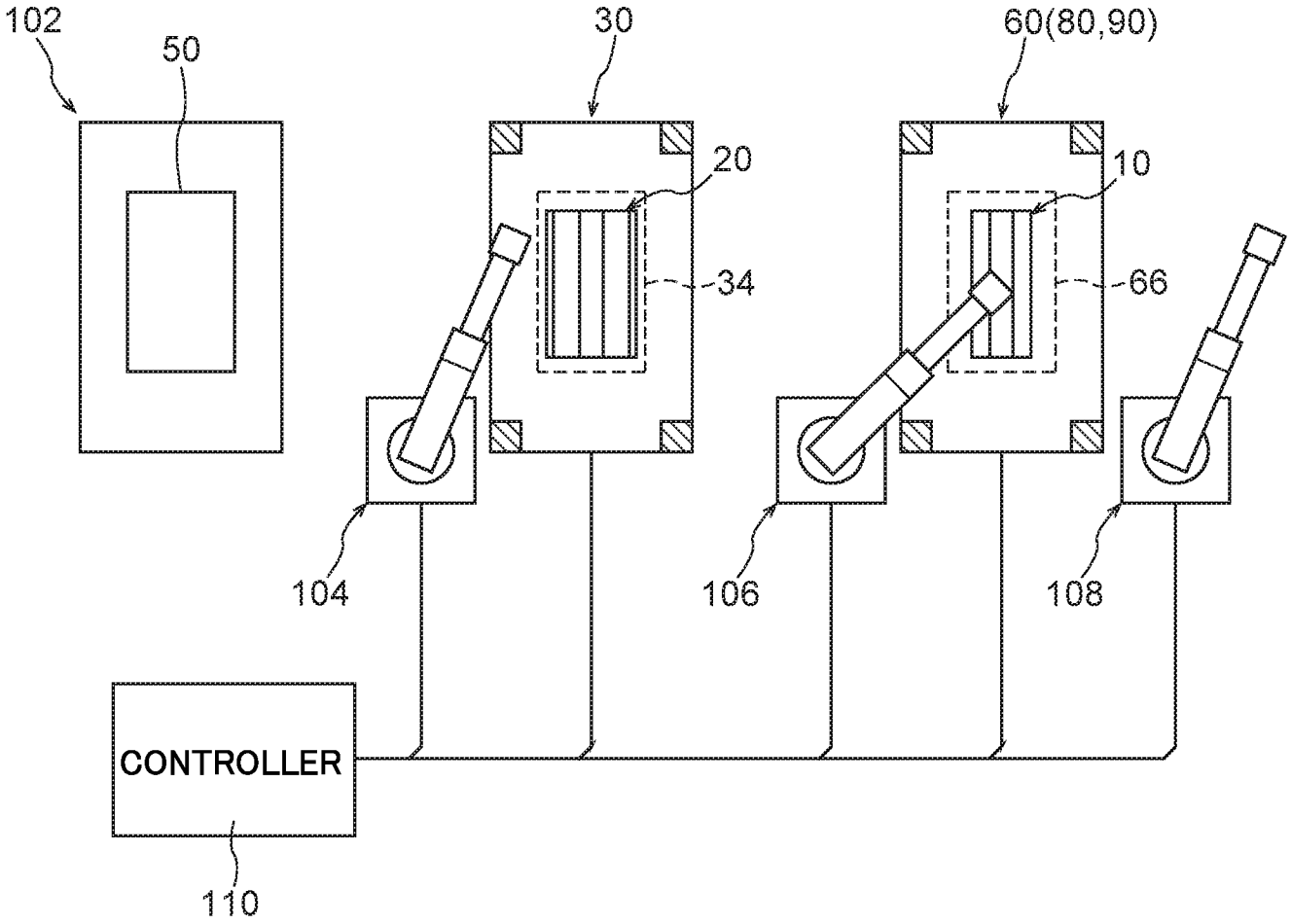
FIG. 33 is a plan view illustrating a press line.

Explanation follows regarding the press line 100 on which the intermediate formed component 20 is formed from a metal stock sheet 50 (referred to below as the blank 50), and the pressed component 10 is formed from the intermediate formed component 20, with reference to FIG. 33.

The press line 100 includes a material table 102, an intermediate forming press 30, described later, and a press 60 (80, 90), described later, arranged in this sequence from an upstream side. The blank 50 is brought to the material table 102. The blank 50 on the material table 102 is conveyed to the intermediate forming press 30 by a first manipulator 104, configured by a multi jointed robot, this being an example of a conveyance means. The blank 50 is formed into the intermediate formed component 20 by the intermediate forming press 30.

The intermediate formed component 20 formed by the intermediate forming press 30 is conveyed to the press 60 (80, 90) by a second manipulator 106. The press 60 (80, 90) forms the intermediate formed component 20 into the pressed component 10. The pressed component 10 formed by the press 60 (80, 90) is then passed over for subsequent processing by a third manipulator 108.

Note that configurations other than manipulators may be employed for at least some of the conveyance means. A conveyor is an example of such conveyance means.

The intermediate forming press 30, the press 60 (80, 90), and the respective manipulators 104, 106, 108 are connected to a controller 110 configured by an industrial computer or the like, and perform processing according to control signals from the controller 110.

Pressed Component 10

Figure 4:
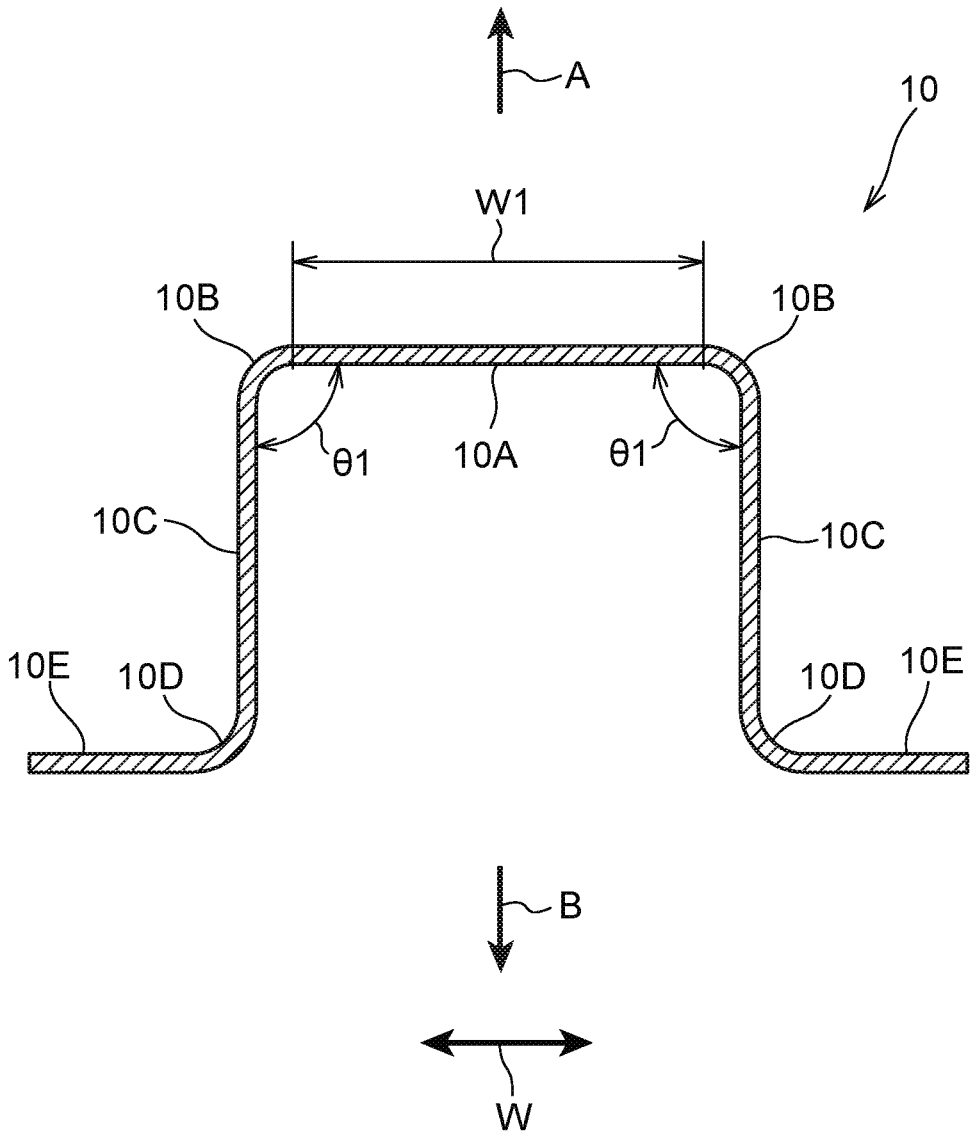
FIG. 4 is a front view cross-section illustrating a pressed component formed by the press illustrated in FIG. 1.

Explanation follows regarding configuration of the pressed component 10, with reference to FIG. 4. Note that in FIG. 4, arrow W indicates the width direction of the pressed component 10, arrow A indicates the upper side of the pressed component 10, and arrow B indicates the lower side of the pressed component 10.

The pressed component 10 is, for example, configured from high-strength sheet steel having a tensile strength of 440 MPa or greater. The pressed component 10 is, for example, a vehicle body framework member with a substantially elongated shape, and is used to configure automobile framework. The pressed component 10 has a substantially hat-shaped cross-section profile in front view (as viewed from one length direction side).

Specifically, the pressed component 10 includes a top plate 10A extending in the width direction of the pressed component 10, and a pair of ridge line portions 10B adjacent to the top plate 10A at both width direction ends of the top plate 10A, and curved into convex arc shapes toward a front face side. The pressed component 10 further includes a pair of vertical walls 10C, extending from the respective ridge line portions 10B toward a back face side of the top plate 10A (one plate thickness direction side), and a pair of ridge line portions 10D adjacent to leading ends (lower ends) of the pair of vertical walls 10C, and curved into convex arc shapes toward the back face side. The pressed component 10 further includes a pair of flanges 10E extending from the pair of ridge line portions 10D toward both width direction sides of the top plate 10A (front face sides of the vertical walls 10C).

Note that in the following explanation, the back face side of the pressed component 10 (one plate thickness direction side) is referred to as the inside of the pressed component 10, and the front face side of the pressed component 10 (other plate thickness direction side) is referred to as the outside of the pressed component 10. As described above, the pair of ridge line portions 10B configure boundaries between the top plate 10A and the vertical walls 10C, and configure bent portions convex toward the outside of the pressed component 10 in front view.

Intermediate Formed Component 20

Figure 5:
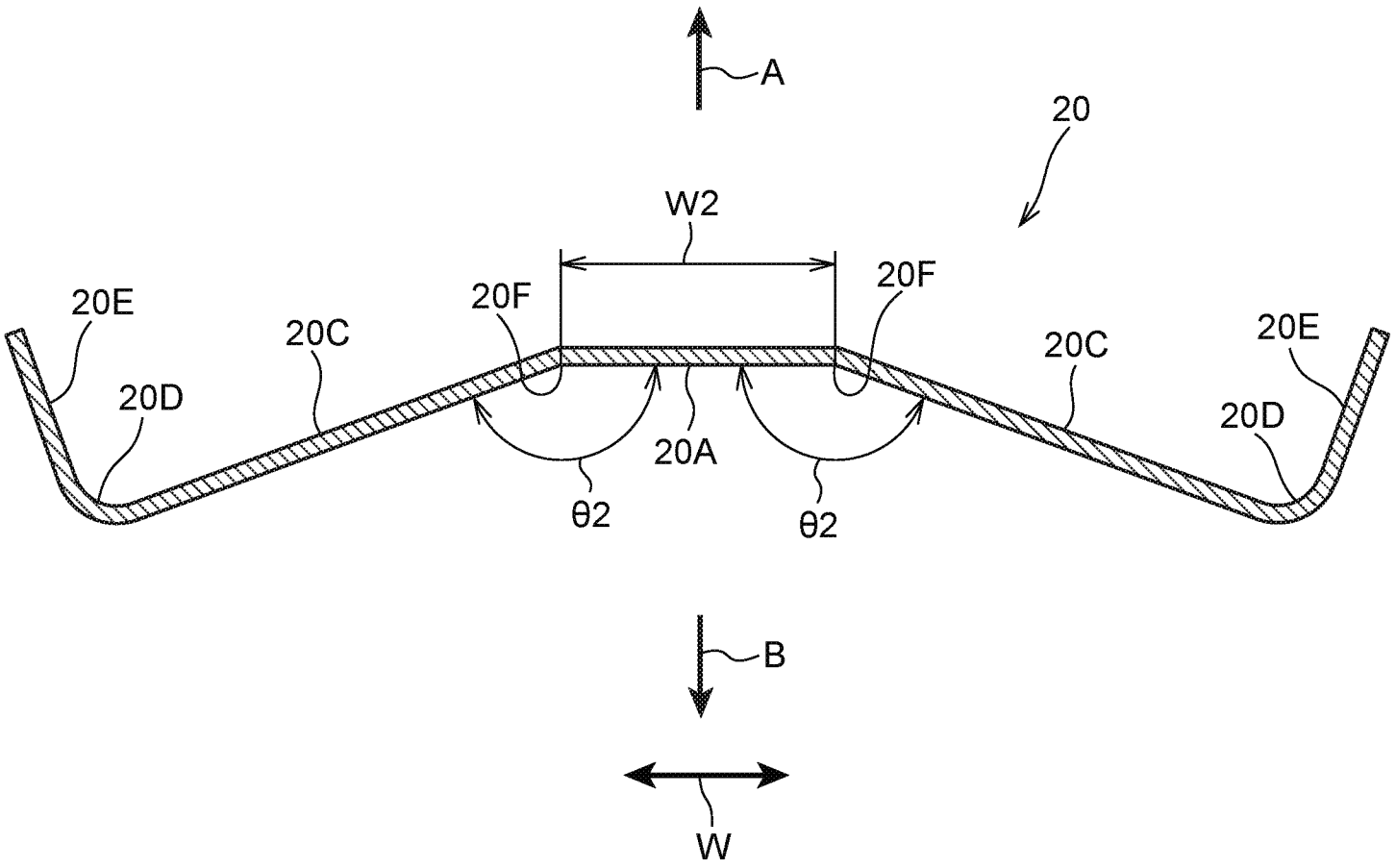
FIG. 5 is an enlarged front view cross-section illustrating an intermediate formed component illustrated in FIG. 1.

Explanation follows regarding the intermediate formed component 20, with reference to FIG. 5. Note that in FIG. 5, arrow W indicates the width direction of the intermediate formed component 20, arrow A indicates the upper side of the intermediate formed component 20, and arrow B indicates the lower side of the intermediate formed component 20. The width direction of a top plate 20A of the intermediate formed component 20 specifically corresponds to the width direction of the top plate 10A (see FIG. 4) of the pressed component 10, and the up-down direction of the top plate 20A of the intermediate formed component 20 corresponds to the up-down direction of the top plate 10A of the pressed component 10.

The intermediate formed component 20 has a substantially W-shape in front view cross-section. Specifically, the intermediate formed component 20 includes the top plate 20A, corresponding to a width direction central portion of the top plate 10A of the pressed component 10, and inclined walls 20C corresponding to portions on both width direction sides of the top plate 10A of the pressed component 10, the ridge line portions 10B, and the vertical walls 10C. The intermediate formed component 20 further includes ridge line portions 20D corresponding to the ridge line portions 10D of the pressed component 10, and flanges 20E corresponding to the flanges 10E of the pressed component 10. The inclined walls 20C are inclined toward the lower side of the intermediate formed component 20 (one plate thickness direction side of the top plate 20A) on progression toward both width direction end sides of the intermediate formed component 20. The intermediate formed component 20 is thus formed with pre-bent portions 20F, serving as a pair of bent portions bent (inflected) toward the one plate thickness direction side of the intermediate formed component 20, at width direction intermediate portions of the intermediate formed component 20.

A width W2 of the top plate 20A of the intermediate formed component 20, namely a distance between the pair of pre-bent portions 20F in the width direction, is smaller than a width W1 of the top plate 10A of the pressed component 10, namely a distance between the pair of ridge line portions 10B of the pressed component 10 (see FIG. 4) in the width direction. For example, the difference between the width W2 and the width W1 is set to at least twice the plate thickness of the intermediate formed component 20, and is preferably set to 10 mm or greater.

In other words, the difference between the width W2 and the width W1 on each of the one width direction side and the other width direction side is set to at least the plate thickness of the intermediate formed component 20, and is preferably set to 5 mm or greater. Accordingly, as described above, the top plate 20A will be formed into a width direction central portion of the top plate 10A of the pressed component 10. Base end side portions (top plate 20A side portions) of the inclined walls 20C will configure both width direction side portions of the top plate 10A of the pressed component 10, and the ridge line portions 10B of the pressed component 10.

Moreover, an angle θ2 formed between the top plate 20A and the inclined walls 20C (this angle is referred to hereafter as the pre-bend angle θ2) is set larger than an angle θ1 formed between the top plate 10A and the vertical walls 10C of the pressed component 10 (see FIG. 4), and is also set as an obtuse angle. Note that the angle of the pre-bend angle θ2 will be discussed later.

Pre-Processing of the Intermediate Formed Component 20

Figure 6:
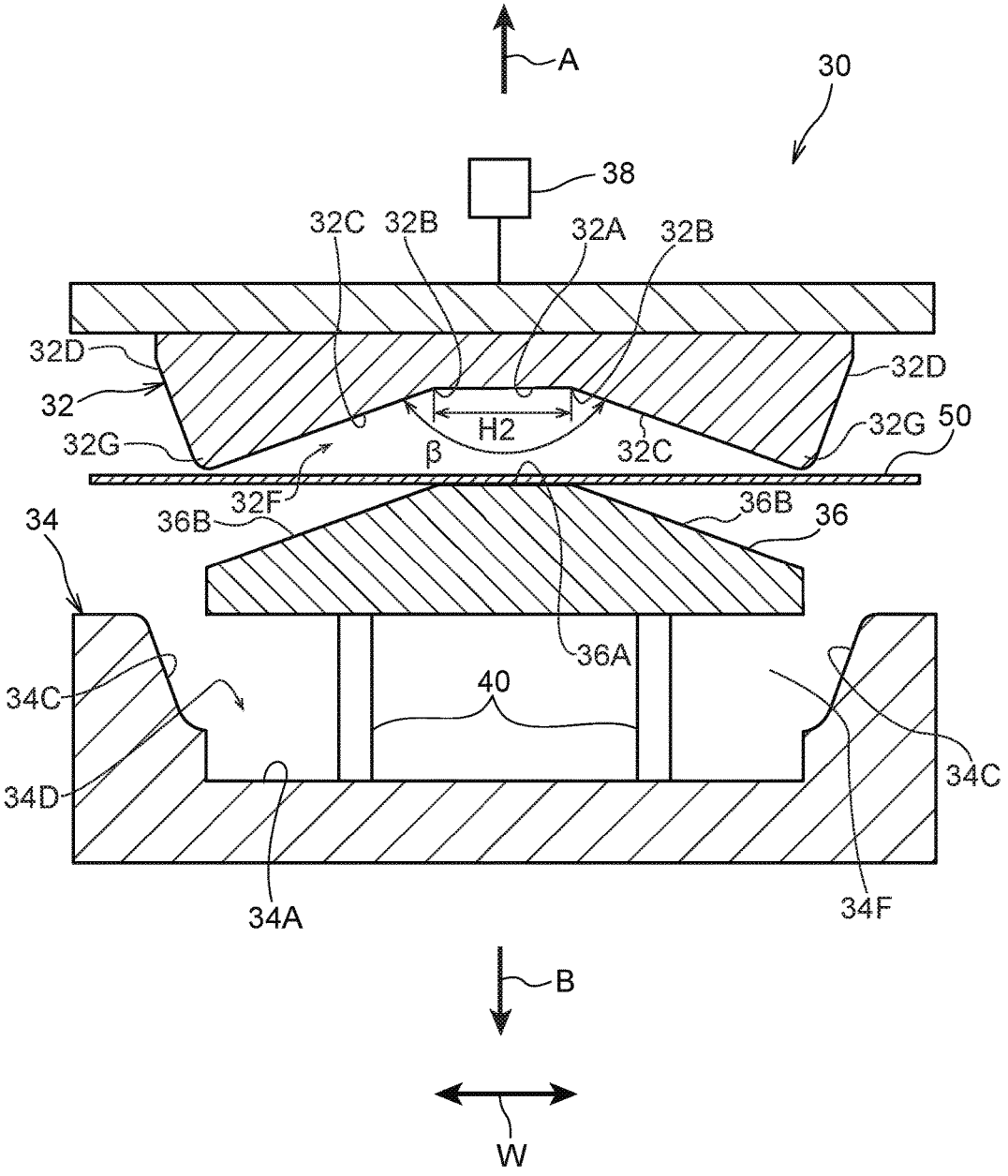
FIG. 6 is a front view cross-section of a press, illustrating a first pre-processing step to manufacture an intermediate formed component by pre-processing a metal stock sheet illustrated in FIG. 5.

Next, explanation follows regarding the pre-processing of the intermediate formed component 20, with reference to FIG. 6 and FIG. 7. In pre-processing of the intermediate formed component 20, the intermediate forming press 30 (referred to simply as the press 30 hereafter), serving as an example of a pre-forming apparatus, is employed to form the intermediate formed component 20.

First, explanation follows regarding the press 30, with reference to FIG. 6 and FIG. 7. Note that in FIG. 6 and FIG. 7, arrow W indicates the width direction of the press 30. Arrow A indicates the apparatus upper side of the press 30, and arrow B indicates the apparatus lower side of the press 30. Moreover, arrow A and arrow B also indicate a pre-forming pressing direction. The width direction of the press 30 corresponds to the width direction of the intermediate formed component 20, and the apparatus up-down direction of the press 30 corresponds to the up-down direction of the intermediate formed component 20.

The press 30 includes a pre-forming punch 32 configuring an apparatus upper side section of the press 30, and a pre-forming die 34 configuring an apparatus lower side section of the press 30. The pre-forming die 34 includes an intermediate formed component pad 36 (referred to simply as the pad 36 hereafter), serving as an example of a pre-forming die pad and configuring a width direction central portion of the pre-forming die 34.

The pre-forming punch 32 has a forming face corresponding to the profile of the front face side of the top plate 20A, the inclined walls 20C, the ridge line portions 20D, and the flanges 20E of the intermediate formed component 20. A mover device 38 is coupled to the pre-forming punch 32. The mover device 38 includes, for example, a hydraulic device or an electrically driven device. The pre-forming punch 32 is thus moved in the apparatus up-down direction (directions toward and away from the pre-forming die 34), namely in the pre-forming pressing direction, by the mover device 38.

Specifically, the pre-forming punch 32 is formed with a pre-forming punch recess 32F. Pre-forming punch shoulders 32G are provided at both sides of the pre-forming punch recess 32F. A pre-forming punch side-wall face 32D extends from each pre-forming punch shoulder 32G.

The pre-forming punch recess 32F is provided with a pre-forming punch recess bottom face 32A intersecting the pre-forming pressing direction running in the apparatus up-down direction. A width H2 of the pre-forming punch recess bottom face 32A is narrower than a width H1 (see FIG. 1, for example) of an apex portion 66F of a punch 66 of the press 60 (80, 90), described later, and not less than widths H4, H5 (see FIG. 1 and FIG. 13, for example) of a top plate-gripping face 68A of an inner pad 68. Note that in the present exemplary embodiment, the width H1 of the apex portion 66F of the punch 66 and the width H4 of the top plate-gripping face 68A are set with the same dimensions as each other.

Pre-forming punch recess corners 32B are provided on both sides of the pre-forming punch recess bottom face 32A of the pre-forming punch recess 32F. Pre-forming punch slopes 32C extend from the pre-forming punch recess corners 32B, each in a direction away from the pre-forming punch recess bottom face 32A. The angle formed between the pre-forming punch slopes 32C on either side is an angle $\beta$ that is larger than an angle $\alpha$ formed between two punch wall faces 66G of the punch 66, described later.

The pre-forming die 34 is provided with a forming face corresponding to the profile of the back face side of the ridge line portions 20D and the flanges 20E of the intermediate formed component 20. A recess 34A serving as an example of a pre-forming die pad housing portion in which the pad 36 is disposed is formed at a width direction central portion of the pre-forming die 34. The recess 34A is open toward the upper side (the pre-forming punch 32 side).

More specifically, the pre-forming die 34 opposes the pre-forming punch 32. A die cavity 34F is formed in the pre-forming die 34. Pre-forming die cavity wall faces 34C as a counterpart to the pre-forming punch side-wall faces 32D, and a pre-forming die bottom 34D disposed between the two pre-forming die cavity wall faces 34C, are formed inside the die cavity 34F. The recess 34A is formed in the pre-forming die bottom 34D.

The pad 36 is formed with a punch bottom face counterpart face 36A as a counterpart to the pre-forming punch recess bottom face 32A, and punch slope counterpart faces 36B as counterparts to the pre-forming punch slopes 32C. The pad 36 is provided with a forming face corresponding to the profile of the back face side of the top plate 20A and the inclined walls 20C of the intermediate formed component 20.

The pad 36 is coupled to the pre-forming die 34 through a pad pressurizer 40. The pad pressurizer 40 is provided with a gas cushion, a hydraulic device, a spring, an electrically driven device, or the like. The pad 36 is thus moved relative to the pre-forming die 34 in the pre-forming pressing direction, this being the apparatus up-down direction (unified as the "pre-forming pressing direction" hereafter), by the pad pressurizer 40. When the pad 36 is at bottom dead center (when the pad 36 is at its closest to the pre-forming die 34), a lower portion of the pad 36 is housed in the recess 34A of the pre-forming die 34 (see FIG. 7B).

Next, explanation follows regarding pre-processing steps to press the blank 50 with the press 30 in order to manufacture the intermediate formed component 20. The pre-processing includes the first to third pre-processing steps described below.

As illustrated in FIG. 6, at the first pre-processing step, the pad 36 is retained in a state projecting to the apparatus upper side of the pre-forming die 34 by the pad pressurizer 40. The blank 50 is placed (set) on the pad 36.

Figure 7A:
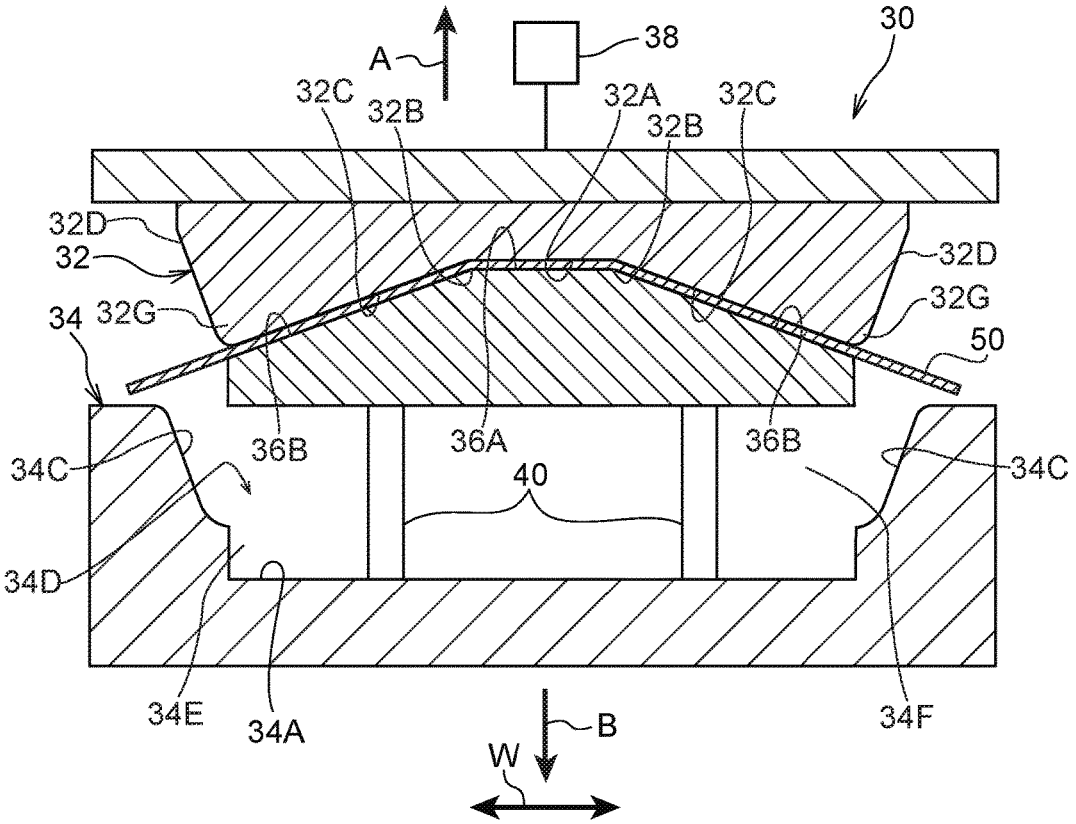
FIG. 7A is a front view cross-section of a press, illustrating a second pre-processing step to manufacture an intermediate formed component.

As illustrated in FIG. 7A, in the second pre-processing step, the mover device 38 moves the pre-forming punch 32 toward the apparatus lower side (in a direction approaching the pad 36), and the pre-forming punch 32 and the pad 36 tightly grip a width direction center-side portion of the blank 50. The top plate 20A, the pair of pre-bent portions 20F, and the pair of inclined walls 20C of the intermediate formed component 20 are thus formed.

Figure 7B:
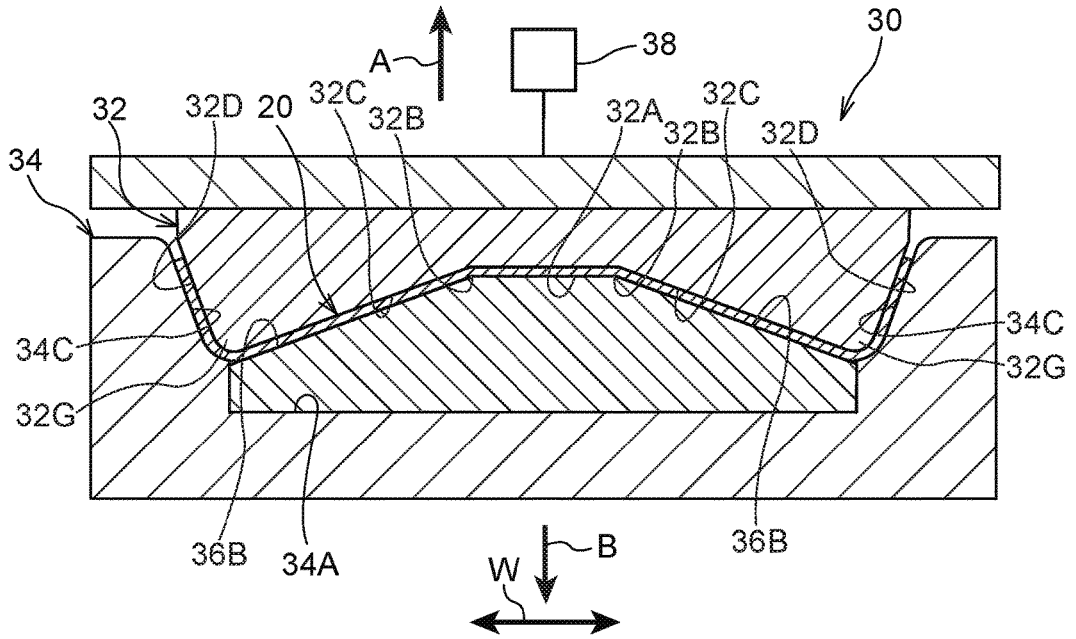
FIG. 7B is a front view cross-section of a press, illustrating a third pre-processing step to manufacture an intermediate formed component.

As illustrated in FIG. 7B, in the third pre-processing step, in a state in which the blank 50 is tightly gripped by the pre-forming punch 32 and the pad 36, the mover device 38 moves the pre-forming punch 32 and the pad 36 downward relative to the pre-forming die 34. When the pre-forming punch 32 and the pad 36 reach bottom dead center, two width direction end portions of the blank 50 are tightly gripped by the pre-forming punch 32 and the pre-forming die 34. The pair of ridge line portions 20D and the flanges 20E of the intermediate formed component 20 are thus formed. The intermediate formed component 20 is formed in this manner.

Pressed Component 10 Manufacturing Method

Next, explanation follows regarding the manufacturing method of the pressed component 10. In the manufacturing method of the pressed component 10, the press 60 is employed to form the pre-processed intermediate formed component 20 into the pressed component 10. First, explanation follows regarding the press 60, with reference to FIG. 1 to FIG. 3.

In FIG. 1 to FIG. 3, arrow W indicates the width direction of the press 60, arrow A indicates the apparatus upper side of the press 60, and arrow B indicates the apparatus lower side of the press 60. Arrow A and arrow B both indicate a pressing direction.

The width direction of the press 60 corresponds to the width directions of the pressed component 10 and the intermediate formed component 20. The apparatus up-down direction of the press 60 corresponds to the up-down directions of the pressed component 10 and the intermediate formed component 20.

The press 60 includes a die 62 configuring an apparatus upper side section of the press 60, and a punch 66 configuring an apparatus lower side section of the press 60. The die 62 and the punch 66 oppose each other in the pressing direction.

A width direction central portion of the die 62 is formed with a recess 62A opening toward the apparatus lower side. A bottom face (apparatus upper-side face) at a die bottom 62F of the recess 62A is formed with a pad housing portion 62B serving as an example of a die pad housing portion that houses a die pad 64, described later. The pad housing portion 62B has a recessed profile opening toward the apparatus lower side. Except for at the pad housing portion 62B, an inner peripheral face of the recess 62A configures a forming face corresponding to the front face of the pressed component 10 at the ridge line portions 10B, the vertical walls 10C, and the ridge line portions 10D.

Note that in the present specification, saying that one mold face is a counterpart to another mold face means that the one mold face opposes the other mold face when at the forming bottom dead center. This also includes cases in which the one mold face and the other mold face are not parallel to each other.

Specifically, the die 62 includes the die bottom 62F that opposes the apex portion 66F of the punch 66, and the pad housing portion 62B formed at the die bottom 62F. The die 62 further includes ridge line-forming faces 62A1 provided on both sides of the die bottom 62F and serving as an example of bottom corners corresponding to punch shoulders 66H of the punch 66. The die 62 further includes die cavity wall faces 62H extending from the respective ridge line-forming faces 62A1 as a counterpart to punch wall faces 66G of the punch 66. The die cavity wall faces 62H are parallel to the punch wall faces 66G.

The width of the recess 62A is greater than the width W2 of the top plate 20A of the intermediate formed component 20 (the distance between the pair of pre-bent portions 20F). Portions of the recess 62A that form the ridge line portions 10B of the pressed component 10 configure the ridge line-forming faces 62A1, serving as a pair of bottom corners. The ridge line-forming faces 62A1 have profiles curved in substantially circular arcs shapes. The pad housing portion 62B is between the pair of ridge line-forming faces 62A1.

The die 62 is coupled to a mover device 70. The mover device 70 includes, for example, a hydraulic device or an electrically driven device. The die 62 is thus moved in the pressing direction (directions toward and away from the punch 66) by the mover device 70.

The die pad 64 is provided at a width direction central portion of the die 62. The die pad 64 is coupled to the die 62 through a pad pressurizer 72. The pad pressurizer 72 is provided with a gas cushion, a hydraulic device, a spring, an electrically driven device, or the like. The die pad 64 is thus moved relative to the die 62 in the pressing direction, this being the apparatus up-down direction (unified as the "pressing direction" hereafter), by the pad pressurizer 72. When the die pad 64 is at its closest to the die 62, the die pad 64 is housed in the pad housing portion 62B, and the die pad 64 and the die 62 are integrated into a single unit. Note that the state in which the die pad 64 is at its closest to the die 62 is the state illustrated in FIG. 2B. The position of the die pad 64 when in this state is referred to hereafter as the initial position of the die pad 64. When forming the pressed component 10, the top plate 20A of the intermediate formed component 20 is tightly gripped by the die pad 64 and the inner pad 68, described later.

Moreover, a lower face of the die pad 64 configures a forming face that forms the top plate 10A of the pressed component 10. The lower face of the die pad 64 (an opposing face opposing the punch 66, described later, and the inner pad 68 in the pressing direction) has a substantially U-shaped profile (convex profile) projecting toward the apparatus lower side in front view cross-section (see FIG. 2B). In a state in which the die pad 64 is housed in the pad housing portion 62B, the lower face of the die pad 64 projects from the pad housing portion 62B toward the apparatus lower side. Namely, the lower face of the die pad 64 projects into the recess 62A (see FIG. 2B).

Specifically, a pair of inclined faces 64A, serving as die-side inclined faces, are formed at both width direction end portions of the lower face of the die pad 64. The inclined faces 64A are inclined toward the apparatus lower side (punch 66 side) on progression toward the width direction center side of the die pad 64.

A top plate-gripping face 64B, this being an example of an inner pad-opposing face, is formed at an apparatus width direction central portion of the lower face of the die pad 64. The top plate-gripping face 64B links width direction inside ends of the pair of inclined faces 64A together, and lies in a plane orthogonal to the pressing direction. Namely, the top plate-gripping face 64B is parallel to the top plate 20A of the intermediate formed component 20.

The width of the top plate-gripping face 64B matches the width W2 of the top plate 20A of the intermediate formed component 20. Namely, in a state in which the top plate 20A of the intermediate formed component 20 is being gripped by the die pad 64 and the inner pad 68, described later, the width direction positions of boundaries between the inclined faces 64A and the top plate-gripping face 64B match the width direction positions of the pre-bent portions 20F of the intermediate formed component 20. Moreover, end portions of the top plate-gripping face 64B, this being an example of an inner pad-opposing face, overlap in the pressing direction with end portions of the top plate-gripping face 68A, this being an example of an inner pad apex face (this applies to all exemplary embodiments except the second exemplary embodiment).

In a state in which the die pad 64 is housed in the pad housing portion 62B, a projection amount of the top plate-gripping face 64B from the pad housing portion 62B toward the apparatus lower side is set as appropriate such that the top plate 10A of the pressed component 10 will adopt a flat profile (flat plate shape) when demolded from the press 60. Namely, the projection amount of the top plate-gripping face 64B from the pad housing portion 62B (a height dimension of the inclined faces 64A in the pressing direction) is set as appropriate based on simulations and the like that consider the tensile strength, the plate thickness, and the like of the metal stock sheet employed for the pressed component 10.

The punch 66 is disposed at the apparatus lower side of the die 62 and die pad 64, and opposes the die 62 and the die pad 64 in the pressing direction. The punch 66 has a convex profile projecting toward the apparatus upper side in front view cross-section. An outer face of the punch 66 is a forming face corresponding to the back face of the pressed component 10 at both width direction side portions of the top plate 10A, the ridge line portions 10B, the vertical walls 10C, the ridge line portions 10D, and the flanges 10E.

A pair of inclined faces 66A, serving as punch-side inclined faces as counterparts to the inclined faces 64A, are formed to the apex portion 66F (upper portion) of the punch 66 that intersects the pressing direction, at a position opposing the inclined faces 64A of the die pad 64 in the pressing direction. Namely, the inclined faces 66A are parallel to the inclined faces 64A, and are inclined toward the apparatus lower side on progression from the punch shoulders 66H of the punch 66 toward the width direction central side. Moreover, the inclined faces 66A have a profile inverted in contour from that of the inclined faces 64A of the die pad 64.

Note that in the present exemplary embodiment, the inclined faces 66A are provided on both width direction sides of the apex portion 66F. However, there is no limitation thereto. For example, an inclined face 66A may be provided on one width direction side of the apex portion 66F alone. Moreover, the inclined faces 66A provided on both width direction sides of the apex portion 66F have the same profile as each other. However, there is no limitation thereto. For example, an inclined face 66A on one width direction side of the apex portion 66F may have a different profile to the inclined face 66A on the other side.

Moreover, the apex portion 66F (upper portion) of the punch 66 is formed with a pad housing portion 66B, serving as an example of an inner pad housing portion for housing the inner pad 68, described later. The pad housing portion 66B has a recessed profile open toward the apparatus upper side, and is adjacent to the pair of inclined faces 66A. The apex face of the punch 66 (this being the upper face of the punch 66, excluding at the pad housing portion 66B and the punch shoulders 66H provided on both sides of the apex portion 66F of the punch 66, and corresponding to a punch apex face of the present application) is thus configured by the pair of inclined faces 66A.

The respective punch shoulders 66H provided on both sides of the apex portion 66F of the punch 66 have a profile inverted in contour from that of the ridge line-forming faces 62A1 of the die 62. The punch wall faces 66G extending in directions away from the apex portion 66F are formed from the respective punch shoulders 66H. The two punch wall faces 66G are applied with a removal gradient so as to become further apart from each other on progression toward the apparatus lower side B, thereby forming the angle $\alpha$ between the two punch wall faces 66G. Note that the two punch wall faces 66G may be parallel to each other (in a direction along the pressing direction).

The inner pad 68 is provided at a width direction central portion of the apex portion 66F (upper portion) of the punch 66. The inner pad 68 has a width H4. The inner pad 68 is coupled to the punch 66 through a pad pressurizer 74. The pad pressurizer 74 is provided with a gas cushion, a hydraulic device, an electrically driven device, or the like. The inner pad 68 is thus moved relative to the punch 66 in the press direction by the pad pressurizer 74. When the inner pad 68 is at its closest to the punch 66 at the bottom dead center, the inner pad 68 is housed in the pad housing portion 66B (see FIG. 3B).

Moreover, the inner pad 68 opposes the top plate-gripping face 64B of the die pad 64 in the pressing direction. The upper face of the inner pad 68 is configured by the top plate-gripping face 68A, serving as an example of an inner pad apex face intersecting the pressing direction. The top plate-gripping face 68A is parallel to the top plate-gripping face 64B of the die pad 64. Namely, the top plate-gripping face 68A lies in a plane orthogonal to the pressing direction (the direction in which the die 62 and the punch 66 oppose each other).

The width of the top plate-gripping face 68A matches the width W2 of the top plate 20A of the intermediate formed component 20. Namely, in a state in which the die pad 64 and the inner pad 68 are gripping the top plate 20A of the intermediate formed component 20, width direction positions of the shoulders on both width direction sides of the inner pad 68 match width direction positions of the pre-bent portions 20F of the intermediate formed component 20. Note that in a state in which the inner pad 68 is housed in the pad housing portion 66B, the top plate-gripping face 68A of the inner pad 68 is disposed in the same plane as an opening plane of the pad housing portion 66B (see FIG. 3B).

Note that at a first step of the pressed component manufacturing method, described later, the pad pressurizer 74 causes the inner pad 68 to project toward the apparatus upper side with respect to the pad housing portion 66B. At the first step, in a state in which the back face (face on the one plate thickness direction side) of the top plate 20A of the intermediate formed component 20 has been placed on the inner pad 68, the die pad 64 and the inner pad 68 grip the top plate 20A of the intermediate formed component 20. A relationship between a projection amount H of the inner pad 68 from the punch 66 (specifically, the punch shoulders 66H of the punch 66) (see FIG. 10), and the pre-bend angle $\theta$2 of the intermediate formed component 20 (see FIG. 5) is set in the following manner.

Namely, when the intermediate formed component 20 has been placed on the inner pad 68 with the inner pad 68 set to the predetermined projection amount H, the pre-bend angle $\theta$2 is set such that the inclined walls 20C of the intermediate formed component 20 are tangential to the punch shoulders 66H (see FIG. 1). In other words, the pre-bend angle $\theta$2 is set such that at the first step of the pressed component manufacturing method, the inclined walls 20C extend in tangential directions that are tangential to the punch shoulders 66H.

Next, explanation follows regarding the manufacturing method of the pressed component 10. The manufacturing method of the pressed component 10 includes the first step to the third step described below.

As illustrated in FIG. 1, at the first step, the pad pressurizer 74 retains the inner pad 68 in a state projecting from the pad housing portion 66B toward the apparatus upper side. In this state, the back face of the top plate 20A of the intermediate formed component 20 is placed (set) on the inner pad 68. When this is performed, the top plate 20A is placed (set) on the inner pad 68 such that the positions of the pre-bent portions 20F of the intermediate formed component 20 are aligned with the shoulders on both width direction sides of the inner pad 68. The pad pressurizer 72 then moves the die pad 64 from the initial position toward the apparatus lower side, and the top plate-gripping face 64B of the die pad 64 and the top plate-gripping face 68A of the inner pad 68 grip the top plate 20A of the intermediate formed component 20 in the pressing direction.

Figure 2A:
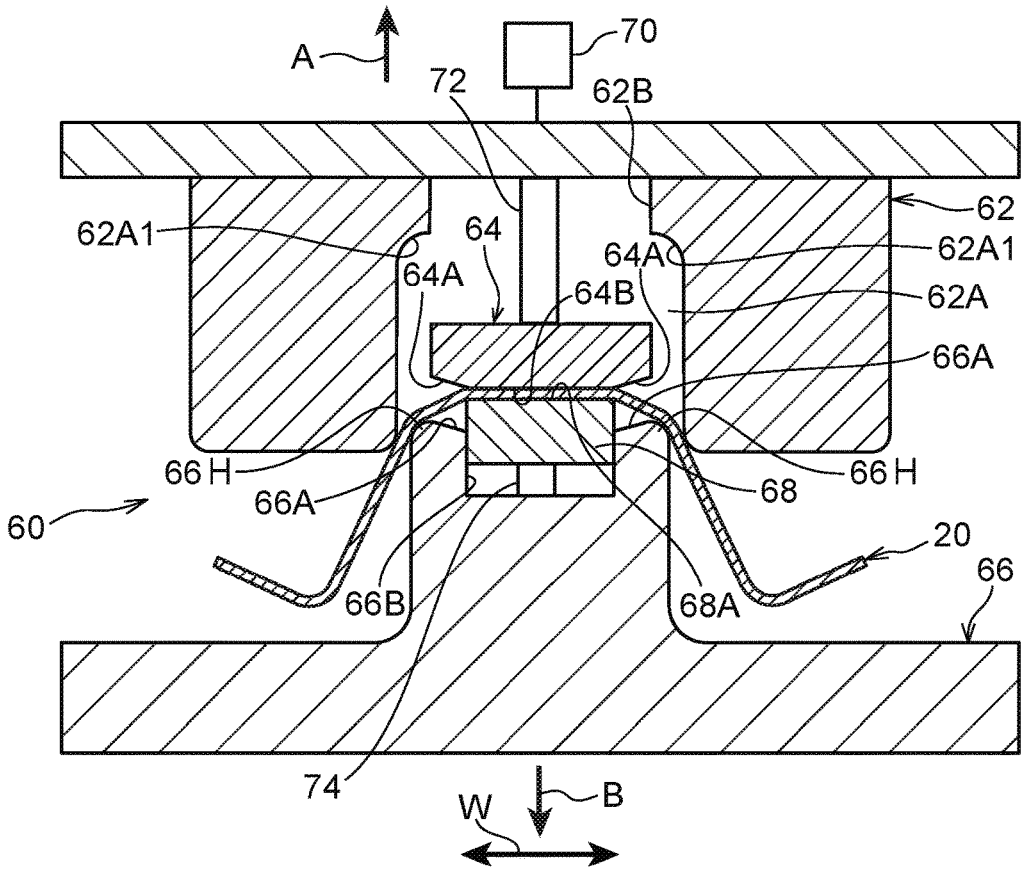
FIG. 2A is a front view cross-section of a press, illustrating a state of a second step of a pressed component manufacturing method according to the first exemplary embodiment.

At the second step, the mover device 70 moves the die 62 toward the apparatus lower side (punch 66 side) from the state illustrated in FIG. 1 (see FIG. 2A). As a result, the die 62 approaches the die pad 64, the inner pad 68, and the punch 66. When this is performed, the die 62 is moved toward the apparatus lower side while the pad pressurizer 72 and the pad pressurizer 74 maintain the tight grip of the die pad 64 and the inner pad 68 on the top plate 20A. Note that a similar effect may be achieved by attaching a mover device to the punch 66 to move the punch 66 toward the apparatus upper side (die 62 side).

Figure 2B:
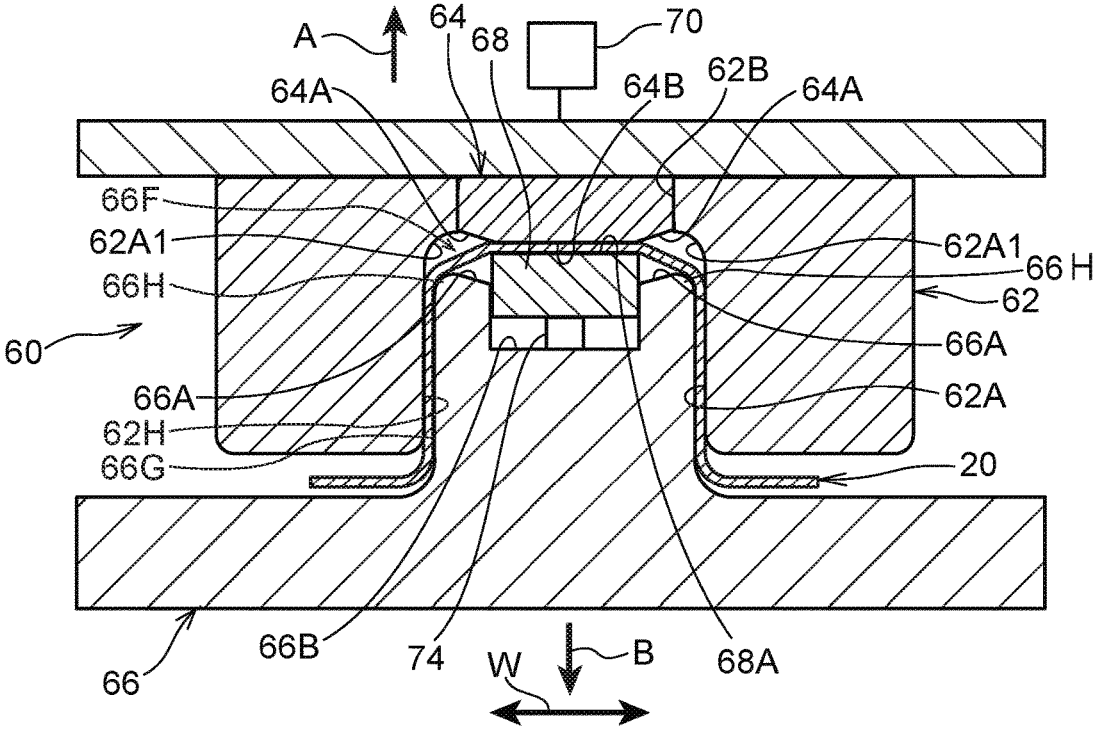
FIG. 2B is a front view cross-section of a press, illustrating a state in which a die has moved relatively toward a punch side from the state illustrated in FIG. 2A, and the die and a die pad have been integrated into a single unit.

The punch 66 is thus pushed into the recess 62A of the die 62, forming the vertical walls 10C of the pressed component 10. Namely, as illustrated in FIG. 2B, the die 62 is moved toward the apparatus lower side until the die pad 64 is housed inside the pad housing portion 62B and the die 62 and the die pad 64 are integrated into a single unit. Namely, a state is attained in which the die pad 64 is incapable of moving in the apparatus upward direction relative to the die 62.

At the third step, the mover device 70 moves the die 62 and the die pad 64 as a unit further toward the apparatus lower side from the state of the second step. The single unit configured by the die 62 and the die pad 64 is pressed toward the punch 66 side as a result. When this is performed, the inner pad 68 is moved toward the apparatus lower side together with the die 62 and the die pad 64 while the pad pressurizer 72 and the pad pressurizer 74 maintain the tight grip of the die pad 64 and the inner pad 68 on the top plate 20A. The inner pad 68 is then housed in the pad housing portion 66B (see FIG. 3A).

Specifically, the inner pad 68 is housed in the pad housing portion 66B such that a portion of the intermediate formed component 20 corresponding to the top plate 10A of the pressed component 10 adopts a flat plate shape. The die pad 64 and the inner pad 68 thus bend the pre-bent portions 20F of the intermediate formed component 20 back into a flat plate shape.

Figure 3A:
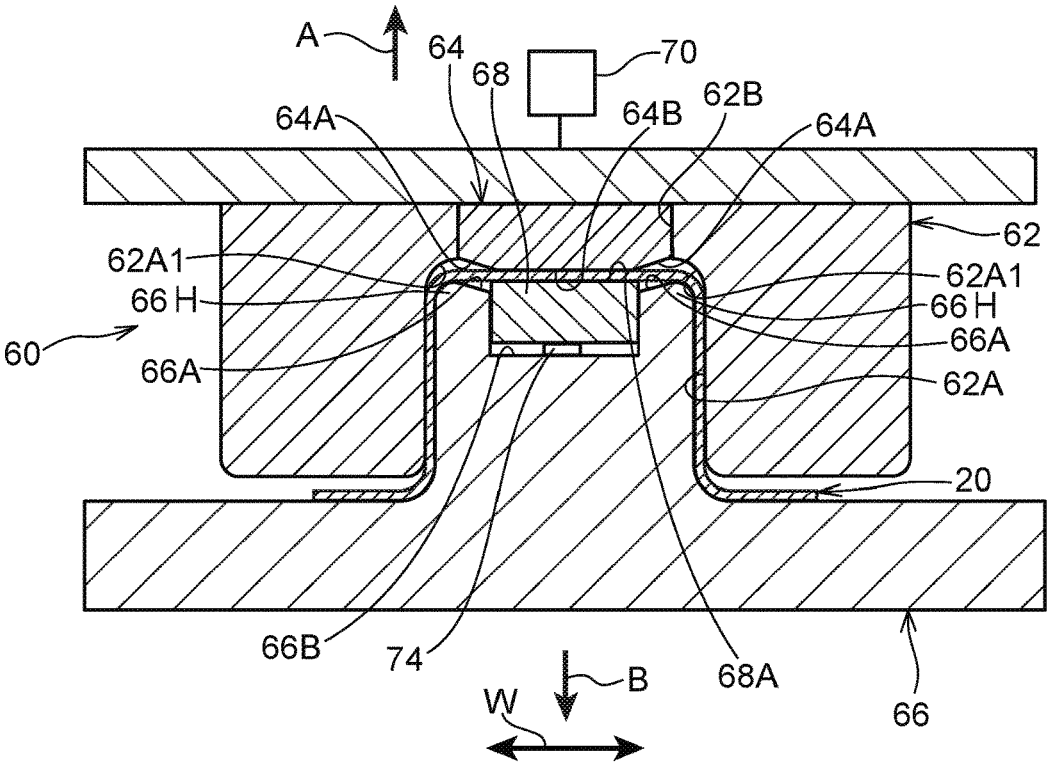
FIG. 3A is a front view cross-section of a press, illustrating a state in which the die and the die pad have moved relatively further toward the punch side from the state illustrated in FIG. 2B.
Figure 3B:
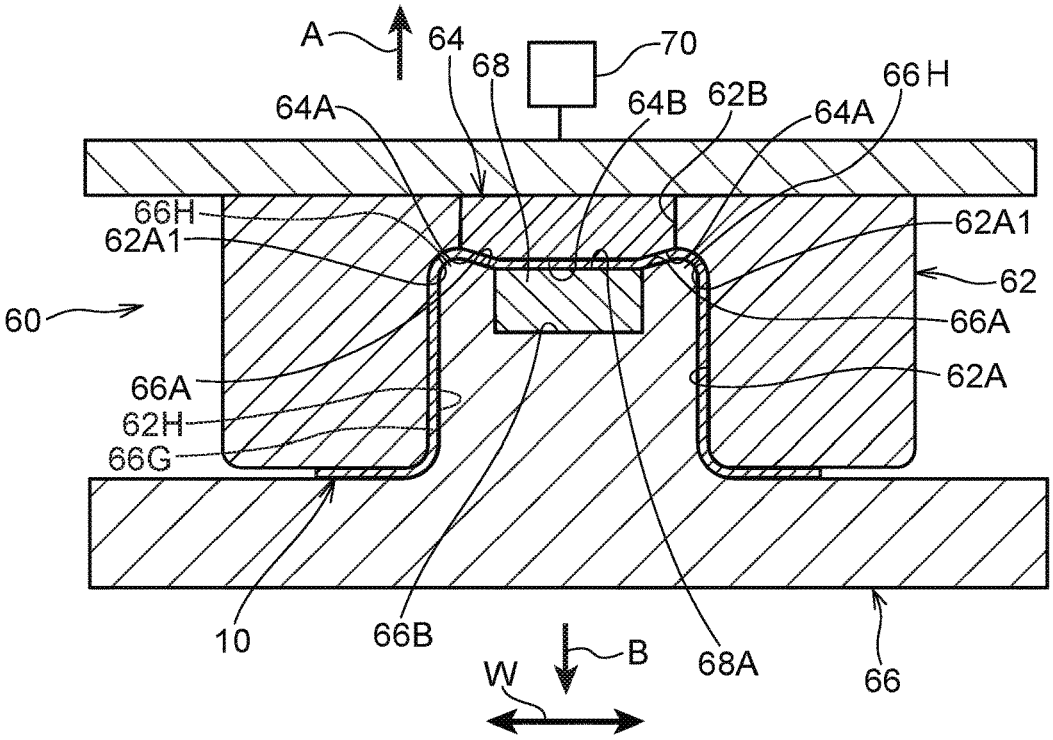
FIG. 3B is a front view cross-section of a press, illustrating a state in which the die and the die pad have reached bottom dead center from the state illustrated in FIG. 3A.

Then, from the state illustrated in FIG. 3A, the mover device 70 moves the single unit configured by the die 62 and the die pad 64 further toward the apparatus lower side. The single unit configured by the die 62 and the die pad 64 is pressed further toward the punch 66 side as a result. The pre-bent portions 20F of the intermediate formed component 20 are accordingly bent further back toward the back face side of the top plate 10A by the die 62 and the die pad 64, and the inner pad 68 and the punch 66. Moreover, the portion of the intermediate formed component 20 corresponding to the top plate 10A of the pressed component 10 is tightly gripped by the die pad 64 and the inner pad 68. The pressed component 10 is then demolded from the press 60, thereby forming the pressed component 10 with the top plate 10A in a flat plate shape.

Next, explanation follows regarding operation and advantageous effects of the present exemplary embodiment, drawing comparison with a manufacturing method of a comparative example described as background art. First, explanation follows regarding the pressed component manufacturing method of the comparative example. In the pressed component manufacturing method of the comparative example, a flat plate shaped blank 50 is employed to form a pressed component 10. Namely, in the comparative example, the blank 50 is pressed straight away, instead of employing the pre-processed intermediate formed component 20 of the present exemplary embodiment.

Figure 8:
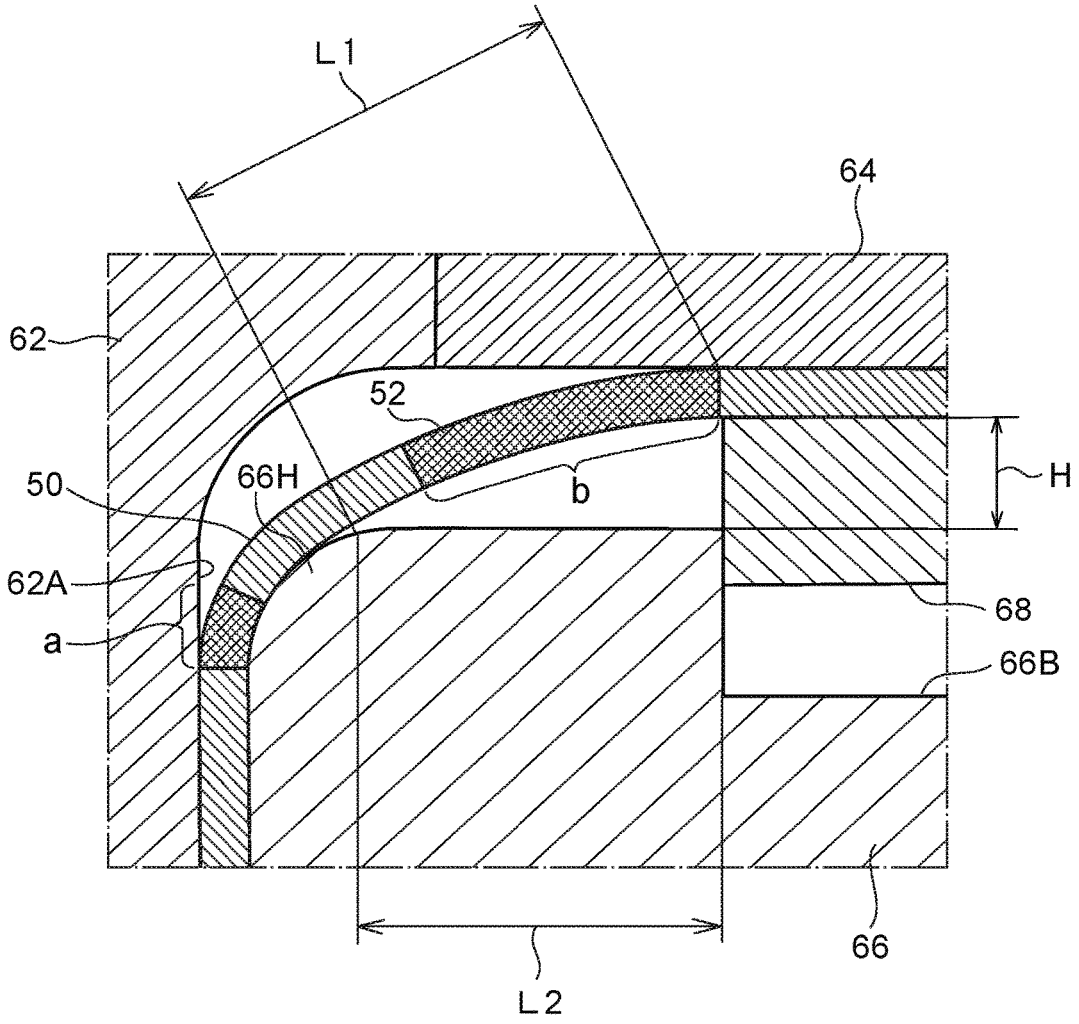
FIG. 8 is a cross-section illustrating the vicinity of a punch shoulder in a third step of a pressed component manufacturing method of a comparative example.

FIG. 8 is an enlarged diagram illustrating the surroundings of a punch shoulder 66H in a press of the comparative example. Note that in FIG. 8, sections of the press of the comparative example configured similarly to those of the present exemplary embodiment are allocated the same reference numerals. Moreover, in the press of the comparative example, portions corresponding to the inclined faces 64A of the die 62 and the inclined faces 66A of the punch 66 of the present exemplary embodiment are formed so as to lie in planes orthogonal to the pressing direction. Namely, the lower face of the die pad 64 has a flat plane profile.

First, in the comparative example, similarly to in the present exemplary embodiment, the die 62 is pressed toward the punch 66 side in a state in which the blank 50 is gripped by the die pad 64 and the inner pad 68, thereby forming portions corresponding to the vertical walls 10C of the pressed component 10. When this is performed, the inner pad 68 projects toward the die 62 side with respect to the punch 66. Accordingly, portions of the blank 50 spanning from shoulders of the inner pad 68 to the punch shoulders 66H (these portions are referred to hereafter as the slack portions 52) are bent obliquely toward the apparatus lower side on progression toward the width direction outside of the press.

Specifically, the slack portion 52 is curved so as to be convex toward the front face side of the blank 50. A length L1 of the slack portion 52 is longer than a length L2 between the inner pad 68 and the punch shoulder 66H in the width direction. From the state in FIG. 8, the die 62 and the die pad 64 are moved as far as the bottom dead center with the slack portions 52 still tightly gripped by the die 62 and the die pad 64, and the punch 66. When this is performed, a portion that is bent by the punch shoulder 66H (portion a in FIG. 8) is pushed out toward the apparatus lower side to form the vertical wall 10C. A portion on the inner pad 68 side of the slack portion 52 (portion b in FIG. 8) is squashed to form part of the top plate 10A.

Figure 9:
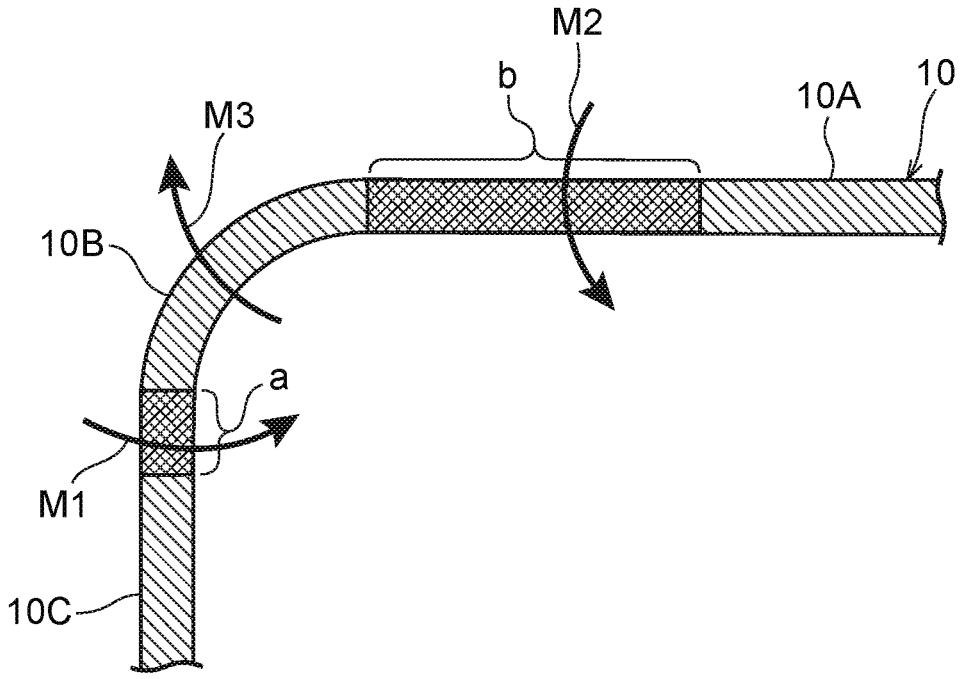
FIG. 9 is a cross-section to explain moment arising in the vicinity of a ridge line in a pressed component.

Accordingly, as illustrated in FIG. 9, in the pressed component 10 of the comparative example, the portion a configures a base end portion of the vertical wall 10C, and the portion b configures a portion on either width direction side of the top plate 10A. The portion a is bent into an arc shape convex toward the outside of the pressed component 10 by the punch shoulder 66H in the state in FIG. 8, and is then pushed out toward the vertical wall 10C side in the state in FIG. 9 and bent back to form the vertical wall 10C. When this is performed, at the bent-back portion a, compression stress arises at the outside of the pressed component 10, and tensile stress arises at the inside of the pressed component 10. A first moment (see arrow M1 in FIG. 9) toward the inside of the pressed component 10 therefore arises at the portion a of the pressed component 10 prior to demolding.

The portion b of the slack portion 52 is curved so as to be convex toward the outside of the pressed component 10 (front face side of the blank 50), and is then formed (bent back) into a flat plate shape to form the top plate 10A. When this is performed, compression stress arises at the outside of the pressed component 10 and tensile stress arises at the inside of the pressed component 10 at the portion b that has been formed into a flat plate shape. A second moment (see arrow M2 in FIG. 9) toward the inside of the pressed component 10 therefore arises at the portion b of the pressed component 10 prior to demolding.

Moreover, portions of the pressed component 10 between the portions a and the portions b (namely the ridge line portions 10B of the pressed component 10) are bent into convex arc shapes toward the outside of the pressed component 10 by the punch shoulders 66H. When this is performed, tensile stress arises at the outside of the pressed component 10 and compression stress arises at the inside of the pressed component 10 at the ridge line portions 10B. A third moment (see arrow M3 in FIG. 9) toward the outside of the pressed component 10 therefore arises at the ridge line portions 10B of the pressed component 10 prior to demolding.

In the comparative example, the first and second moment arising at the portions a and the portions b of the pressed component 10 as described above are cancelled out (balanced out) by the third moment arising at the ridge line portions 10B of the pressed component 10, thereby suppressing spring-back in the pressed component 10. However, in the manufacturing method of the comparative example, the greater the projection amount H of the inner pad 68 from the punch 66, the greater the amount by which the slack portions 52 are bent. This results in a tendency for the amount by which the slack portions 52 curve so as to be convex toward the front face side of the blank 50 to become greater.

The greater the projection amount H of the inner pad 68 from the punch 66, the greater the first moment arising at the portion a and the second moment arising at the portion b of the pressed component 10. Accordingly, a displacement amount of the vertical walls 10C toward the inside of the pressed component 10 tends to become greater as the projection amount H becomes larger. In other words, as the first and second moments increase, the width direction dimensions of the vertical walls 10C change excessively with respect to the projection amount H of the inner pad 68 from the punch 66. As a result, a permissible range (the difference between the upper limit and lower limit) of the projection amount H of the inner pad 68 from the punch 66 becomes more restrictive in order to keep the vertical walls 10C within a tolerance for the intended shape (of the manufactured component) after forming.

However, in the present exemplary embodiment, the pre-processed intermediate formed component 20 is employed to form the pressed component 10. Namely, the pre-bent portions 20F are formed at the width direction intermediate portion of the intermediate formed component 20, and the inclined walls 20C of the intermediate formed component 20 that correspond to the slack portions 52 described above are pre-bent toward the punch shoulder 66H side. In other words, the inclined walls 20C of the intermediate formed component 20 are closer to the punch shoulders 66H than in the comparative example.

Figure 10:
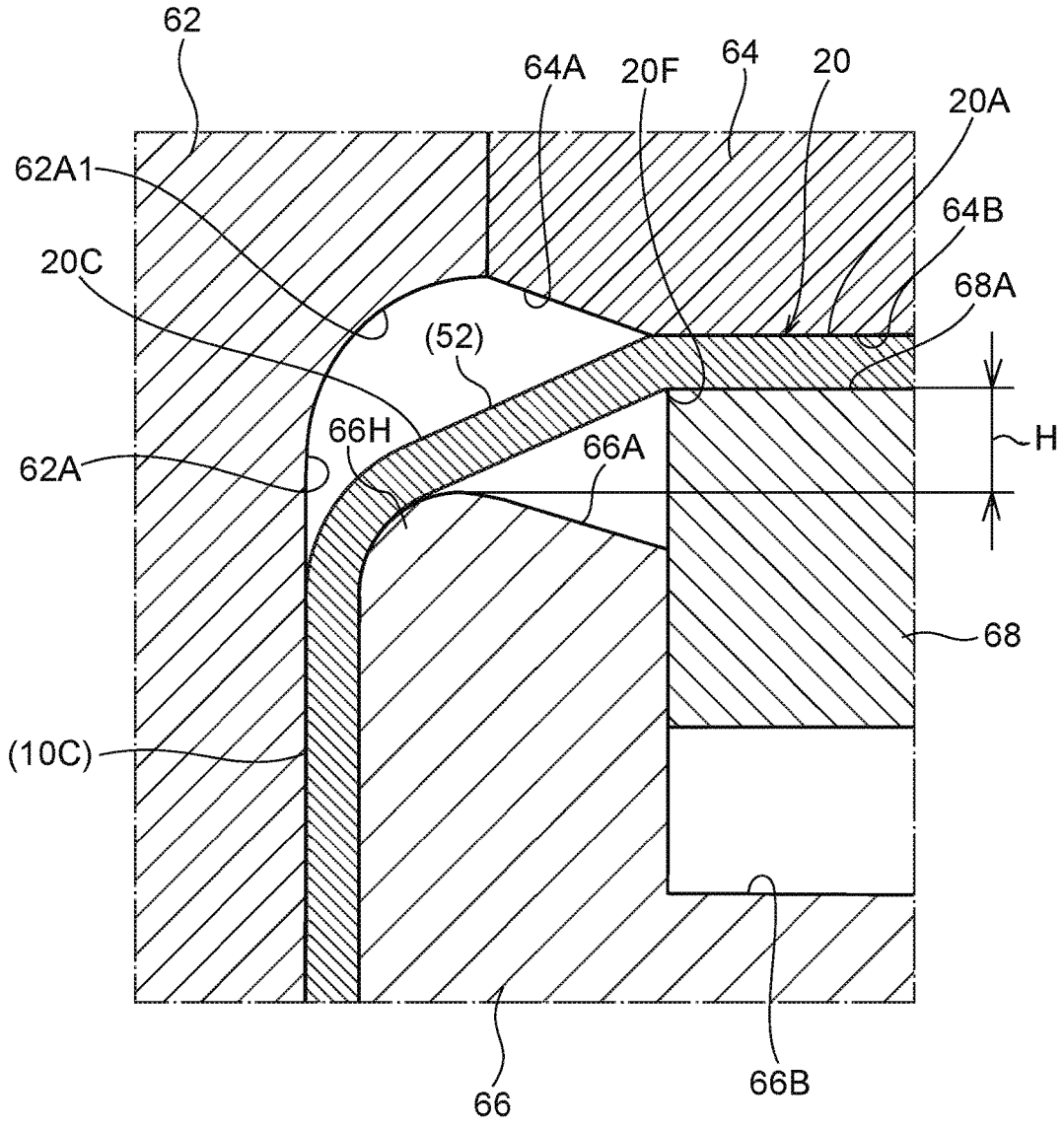
FIG. 10 is an enlarged cross-section illustrating the vicinity of a punch shoulder illustrated in FIG. 2A.

Accordingly, as illustrated in FIG. 10, when the die 62 is pressed toward the punch 66 side to form the vertical walls 10C of the pressed component 10, the portions of the inclined walls 20C corresponding to the slack portions 52 are suppressed from deforming into a convex curve toward the front face side of the inclined walls 20C. Accordingly, the second moment is suppressed from arising at the portion b described above in the pressed component 10 after demolding. As a result, mainly the first moment toward the inside of the pressed component 10 arising at the portions a of the pressed component 10 and the third moment toward the outside of the pressed component 10 arising at the ridge line portions 10B of the pressed component 10 cancel each other out (balance each other out), enabling spring-back of the pressed component 10 to be suppressed.

Namely, the second moment can be suppressed from influencing the width direction displacement amount of the vertical walls 10C, enabling the width direction displacement amount of the vertical walls 10C to be regulated using mainly the first moment alone. The width direction dimensions of the vertical walls 10C are thus suppressed from changing excessively with respect to the projection amount H of the inner pad 68 from the punch 66. As a result, the permissible range (difference between the upper limit and lower limit) of the projection amount H of the inner pad 68 from the punch 66 can be expanded. The displacement amount of the vertical walls 10C toward the inside of the pressed component 10 can also be suppressed from becoming inordinately large as the projection amount H of the inner pad 68 from the punch 66 increases.

As described above, the pressed component 10 can be formed with the dimensional precision of the vertical walls 10C secured within the tolerance, even with an expanded range of the projection amount H of the inner pad 68 from the punch 66.

Figure 11:
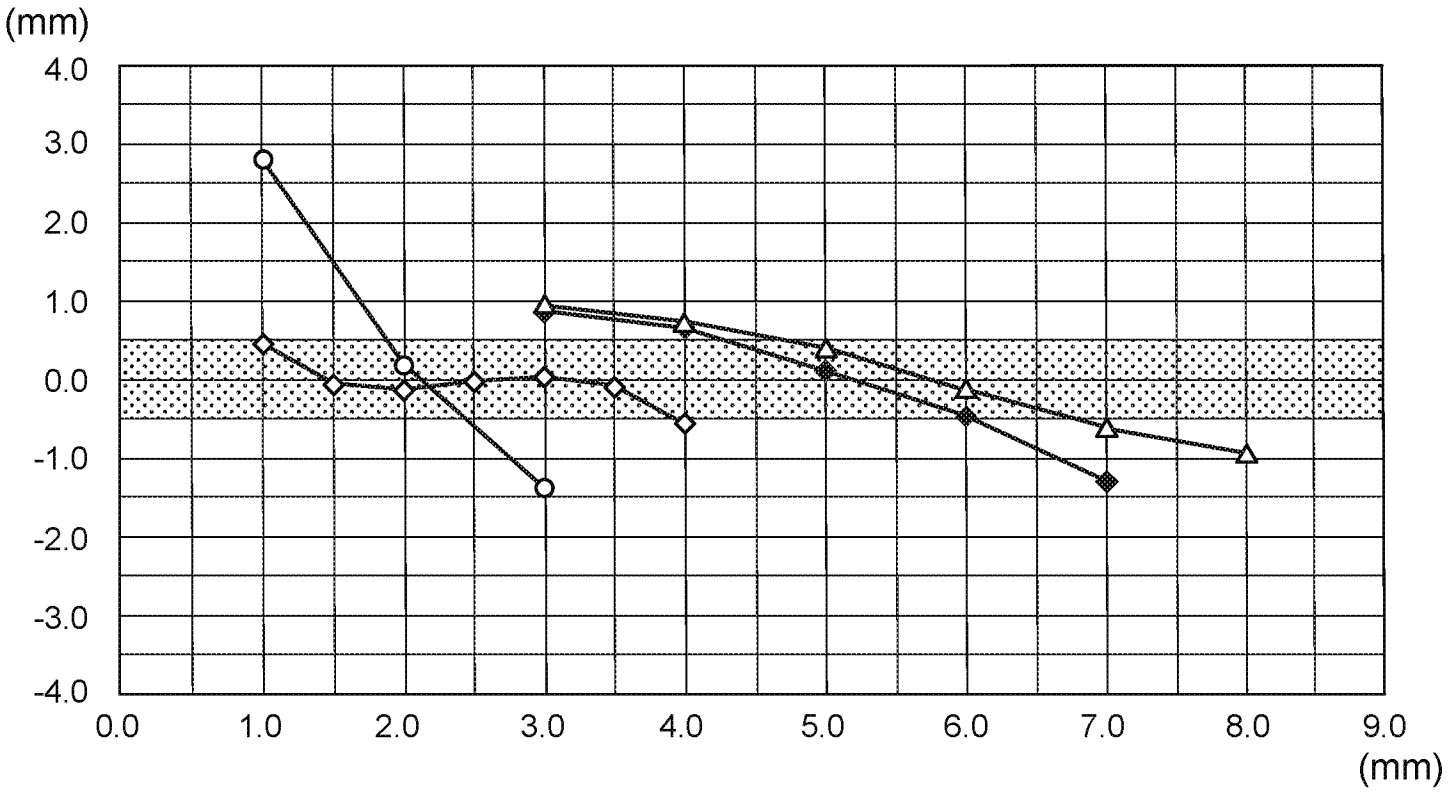
FIG. 11 is a graph illustrating a relationship between a projection amount of an inner pad from a punch, and the amount of departure of a vertical wall from an intended shape.

Explanation follows regarding this point, with reference to the graph illustrated in FIG. 11. This graph illustrates simulation results for forming the pressed component 10 illustrated in FIG. 12 using the manufacturing methods of the comparative example and of the present exemplary embodiment. The graph illustrates a relationship between the projection amount H of the inner pad 68 from the punch 66 and the width direction positions of a leading end portion of one of the vertical walls 10C of the pressed component 10.

Figure 12:
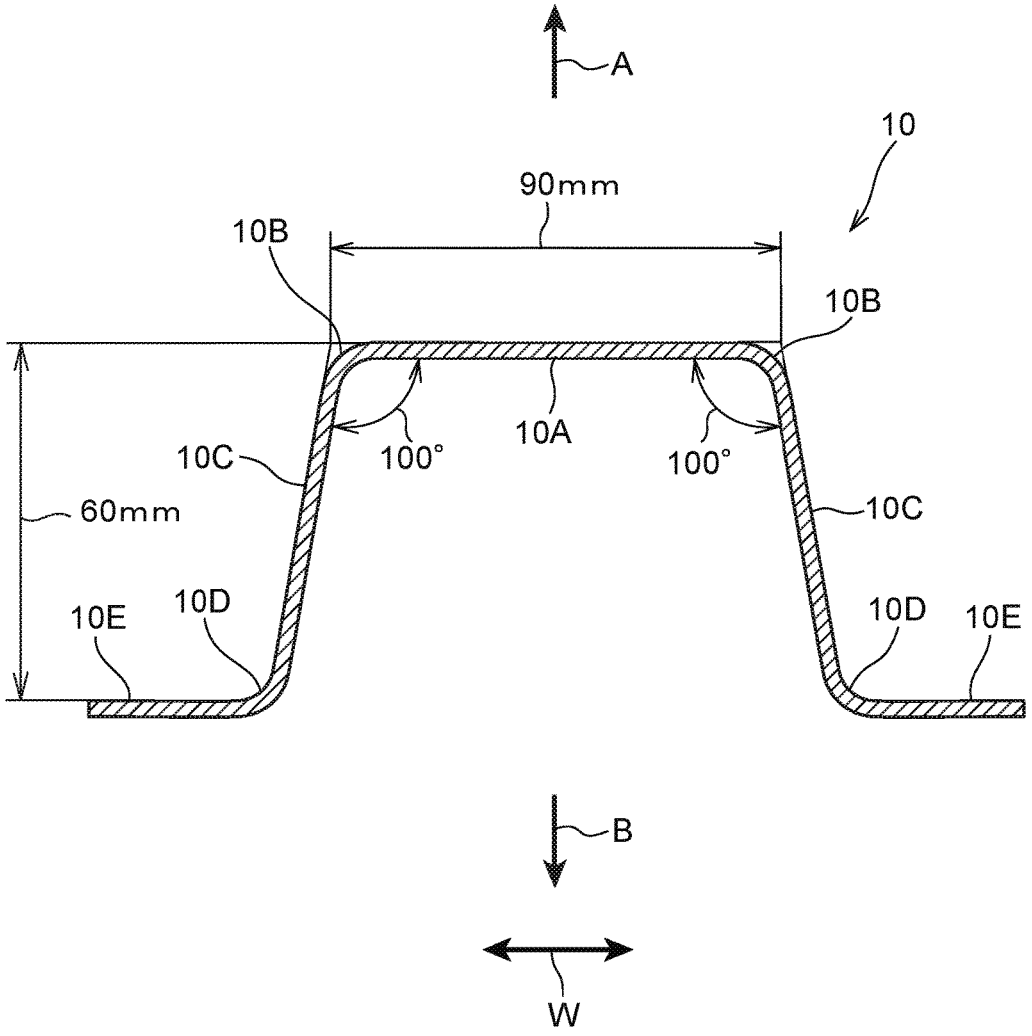
FIG. 12 is a front view cross-section of a pressed component employed in the explanation of the graph of FIG. 11.

First, explanation follows regarding various dimensions of the pressed component 10 illustrated in FIG. 12. In this pressed component 10, the width of the pressed component 10 at the top plate 10A side is 90 mm, and an up-down dimension of the pressed component 10 (the up-down dimension from the front face of the top plate 10A to the front faces of the flanges 10E) is 60 mm. The angle θ1 formed between the top plate 10A and the vertical walls 10C of the pressed component 10 is 100°. Moreover, the pressed component 10 is configured by high-strength sheet steel with a sheet thickness of 1.4 mm and a tensile strength of 1180 MPa.

In the graph illustrated in FIG. 11, the horizontal axis shows projection amounts H (mm) of the inner pad 68 from the punch shoulders 66H, and the vertical axis shows the positions of the leading end portion of one vertical wall 10C of the pressed component 10. Note that the vertical axis indicates the amount of departure (amount of variation) (mm) of the vertical wall 10C with respect to the intended shape of the vertical wall 10C in the width direction. Namely, the positive side of the vertical axis indicates positions of the vertical wall 10C toward the width direction outside of the intended shape (position) after forming, and the negative side of the vertical axis indicates positions of the vertical wall 10C toward the width direction inside of the intended shape (position) after forming. Moreover, in this graph, the dotted region is a region within the tolerance of the intended shape of the one vertical wall 10C. Namely, in the present exemplary embodiment, the tolerance with respect to the intended shape of the one vertical wall 10C is set to ±0.5 mm. In the graph, the points shown by white circles are data for the comparative example, and the points shown by white squares are data for the present exemplary embodiment.

As shown in the graph, in the pressed component 10 of the comparative example, the greater the projection amount H of the inner pad 68 from the punch shoulders 66H, the larger the width direction displacement amount of the vertical wall 10C. In other words, in the comparative example, the slope of a line connecting the data points is comparatively steep. Moreover, in the comparative example, in order to form the vertical wall 10C within the tolerance of the intended shape, the projection amount H has to be set approximately between 1.9 mm and 2.5 mm, giving a permissible range of the projection amount H of approximately 0.6 mm in manufacture. Namely, in the press 60, the position of the inner pad 68 with respect to the punch 66 has to be adjusted within the permissible range of the projection amount H (within a range of 0.6 mm) to manufacture the pressed component 10.

By contrast, in the present exemplary embodiment, as illustrated by the graph in FIG. 11, the width direction displacement amount of the vertical wall 10C with respect to the amount of variation in the projection amount H of the inner pad 68 from the punch shoulders 66H is smaller. In other words, in the present exemplary embodiment, the slope of a line connecting the data points is gentler than in the comparative example.

Moreover, in the present exemplary embodiment, the projection amounts H in which the vertical wall 10C is formed within the tolerance of the intended shape are approximately from 1.0 mm to 4.0 mm. The permissible range of the projection amount H is thus expanded to approximately 3 mm in manufacture. Accordingly, the pressed component manufacturing method of the present exemplary embodiment enables the permissible range (difference between the upper limit and lower limit) of the projection amount H of the inner pad 68 from the punch 66, in which the vertical wall 10C is kept within the tolerance of the intended shape in the width direction after forming, to be expanded. Moreover, in the press 60, the inner pad 68 can be adjusted over an expanded range, enabling a contribution to be made to improving the productivity of the pressed component 10.

Note that in the present exemplary embodiment illustrated in FIG. 11, when the projection amount H of the inner pad 68 from the punch 66 is 2.5 mm, the pre-bend angle θ2 of the intermediate formed component 20 is set such that the inclined walls 20C of the intermediate formed component 20 contact the punch shoulders 66H.

Moreover, in the present exemplary embodiment, the apex portion 66F of the punch 66 in the press 60 is formed with the inclined faces 66A that are set back from the apex portion 66F progressively from the punch shoulders 66H toward the width direction center side of the punch 66. The lower face of the die pad 64 is formed with a convex profile corresponding to the apex portion 66F of the punch 66. Specifically, the lower face of the die pad 64 is formed with the inclined faces 64A disposed opposing the inclined faces 66A so as to be parallel to the inclined faces 66A. This enables the inclined walls 20C of the intermediate formed component 20 to be bent back at the third step described above. This thereby enables the top plate 10A of the pressed component 10 to be formed with a flat profile even with the pre-bent portions 20F pre-formed to the intermediate formed component 20.

In the press 60, the width of the inner pad 68 matches the width W2 of the top plate 20A of the intermediate formed component 20. Accordingly, at the first step described above, when the intermediate formed component 20 is placed (set) on the inner pad 68, the intermediate formed component 20 can be suppressed from slipping in the width direction with respect to the inner pad 68. This enables the intermediate formed component 20 to be placed (set) on the inner pad 68 in an appropriate manner, in a state in which the position of the intermediate formed component 20 is suppressed from slipping.

Moreover, in the press 60, the inclined faces 66A of the punch 66 are disposed adjacent to the inner pad 68. As described above, the width of the inner pad 68 matches the width W2 of the top plate 20A of the intermediate formed component 20. Moreover, at the lower face of the die pad 64, the inclined faces 64A and the top plate-gripping face 64B are disposed adjacent to each other. The width of the top plate-gripping face 64B matches the width W2 of the top plate 20A of the intermediate formed component 20, and overlaps the top plate 20A of the intermediate formed component 20 in the pressing direction.

Accordingly, when the die pad 64 and the inner pad 68 are gripping the top plate 20A of the intermediate formed component 20, the width direction positions of the boundaries between the inclined faces 64A and the top plate-gripping face 64B of the die pad 64 match the width direction positions of the pre-bent portions 20F of the intermediate formed component 20. Moreover, the width direction positions of the shoulders of the inner pad 68 match the width direction positions of the pre-bent portions 20F of the intermediate formed component 20. Accordingly, at the third step described above, when forming the top plate 10A of the pressed component 10, the pre-bent portions 20F of the intermediate formed component 20 are tightly gripped in a state bent back toward the back face side of the top plate 20A. This thereby enables creases at the pre-bent portions 20F to be removed from the top plate 10A of the pressed component 10. This thereby enables effective flattening of the top plate 10A of the pressed component 10 as a result.

Moreover, the pre-bend angle θ2 of the intermediate formed component 20 is set such that the inclined walls 20C contact the punch shoulders 66H when the top plate 20A of the intermediate formed component 20 is placed on the inner pad 68 in the first step described above. When the die 62 and the punch 66 form the vertical walls 10C of the pressed component 10, the inclined walls 20C of the intermediate formed component 20 contact the punch shoulders 66H. This thereby enables the portions of the inclined walls 20C corresponding to the slack portions 52 described above to be effectively suppressed from deforming so as to curve toward the front face side of the inclined walls 20C. In other words, the pressed component 10 can be formed while keeping the portions of the inclined walls 20C corresponding to the slack portions 52 inclined in substantially straight line shapes. This thereby enables the second moment to be effectively suppressed from arising at the portions b of the pressed component 10 described above, enabling the influence of the second moment to be effectively suppressed.

Second Exemplary Embodiment

Figure 13:
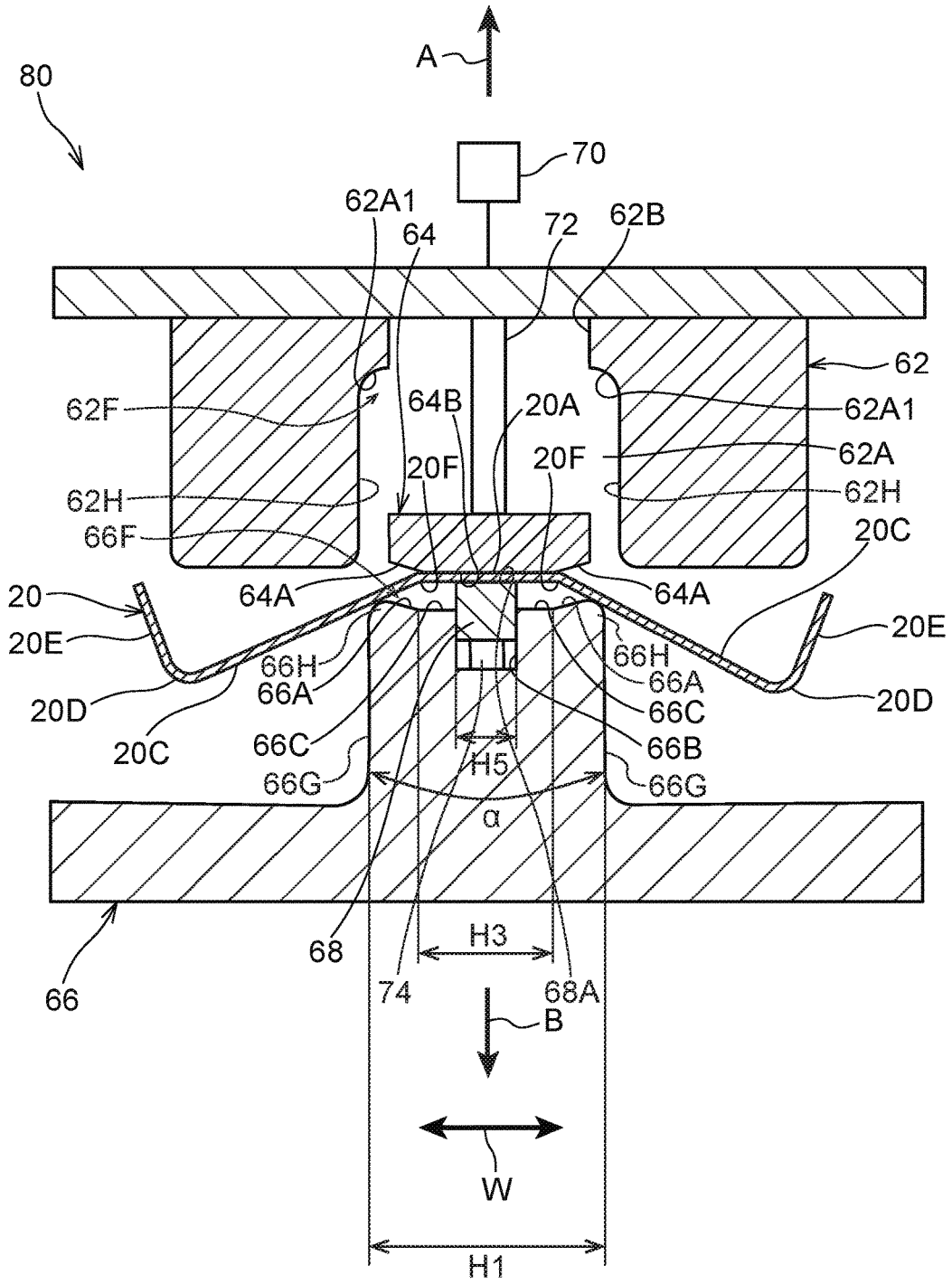
FIG. 13 is a front view cross-section of a press, illustrating a state of a first step of a pressed component manufacturing method according to a second exemplary embodiment.
Figure 14A:
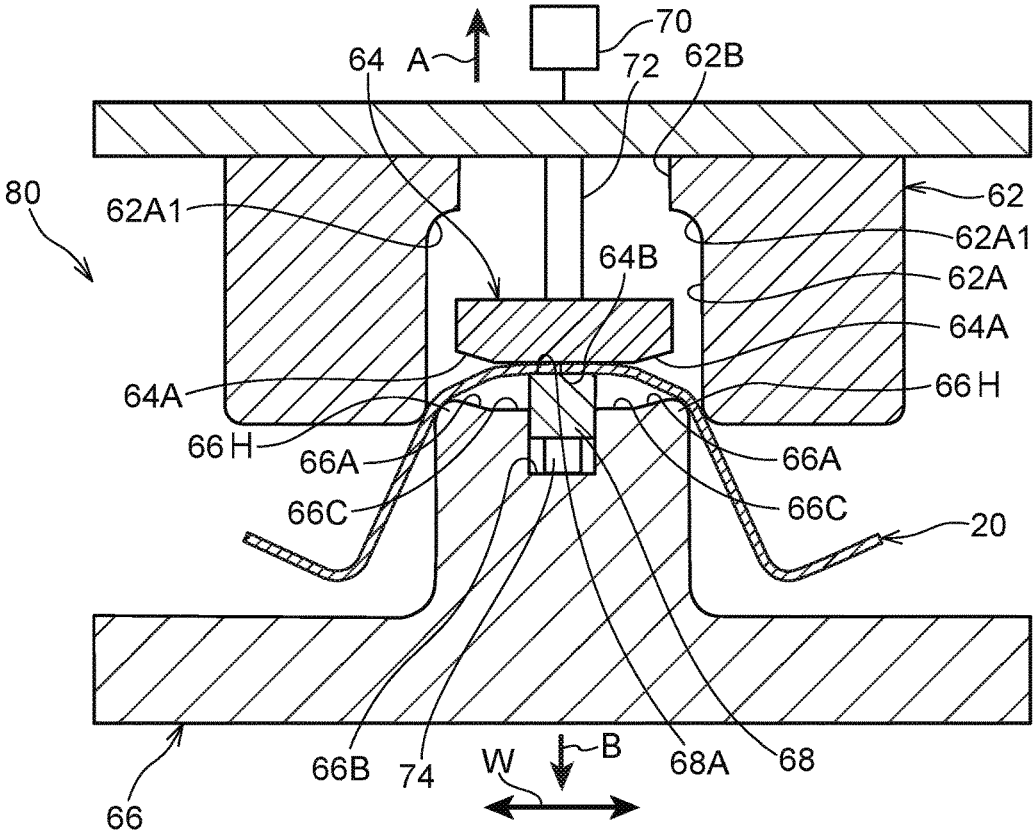
FIG. 14A is a front view cross-section of a press, illustrating a state of a second step of a pressed component manufacturing method according to the second exemplary embodiment.

Next, explanation follows regarding a pressed component manufacturing method of a second exemplary embodiment, with reference to FIG. 13 to FIG. 15. In the second exemplary embodiment, the pressed component 10 is formed using a press 80 that differs from the press 60 employed in the first exemplary embodiment. The press 80 employed in the second exemplary embodiment is similar to the press 60 employed in the first exemplary embodiment with the exception of the punch 66. This will be described in detail below. Note that portions of the press 80 similar to those of the press 60 are allocated the same reference numerals.

In the punch 66 of the press 80, a width H5 of the inner pad 68 is smaller than the width H4 of the first exemplary embodiment. Namely, the width H4 of the inner pad 68 is smaller than the width W2 of the top plate 20A of the intermediate formed component 20. The width of the pad housing portion 66B of the punch 66 is therefore also smaller than that of the first exemplary embodiment.

Top plate intermediate forming faces 66C for forming a width direction intermediate portion of the top plate 10A of the pressed component 10 are between the inclined faces 66A and the pad housing portion 66B at the apex portion 66F of the punch 66. The top plate intermediate forming faces 66C extend from width direction inside ends of the respective inclined faces 66A toward the width direction central side of the punch 66, and are parallel to the top plate-gripping face 64B of the die pad 64.

Namely, the top plate intermediate forming faces 66C are disposed in a plane orthogonal to the pressing direction, and the punch 66 is formed with the top plate intermediate forming faces 66C, these being orthogonal to the pressing direction, as an example of other faces having a gentler incline than the inclined faces 66A. The top plate intermediate forming faces 66C are disposed on the pad housing portion 66B side, between the respective punch shoulder 66H and the pad housing portion 66B.

Accordingly, an apex face of the punch 66 is configured by the pair of inclined faces 66A and a pair of the top plate intermediate forming faces 66C, and locations opposing the inclined faces 66A and the top plate intermediate forming faces 66C are configured with a profile inverted in contour from that of the inclined faces 66A and the top plate intermediate forming faces 66C.

Moreover, the width direction distance from the inner pad 68 to the pre-bent portions 20F of the intermediate formed component 20 and the distance from the inner pad 68 to the boundaries between the inclined faces 66A and the top plate intermediate forming faces 66C are set so as to be the same as each other. Namely, in a state in which the die pad 64 and the inner pad 68 are gripping the top plate 20A of the intermediate formed component 20, the pre-bent portions 20F of the intermediate formed component 20 and the boundaries between the inclined faces 66A and the top plate intermediate forming faces 66C are disposed opposing each other in the pressing direction. Moreover, when the inner pad 68 is housed in the pad housing portion 66B, the top plate-gripping face 68A of the inner pad 68 is disposed in the same plane as the top plate intermediate forming faces 66C.

The width between the boundary between the inclined face 66A and the top plate intermediate forming face 66C on one side of the pad housing portion 66B and the boundary between the inclined face 66A and the top plate intermediate forming face 66C on another side of the pad housing portion 66B is H3. The width H3 has the same dimension as the width H2 of the pre-forming punch recess bottom face 32A of the pre-forming punch 32.

In the second exemplary embodiment, the pressed component 10 is formed by going through the first step to the third step, similarly to in the first exemplary embodiment. Namely, as illustrated in FIG. 13, at the first step, the inner pad 68 projects from the pad housing portion 66B toward the apparatus upper side. In this state, the top plate-gripping face 64B of the die pad 64 and the top plate-gripping face 68A of the inner pad 68 grip the top plate 20A of the intermediate formed component 20 in the pressing direction.

Figure 14B:
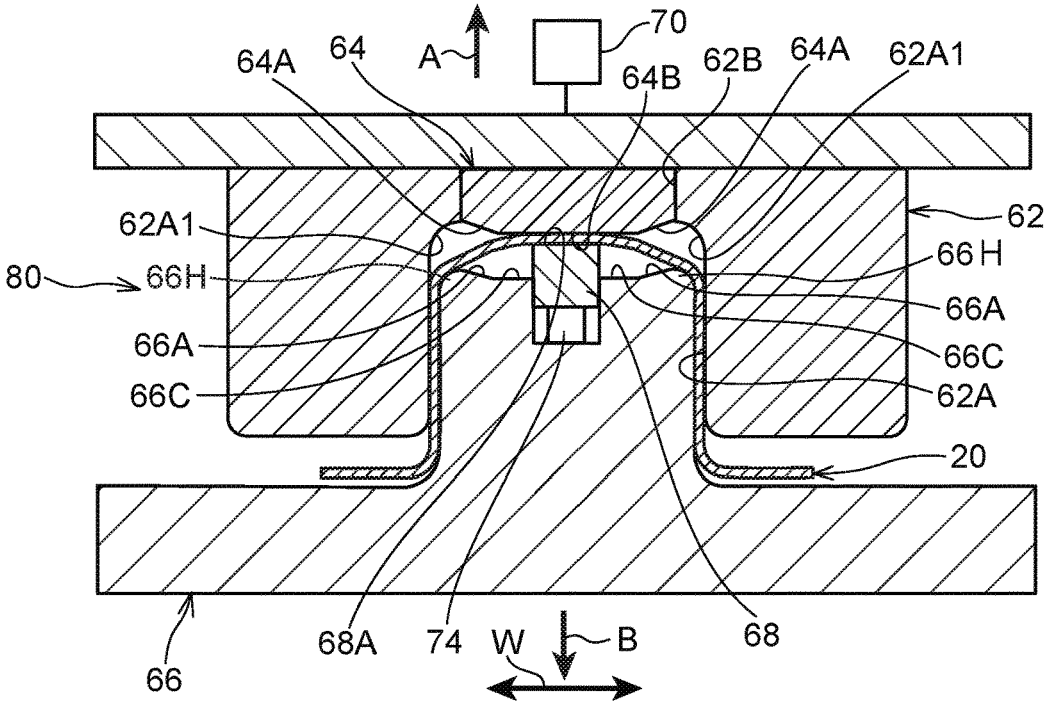
FIG. 14B is a front view cross-section of a press, illustrating a state in which a die has moved relatively toward a punch side from the state illustrated in FIG. 14A, and the die and a die pad have been integrated into a single unit.

At the second step, the mover device 70 moves the die 62 toward the apparatus lower side (punch 66 side) from the state illustrated in FIG. 13. The punch 66 is thereby pushed into the recess 62A of the die 62, forming the inclined walls 20C of the intermediate formed component 20 (see FIG. 14A). The mover device 70 then moves the die 62 further toward the apparatus lower side, such that the die 62 and the die pad 64 are integrated into a single unit. Namely, as illustrated in FIG. 14B, the die pad 64 is housed in the pad housing portion 62B. Note that a similar effect may be achieved by attaching a mover device to the punch 66 to move the punch 66 toward the apparatus upper side (die 62 side).

At the third step, the mover device 70 moves the single unit configured by the die 62 and the die pad 64 further toward the apparatus lower side, pressing the die 62 and the die pad 64 toward the punch 66 side. When this is performed, the inner pad 68 moves toward the apparatus lower side together with the die 62 and the die pad 64 while the pad pressurizer 72 and the pad pressurizer 74 maintain the tight grip of the die pad 64 and the inner pad 68 on the top plate 20A. The inner pad 68 is then housed in the pad housing portion 66B (see FIG. 15A). Specifically, the inner pad 68 is housed inside the pad housing portion 66B such that a portion of the intermediate formed component 20 corresponding to the top plate 10A of the pressed component 10 becomes flat.

Figure 15A:
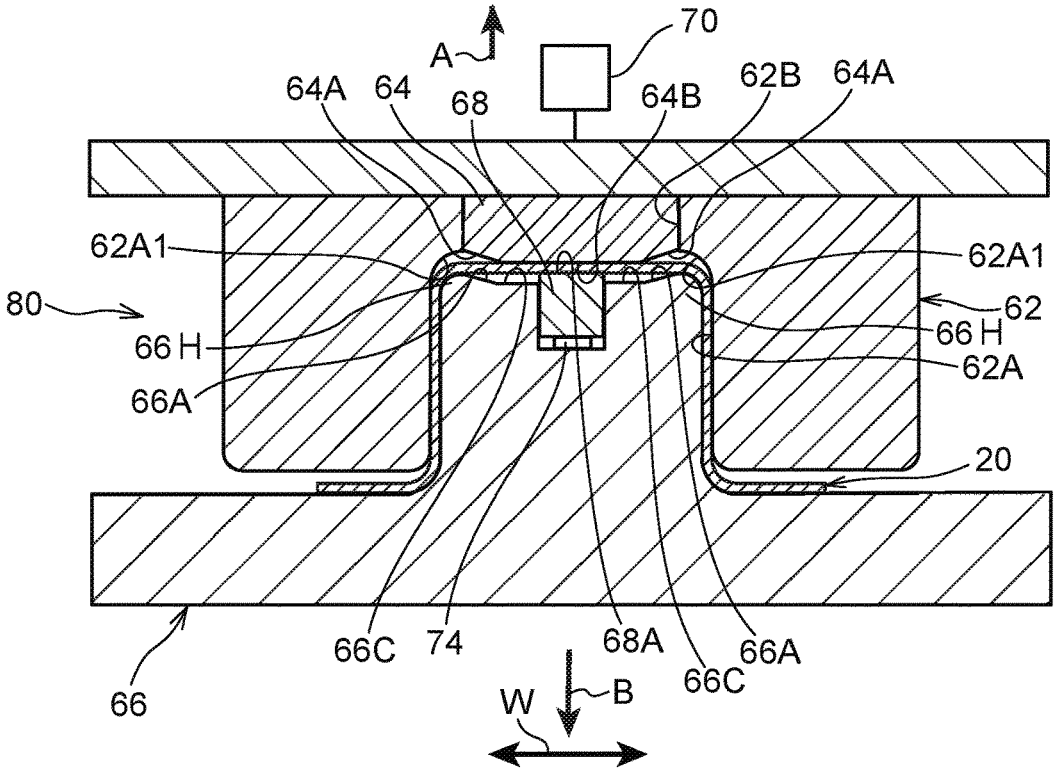
FIG. 15A is a front view cross-section of a press, illustrating a state in which the die and the die pad have moved relatively further toward the punch side from the state illustrated in FIG. 14B.
Figure 15B:
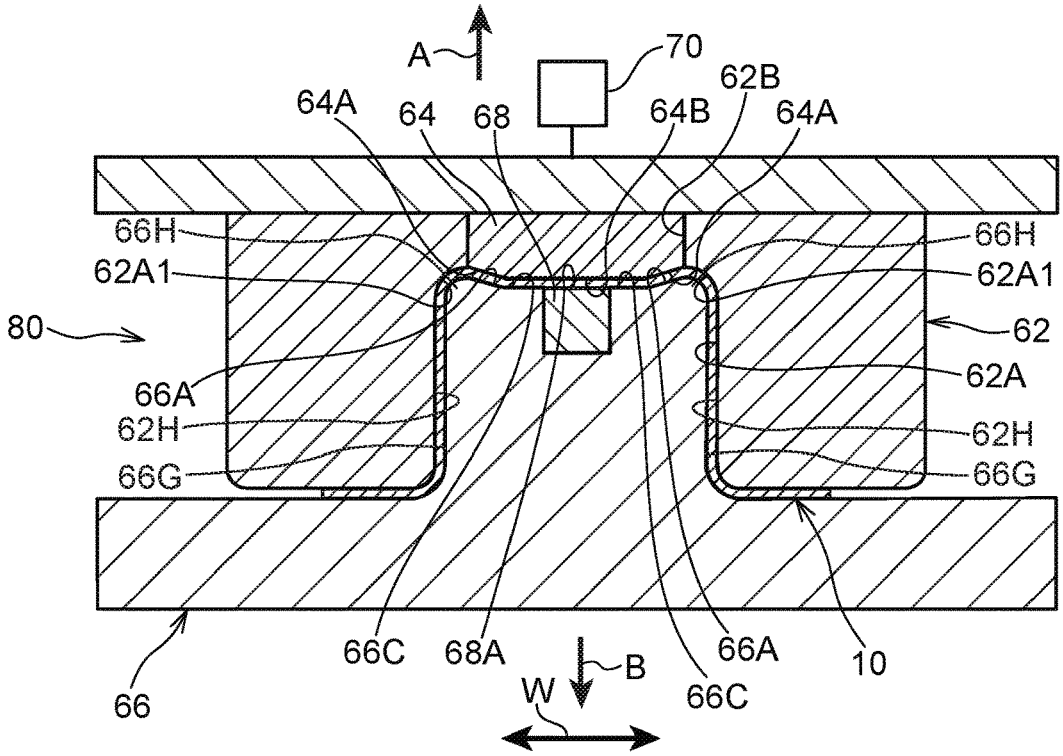
FIG. 15B is a front view cross-section of a press, illustrating a state in which the die and the die pad have reached bottom dead center from the state illustrated in FIG. 15A.

The mover device 70 then moves the single unit configured by the die 62 and the die pad 64 from the state illustrated in FIG. 15A further toward the lower side, pressing the die 62 and the die pad 64 toward the punch 66 side. The pre-bent portions 20F of the intermediate formed component 20 are thereby bent back by the die 62 and the die pad 64, and the inner pad 68 and the punch 66 (see FIG. 15B). As a result, the top plate 10A of the pressed component 10 is formed with a flat plane profile after demolding. In this manner, the second exemplary embodiment also suppresses the second moment described above from arising in the pressed component 10, and is thus capable of achieving similar operation and advantageous effects to those of the first exemplary embodiment.

In the second exemplary embodiment, the width direction dimension of the inner pad 68 is smaller than in the first exemplary embodiment. Accordingly, the distance along the inclined walls 20C of the intermediate formed component 20 from the shoulders of the inner pad 68 to the punch shoulders 66H (namely, the length of portions corresponding to the slack portions 52 described above) is longer than in the first exemplary embodiment. In other words, in the second exemplary embodiment, when forming the vertical walls 10C in the second step of the pressed component manufacturing method, the top plate intermediate forming faces 66C of the punch 66 and the portions of the intermediate formed component 20 opposing the top plate intermediate forming faces 66C in the pressing direction are not restrained from moving toward the apparatus lower side by the inner pad 68.

Accordingly, at the second step of the pressed component manufacturing method, when forming the vertical walls 10C, the portions of the intermediate formed component 20 corresponding to the slack portions 52 deform readily within their elastic range, enabling the second moment described above to be further suppressed from arising. This thereby enables the range of the projection amount H of the inner pad 68 from the punch 66 to be expanded, while setting a comparatively large projection amount H.

The graph in FIG. 11 illustrates a relationship between the projection amount H of the inner pad 68 from the punch 66 and the width direction position of a leading end portion of one of the vertical walls 10C of the pressed component 10 in a case in which the pressed component 10 in FIG. 12 has been formed using the manufacturing method of the second exemplary embodiment. Note that in the graph, the points shown by black squares are data for the second exemplary embodiment.

As shown in the graph, in the second exemplary embodiment too, the width direction displacement amount of the vertical wall 10C with respect to the amount of variation of the projection amount H of the inner pad 68 from the punch shoulders 66H is smaller than that in the comparative example described above. In other words, in the second exemplary embodiment too, a slope connecting the data points is gentler than in the comparative example. Specifically, the range of the projection amount H for forming the vertical wall 10C within the tolerance of the intended shape can be expanded to approximately 1.8 mm. Moreover, in the second exemplary embodiment, the overall projection amount H of the inner pad 68 from the punch shoulders 66H can be made greater than in the first exemplary embodiment.

Third Exemplary Embodiment

Figure 16:
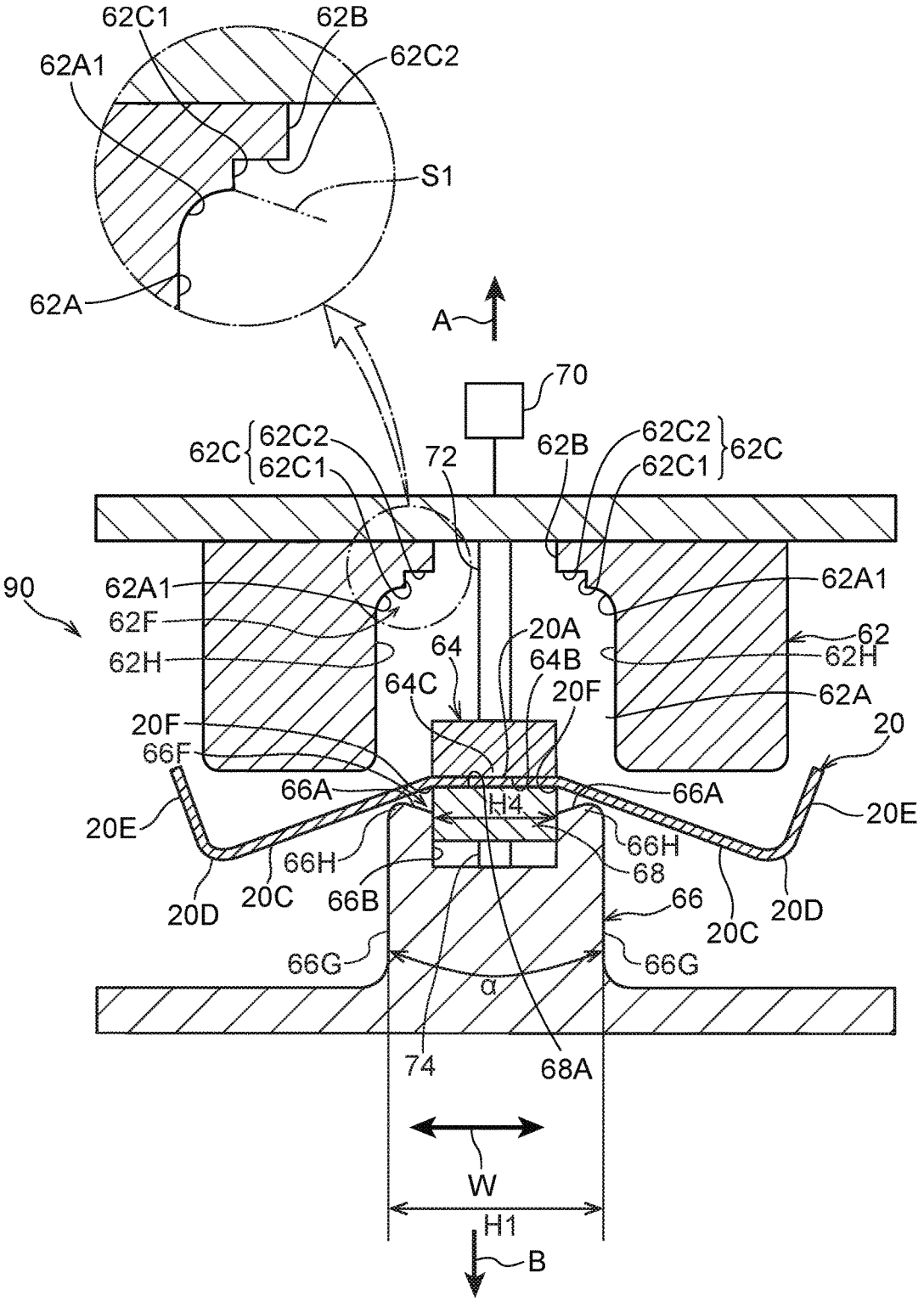
FIG. 16 is a front view cross-section of a press, illustrating a state of a first step of a pressed component manufacturing method according to a third exemplary embodiment.
Figure 17A:
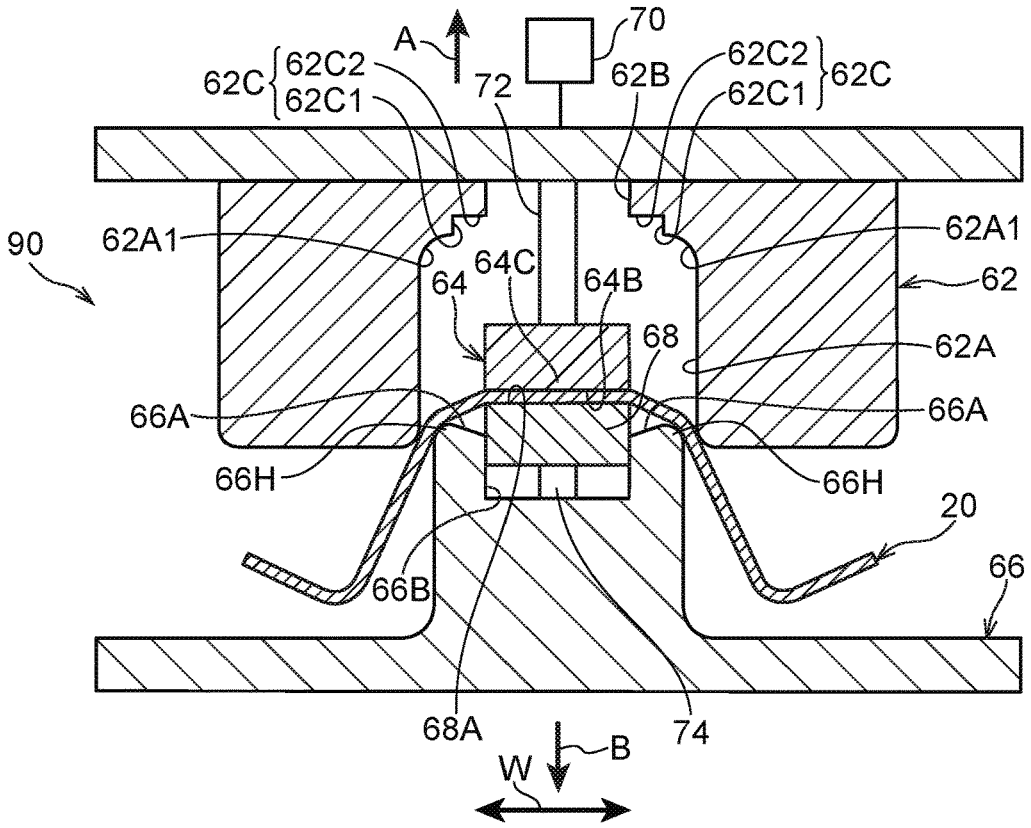
FIG. 17A is a front view cross-section of a press, illustrating a state of a second step of a pressed component manufacturing method according to the third exemplary embodiment.

Next, explanation follows regarding a pressed component manufacturing method of a third exemplary embodiment, with reference to FIG. 16 to FIG. 18. In the third exemplary embodiment, the pressed component 10 is formed using a press 90 that differs from the press 60 employed in the first exemplary embodiment. The press 90 is similar to the press 60 employed in the first exemplary embodiment with the exception of the die 62 and the die pad 64. These will be described in detail below. Note that portions of the press 90 similar to those of the press 60 are allocated the same reference numerals.

In the press 90, the width of the die pad 64 is the same dimension as the width of the inner pad 68. Namely, the width of the die pad 64 is smaller than in the first exemplary embodiment. Moreover, regarding the profile of the die pad 64, the inclined faces 64A of the first exemplary embodiment are omitted, such that the die pad 64 has a rectangular profile in front view cross-section. In other words, the lower face of the die pad 64 is configured by the top plate-gripping face 64B alone. Accordingly, the top plate-gripping face 64B of the die pad 64 is formed at a lower end portion 64C (corresponding to an opposing portion of the present application) of the die pad 64 opposing the inner pad 68 in the pressing direction.

In the die 62 of the press 90, the width of the pad housing portion 62B is smaller than in the first exemplary embodiment, so as to correspond with the width of the die pad 64. Accordingly, in the third exemplary embodiment (a bottom portion of the recess 62A of) the die 62 opposes the inclined face 66A of the punch 66 (the apex face of the punch 66) in the pressing direction.

Moreover, locations of the die 62 that oppose the inclined faces 66A of the punch 66 are formed with a pair of steps 62C, these being an example of die-side recesses opening toward the apparatus lower side and the width direction central side. The interiors of the steps 62C are in communication with the interior of the pad housing portion 62B. More specifically, locations of the die 62 between the ridge line-forming faces 62A1 and the pad housing portion 62B are formed with the pair of steps 62C as an element that may be understood as an escape portion. The steps 62C are set back in the pressing direction from the ridge line-forming faces 62A1.

Note that in the present exemplary embodiment, the steps 62C are provided on both sides of the pad housing portion 62B. However, there is no limitation thereto. A step 62C may be provided on a single side of the pad housing portion 62B. The steps 62C are provided with the same profile on both sides of the pad housing portion 62B. However, there is no limitation thereto. The step 62C provided on one side may have a different profile to the step 62C provided on the other side.

Moreover, in the present exemplary embodiment, the steps 62C are provided on both sides of the pad housing portion 62B to configure escape portions. However, there is no limitation thereto. For example, in the configuration illustrated in FIG. 1, in which the die pad 64 is formed with the inclined faces 64A, the apex portion 66F may be modified so as to be perpendicular to the pressing direction to create a gap between the intermediate formed component 20 and the inclined faces 64A of the die pad 64 in a state in which the die 62 has reached the bottom dead center. In such cases, the inclined faces 64A configure escape portions away from the top plate-gripping face 68A, serving as an example of an inner pad apex face, in the pressing direction. Moreover, the inclined faces 64A may extend as far as a location opposing the top plate-gripping face 68A (similar applies in the modified examples hereafter).

In front view cross-section, each of the steps 62C includes a side face 62C1 extending from the ridge line-forming face 62A1 at a width direction central side end portion of the die 62 toward the apparatus upper side, and an escape face 62C2 extending from an upper end portion of the side face 62C1 toward the width direction central side. The escape faces 62C2 of the steps 62C configure opposing faces opposing the inclined faces 66A of the punch 66 in the pressing direction, and correspond to a "location of the die opposing the punch apex face" of the present application. Moreover, if an imaginary plane starting at the ridge line-forming face 62A1 at a width direction central side end portion of the die 62 and disposed parallel to the inclined face 66A of the punch 66 configures a first imaginary plane S1 (see the enlarged portion in FIG. 16), then the escape face 62C2 would be further to the apparatus upper side (die 62 side) than the first imaginary plane S1.

Note that in the present exemplary embodiment, the escape faces 62C2 are configured as flat faces. However, there is no limitation thereto. For example, the escape faces 62C2 may be formed with circular arc shapes projecting in a direction away from the top plate-gripping face 68A of the inner pad 68. The escape faces 62C2 may also be configured as inclined portions.

Figure 17B:
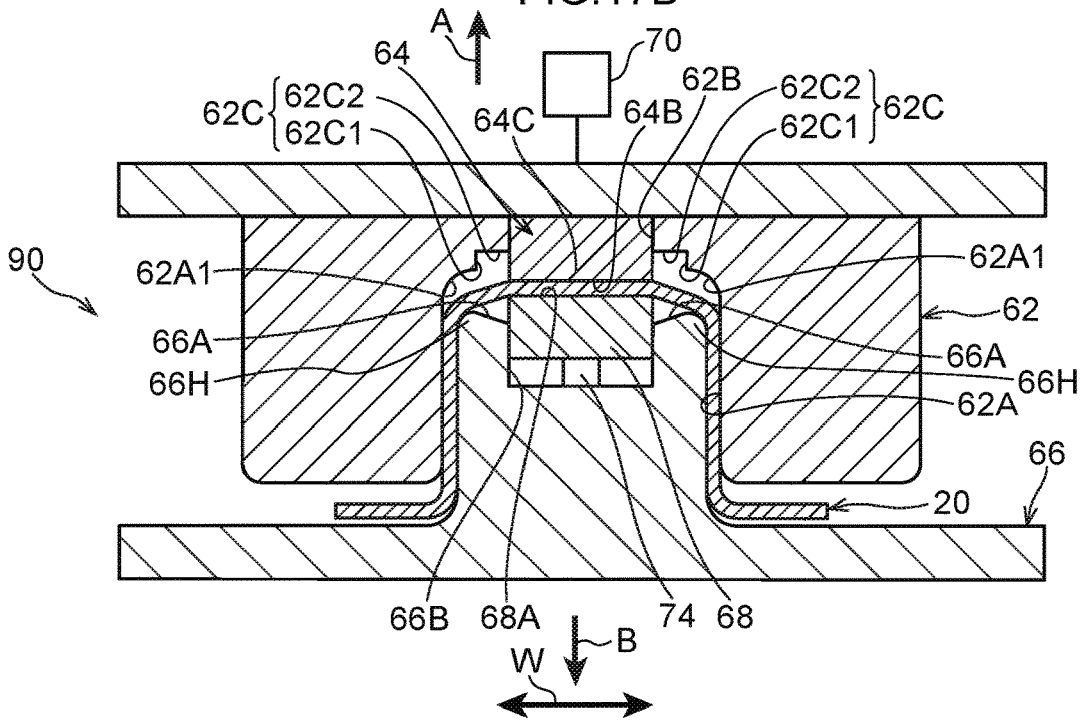
FIG. 17B is a front view cross-section of a press, illustrating a state in which a die has moved relatively toward a punch side from the state illustrated in FIG. 17A, and the die and the die pad have been integrated into a single unit.
Figure 18A:
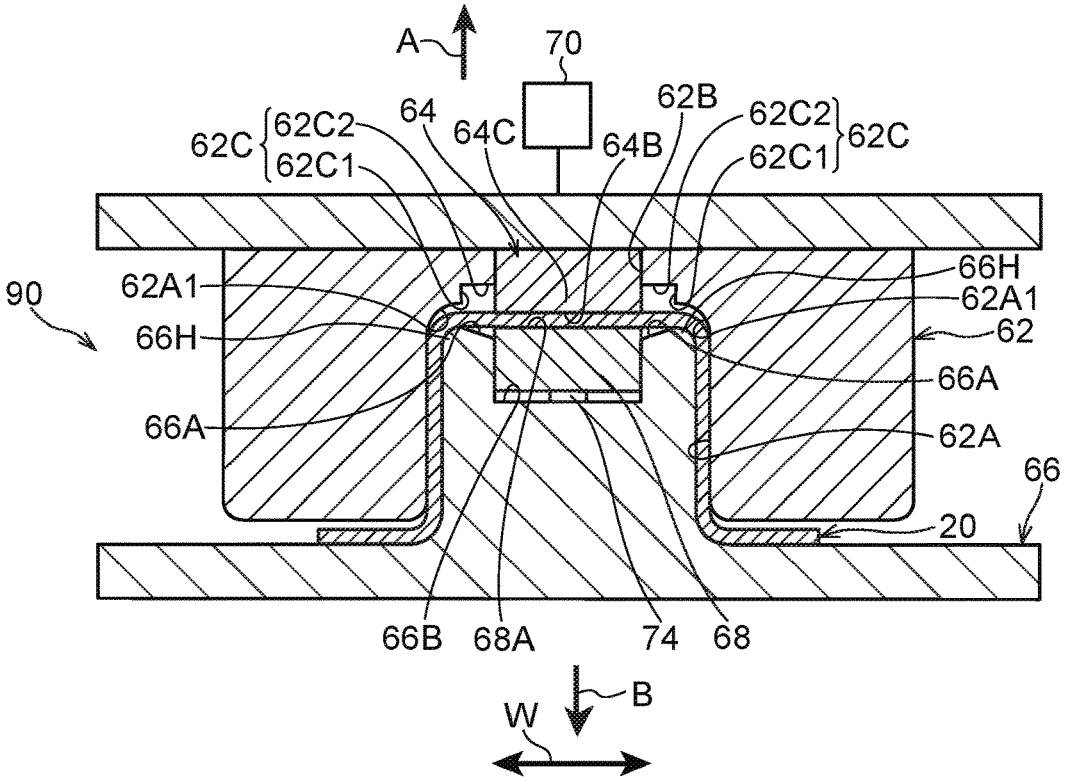
FIG. 18A is a front view cross-section of a press, illustrating a state in which the die and the die pad have moved relatively further toward the punch side from the state illustrated in FIG. 17B.
Figure 18B:
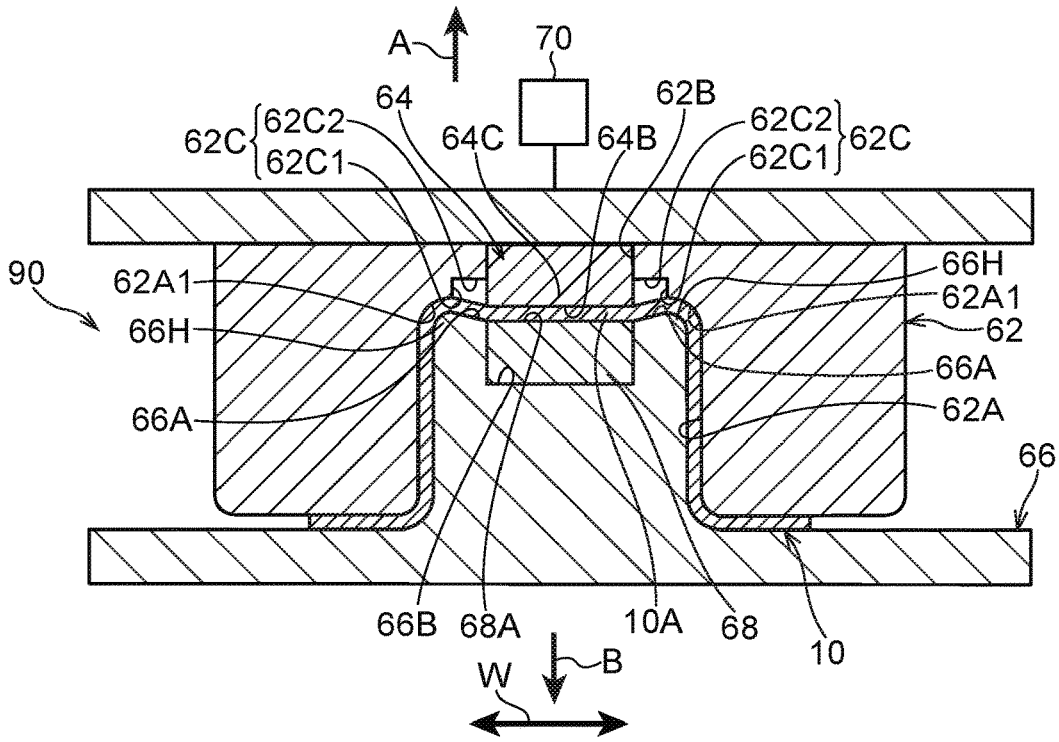
FIG. 18B is a front view cross-section of a press, illustrating a state in which the die and the die pad have reached bottom dead center from the state illustrated in FIG. 18A.

Due to the above configuration, as illustrated in FIG. 17B, FIG. 18A, and FIG. 18B, at the initial position of the die pad 64 (position in a state in which the die pad 64 and the die 62 are integrated into a single unit), the lower end portion 64C of the die pad 64 projects from the pad housing portion 62B of the die 62 toward the apparatus lower side. Moreover, the lower end portion 64C of the die pad 64 projects to the apparatus lower side of the escape faces 62C2 of the die 62 (namely, toward the inner pad 68 side). Moreover, as described above, the escape faces 62C2 of the die 62 are further to the apparatus upper side (the die 62 side) than the first imaginary plane S1. Accordingly, as illustrated in FIG. 18B, at the end of the third step (in other words, at the bottom dead center of the die 62 and the die pad 64), the escape faces 62C2 of the steps 62C are disposed at the apparatus upper side of the top plate 10A of the pressed component 10, and gaps (spaces) are formed between the steps 62C and the top plate 10A.

Specifically, the gaps (spaces) between the escape faces 62C2 and the top plate 10A become larger on progression toward the width direction central side. Accordingly, at the end of the third step (at the bottom dead center of the die 62 and the die pad 64), an opposing-direction spacing between the escape faces 62C2 of the die 62 and the inclined faces 66A of the punch 66 is larger than an opposing-direction spacing between the die pad 64 (top plate-gripping face 64B) and the inner pad 68 (top plate-gripping face 68A).

In the third exemplary embodiment, the pressed component 10 is formed by going through the first step to the third step, similarly to in the first exemplary embodiment. Namely, as illustrated in FIG. 16, at the first step, the inner pad 68 projects from the pad housing portion 66B toward the apparatus upper side. In this state, the top plate-gripping face 64B of the die pad 64 and the top plate-gripping face 68A of the inner pad 68 grip the top plate 20A of the intermediate formed component 20 in the pressing direction.

At the second step, the mover device 70 moves the die 62 toward the apparatus lower side (punch 66 side) from the state illustrated in FIG. 16. The die 62 approaches the die pad 64, the inner pad 68, and the punch 66 as a result. The punch 66 is thereby pushed into the recess 62A of the die 62, forming the inclined walls 20C of the intermediate formed component 20 (see FIG. 17A). The mover device 70 then moves the die 62 further toward the apparatus lower side. The die 62 and the die pad 64 are integrated into a single unit as a result. Namely, as illustrated in FIG. 17B, the die pad 64 is housed in the pad housing portion 62B. When this is performed, the lower end portion 64C of the die pad 64 adopts a state projecting to the apparatus lower side of the escape faces 62C2 of the steps 62C of the die 62. Note that a similar effect may be achieved by attaching a mover device to the punch 66 to move the punch 66 toward the apparatus upper side (die 62 side).

At the third step, the mover device 70 moves the single unit configured by the die 62 and the die pad 64 further toward the apparatus lower side so as to press the die 62 and the die pad 64 toward the punch 66 side. When this is performed, the inner pad 68 moves toward the apparatus lower side together with the die 62 and the die pad 64 while the pad pressurizer 72 and the pad pressurizer 74 maintain the tight grip of the die pad 64 and the inner pad 68 on the top plate 20A. The inner pad 68 is then housed in the pad housing portion 66B (see FIG. 18A). Specifically, the inner pad 68 is housed inside the pad housing portion 66B such that a portion of the intermediate formed component 20 corresponding to the top plate 10A of the pressed component 10 becomes flat.

The mover device 70 then moves the single unit configured by the die 62 and the die pad 64 from the state illustrated in FIG. 18A further toward the lower side, pressing the die 62 and the die pad 64 toward the punch 66 side. The pre-bent portions 20F of the intermediate formed component 20 are thereby bent back by the die pad 64 and the inner pad 68 (see FIG. 18B). As a result, the top plate 10A of the pressed component 10 is formed with a flat plane profile after demolding. In this manner, the third exemplary embodiment also suppresses the second moment described above from arising in the pressed component 10, and is thus capable of achieving similar operation and advantageous effects to those of the first exemplary embodiment.

Moreover, in the third exemplary embodiment, as illustrated in FIG. 18B, at the end of the third step when the die 62 and the die pad 64 reach the bottom dead center, the lower end portion 64C of the die pad 64 projects to the apparatus lower side of the escape faces 62C2 of the steps 62C of the die 62. The escape faces 62C2 are thus distanced toward the apparatus upper side with respect to the top plate 10A of the pressed component 10.

Namely, in the third exemplary embodiment, at the end of the third step, portions at both width direction end sides of the top plate 10A (portions corresponding to the portion bin FIG. 9) are not gripped by the inclined faces 66A of the punch 66 and the die 62, and gaps (spaces) are formed between the top plate 10A and the escape faces 62C2. This thereby enables the second moment to be effectively suppressed from arising at the portions b of the pressed component 10 described above (see FIG. 9), and the range of the projection amount H of the inner pad 68 from the punch 66 can be expanded while setting a comparatively large projection amount H.

Namely, in the third exemplary embodiment, similarly to in the first exemplary embodiment, the pressed component 10 is formed employing the pre-processed intermediate formed component 20. Accordingly, as described above, when forming the vertical walls 10C of the pressed component 10 at the second step, as illustrated in FIG. 10, the portions of the intermediate formed component 20 corresponding to the slack portions 52 of the inclined walls 20C are suppressed from deforming into convex curves toward the front face side of the inclined walls 20C.

However, at the second step, although curving deformation of the portions of the intermediate formed component 20 corresponding to the slack portions 52 of the inclined walls 20C is suppressed, it is difficult to entirely prevent curving deformation in the portions corresponding to the slack portions 52. Namely, sometimes slight curving deformation may arise at the portions corresponding to the slack portions 52 of the inclined walls 20C.

Note that if the slack portions 52 are gripped in a flat plate shape by the punch 66 and the die pad 64 after deforming into a curve, compressive stress arises at the outside of the pressed component 10 and tensile stress arises at the inside of the pressed component 10 at the portions b of the slack portions 52. The second moment therefore arises at the portions b of the pressed component 10.

Explanation follows regarding a case in which at the end of the third step, the slack portions 52 in which slight curving deformation has occurred are gripped by the inclined faces 66A of the punch 66 and the inclined faces 64A of the die pad 64 as in the first exemplary embodiment. In such cases, in the pressed component 10 prior to demolding, slight compressive stress arises at the outside of the pressed component 10 and slight tensile stress arises at the inside of the pressed component 10 at the portions corresponding to the portions b. A comparatively small second moment might therefore arise at the portions b.

However, in the third exemplary embodiment, configuration is made such that at the end of the third step, that the portions at both width direction end sides of the top plate 10A are not gripped by the inclined faces 66A of the punch 66 and the die 62. Accordingly, the second moment can be more thoroughly suppressed at the portions b of the pressed component 10 prior to demolding than in the first exemplary embodiment. Namely, the influence of the second moment on the width direction displacement amount of the vertical walls 10C can be more thoroughly suppressed than in the first exemplary embodiment.

Moreover, in the third exemplary embodiment, similarly to in the first exemplary embodiment, since the first moment and the third moment mainly cancel each other out, the width direction displacement amount of the vertical walls 10C is suppressed. However, in order to cancel out the third moment, it is necessary to set the first moment larger than in the first exemplary embodiment by an amount commensurate with the suppression of the second moment. Namely, the length of the portions a of the pressed component 10 (see FIG. 9) configuring the base end portions of the vertical walls 10C has to be made longer than in the first exemplary embodiment. The projection amount H of the inner pad 68 from the punch 66 therefore tends to become greater than in the first exemplary embodiment. Due to the above, in the third exemplary embodiment, the range of the projection amount H of the inner pad 68 from the punch 66 can be expanded, while setting a comparatively large projection amount H.

The graph in FIG. 11 illustrates a relationship between the projection amount H of the inner pad 68 from the punch 66 and the width direction position of a leading end portion of one of the vertical walls 10C of the pressed component 10 in a case in which the pressed component 10 illustrated in FIG. 12 has been formed using the manufacturing method of the third exemplary embodiment. Note that in the graph, the points shown by white triangles are data for the third exemplary embodiment.

As shown in the graph, in the third exemplary embodiment too, the width direction displacement amount of the vertical wall 10C with respect to the amount of variation of the projection amount H of the inner pad 68 from the punch shoulders 66H is smaller than that in the comparative example described above. In other words, in the third exemplary embodiment too, a slope connecting the data points is gentler than in the comparative example. Specifically, the range of the projection amount H for forming the vertical wall 10C within the tolerance of the intended shape can be expanded to approximately 2 mm. Moreover, in the third exemplary embodiment, the overall projection amount H of the inner pad 68 from the punch shoulders 66H can be made greater than in the first exemplary embodiment.

Modified Examples of the Press 90

Next, explanation follows regarding plural modified examples of the press 90 employed in the pressed component manufacturing method of the third exemplary embodiment.

First Modified Example of the Press 90

Figure 19:
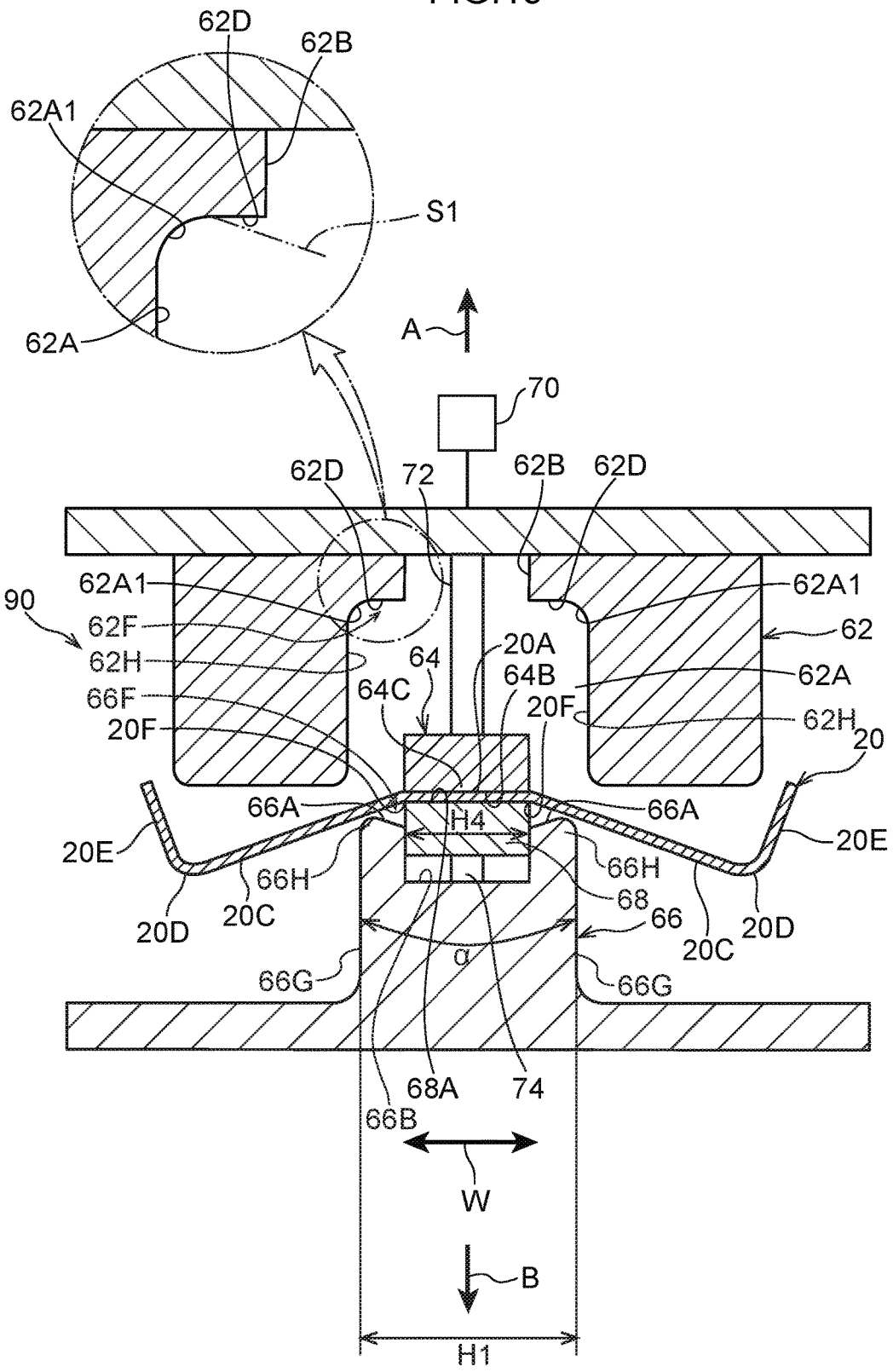
FIG. 19 is a cross-section corresponding to FIG. 16, illustrating a case in which a first modified example of the press illustrated in FIG. 16 is employed.
Figure 20A:
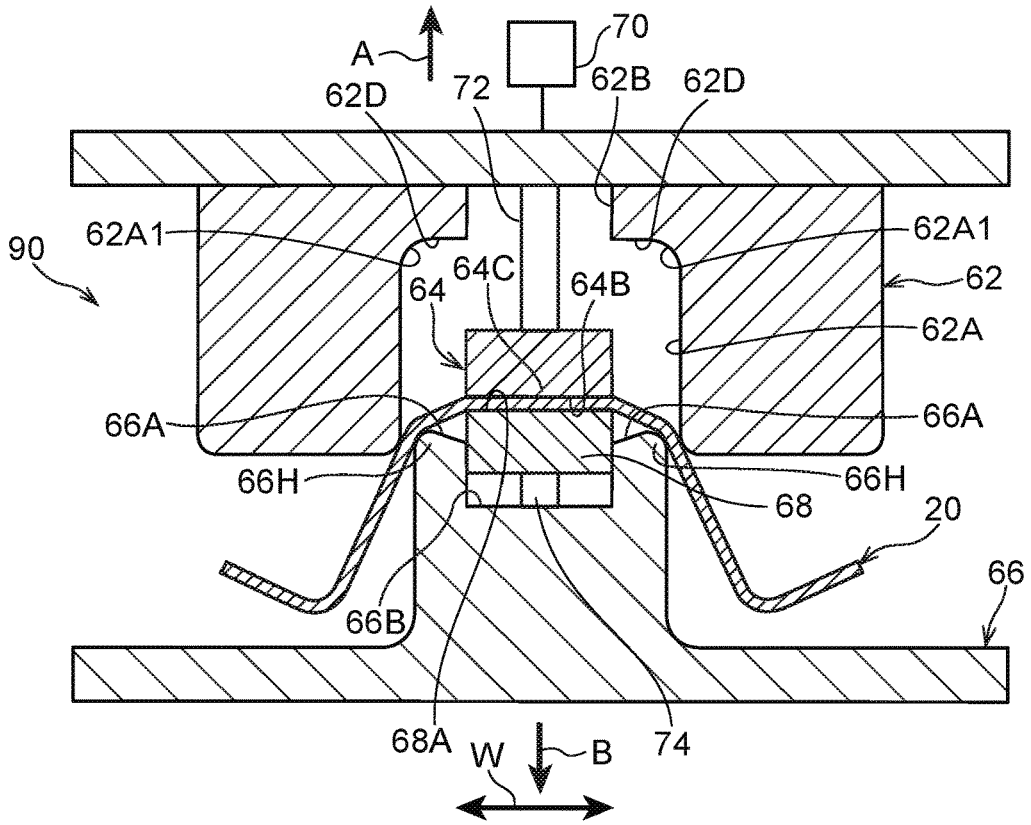
FIG. 20A is a cross-section corresponding to FIG. 17A, illustrating a case in which the first modified example of the press is employed.

A first modified example of the press 90 is similar to the third exemplary embodiment, with the exception of the following points. Namely, as illustrated in FIG. 19 to FIG. 21, in the first modified example, the steps 62C are omitted from the die 62. Moreover, opposing faces of the die 62 opposing the inclined faces 66A of the punch 66 (locations between the ridge line-forming faces 62A1 of the recess 62A and the pad housing portion 62B of the die 62) are escape faces 62D (elements that may be broadly understood as an "escape portion") configuring an example of a die-side recess. The escape faces 62D extend from width direction central side end portions at the ridge line-forming faces 62A1 of the die 62 toward the apparatus width direction central side. More specifically, the escape faces 62D are disposed in a plane orthogonal to the pressing direction, and a width direction outside end portion of each escape face 62D is connected so as to be tangential to the ridge line-forming face 62A1. Accordingly, in the first modified example, an opening plane of the pad housing portion 62B of the die 62 is further toward the apparatus lower side than in the third exemplary embodiment. Moreover, the escape faces 62D correspond to a "location of the die opposing the punch apex face" of the present application, and are further toward the apparatus upper side (die 62 side) than the first imaginary plane S1 (see the enlarged portion in FIG. 19). Namely, the escape faces 62D are set back in the pressing direction from the inclined faces 66A of the punch 66.

Figure 20B:
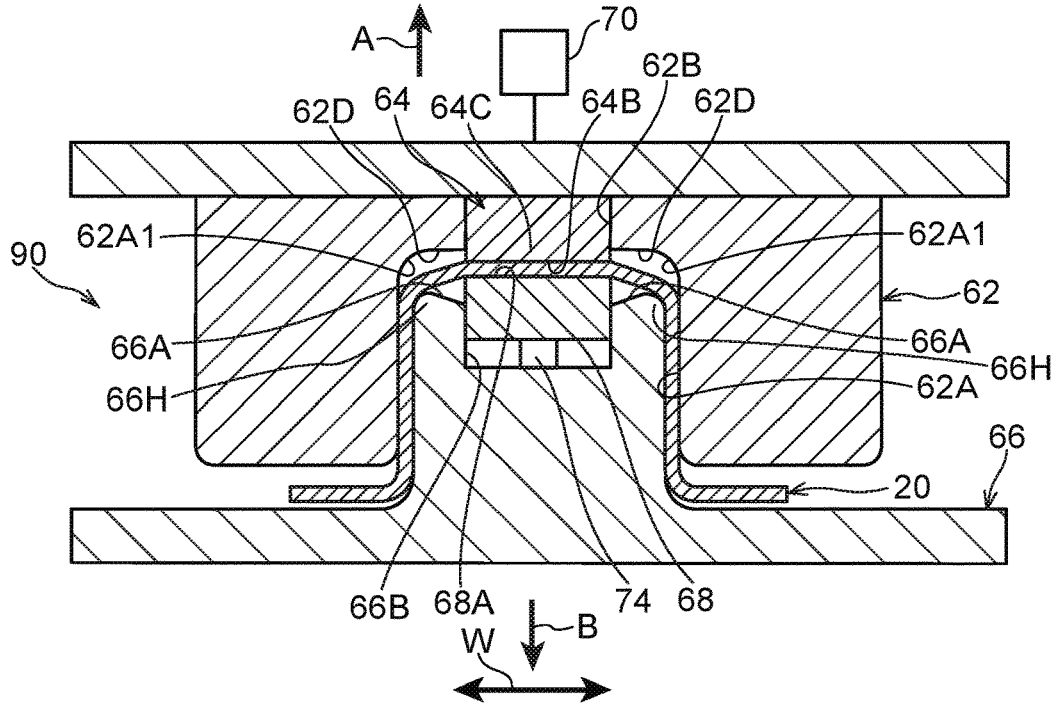
FIG. 20B is a cross-section corresponding to FIG. 17B, illustrating a case in which the first modified example of the press is employed.
Figure 21A:
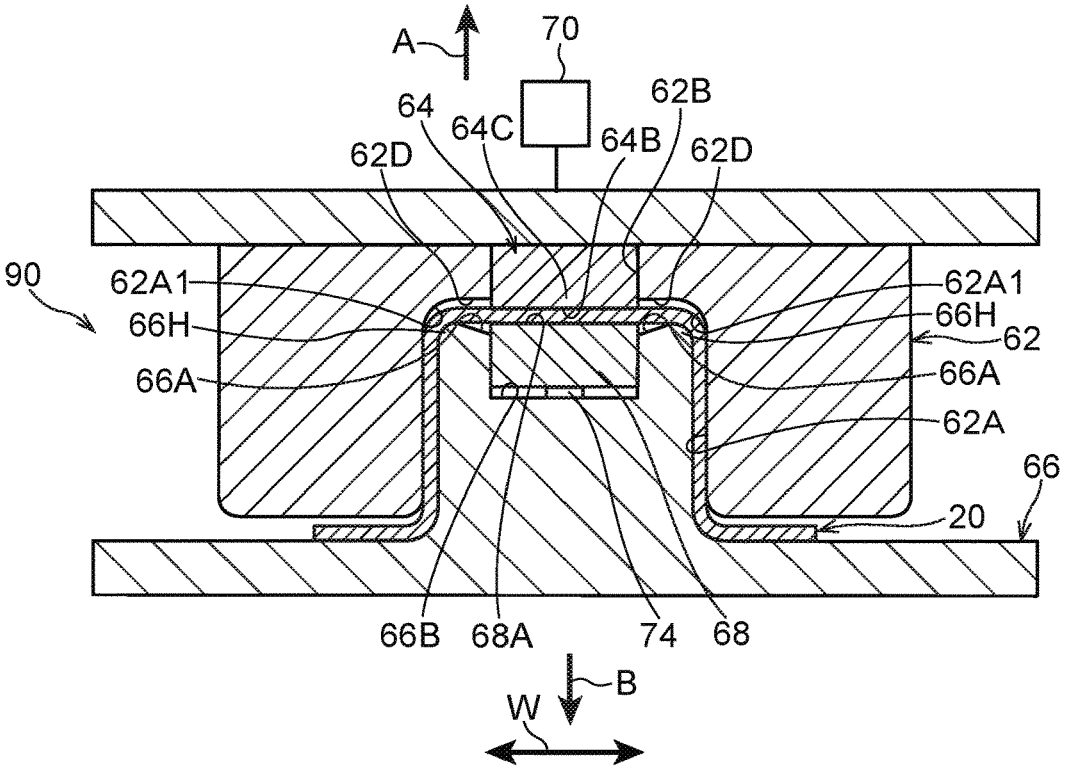
FIG. 21A is a cross-section corresponding to FIG. 18A, illustrating a case in which the first modified example of the press is employed.
Figure 21B:
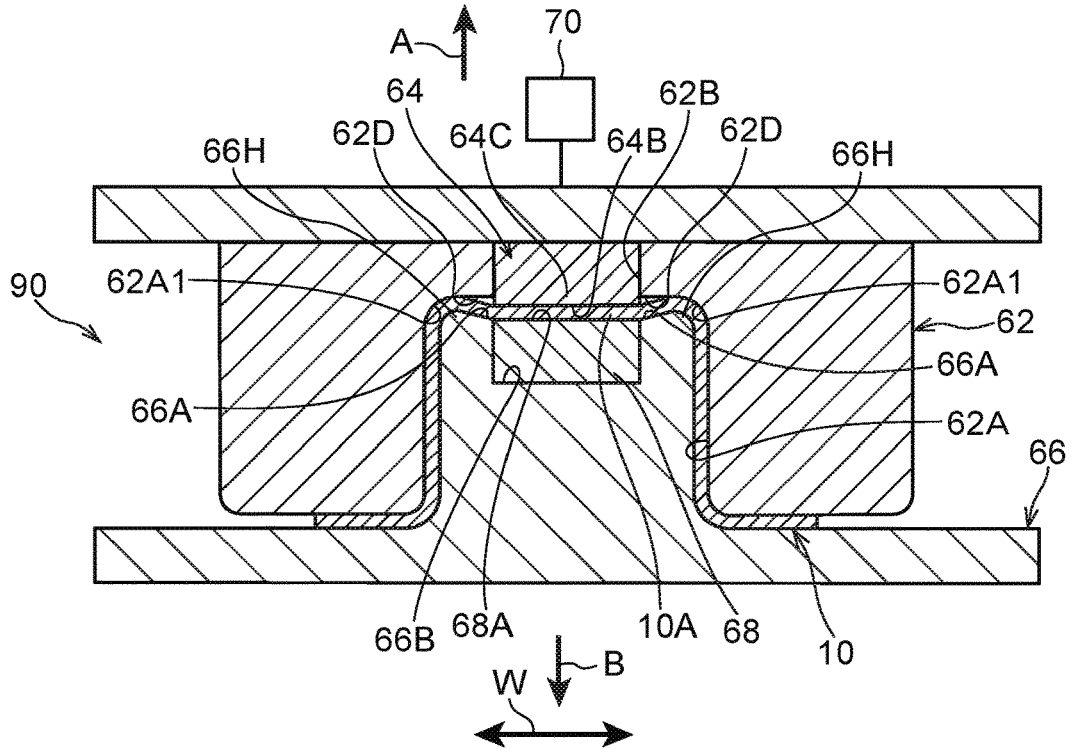
FIG. 21B is a cross-section corresponding to FIG. 18B, illustrating a case in which the first modified example of the press is employed.

Moreover, as illustrated in FIG. 20B, FIG. 21A, and FIG. 21B, at the initial position of the die pad 64, the lower end portion 64C of the die pad 64 projects to the apparatus lower side from the pad housing portion 62B, and projects to the apparatus lower side of the escape faces 62D of the die 62. Moreover, as described above, the escape face 62D is further toward the apparatus upper side (die 62 side) than the first imaginary plane S1. Accordingly, as illustrated in FIG. 21B, at the end of the third step (at the bottom dead center of the die 62 and the die pad 64), the escape faces 62D are disposed at the apparatus upper side of the top plate 10A of the pressed component 10, and gaps (spaces) are formed between the escape faces 62D and the top plate 10A.

Specifically, although the gaps (spaces) between the escape faces 62D and the top plate 10A are smaller than in the third exemplary embodiment, they become larger on progression toward the apparatus width direction central side. Accordingly, in the first modified example too, at the end of the third step (at the bottom dead center of the die 62 and the die pad 64), an opposing-direction spacing between the escape faces 62D of the die 62 and the inclined faces 66A of the punch 66 is larger than an opposing-direction spacing between the die pad 64 (top plate-gripping face 64B) and the inner pad 68 (top plate-gripping face 68A).

FIG. 19 illustrates a pressed component manufacturing method employing the press 90 of the first modified example. In FIG. 19, similarly to in the third exemplary embodiment, at the first step, the top plate-gripping face 64B of the die pad 64 and the top plate-gripping face 68A of the inner pad 68 grip the top plate 20A of the intermediate formed component 20 in the pressing direction.

At the second step, the mover device 70 moves the die 62 toward the apparatus lower side from the state illustrated in FIG. 19. As a result, the die 62 approaches the die pad 64, the inner pad 68, and the punch 66. The punch 66 is thus pushed into the recess 62A of the die 62, forming the inclined walls 20C of the intermediate formed component 20 (see FIG. 20A). Then, as illustrated in FIG. 20B, at the end of the second step, the die pad 64 is housed in the pad housing portion 62B, and the lower end portion 64C of the die pad 64 adopts a state projecting toward the apparatus lower side with respect to the pad housing portion 62B and the escape face 62D of the die 62. Note that a similar effect may be achieved by attaching a mover device to the punch 66 to move the punch 66 toward the apparatus upper side (die 62 side).

At the third step, the mover device 70 moves the single unit configured by the die 62 and the die pad 64 further toward the apparatus lower side, pressing the die 62 and the die pad 64 toward the punch 66 side. Then, as illustrated in FIG. 21A, during the third step, the inner pad 68 is housed in the pad housing portion 66B, such that the portion of the intermediate formed component 20 corresponding to the top plate 10A of the pressed component 10 becomes flat. Then, as illustrated in FIG. 21B, at the end of the third step, the inner pad 68 is housed inside the pad housing portion 66B of the punch 66, and the pre-bent portions 20F of the intermediate formed component 20 are bent back by the die pad 64 and the inner pad 68. Also at the end of the third step, gaps (spaces) are formed between the escape faces 62D and the top plate 10A of the pressed component 10. Therefore, at the end of the third step in the first modified example too, portions at both width direction end sides of the top plate 10A are not gripped by the inclined faces 66A of the punch 66 and the die 62. The press 90 of the first modified example thus exhibits similar operation and advantageous effects to those of the third exemplary embodiment.

Second Modified Example of the Press 90

Figure 22:
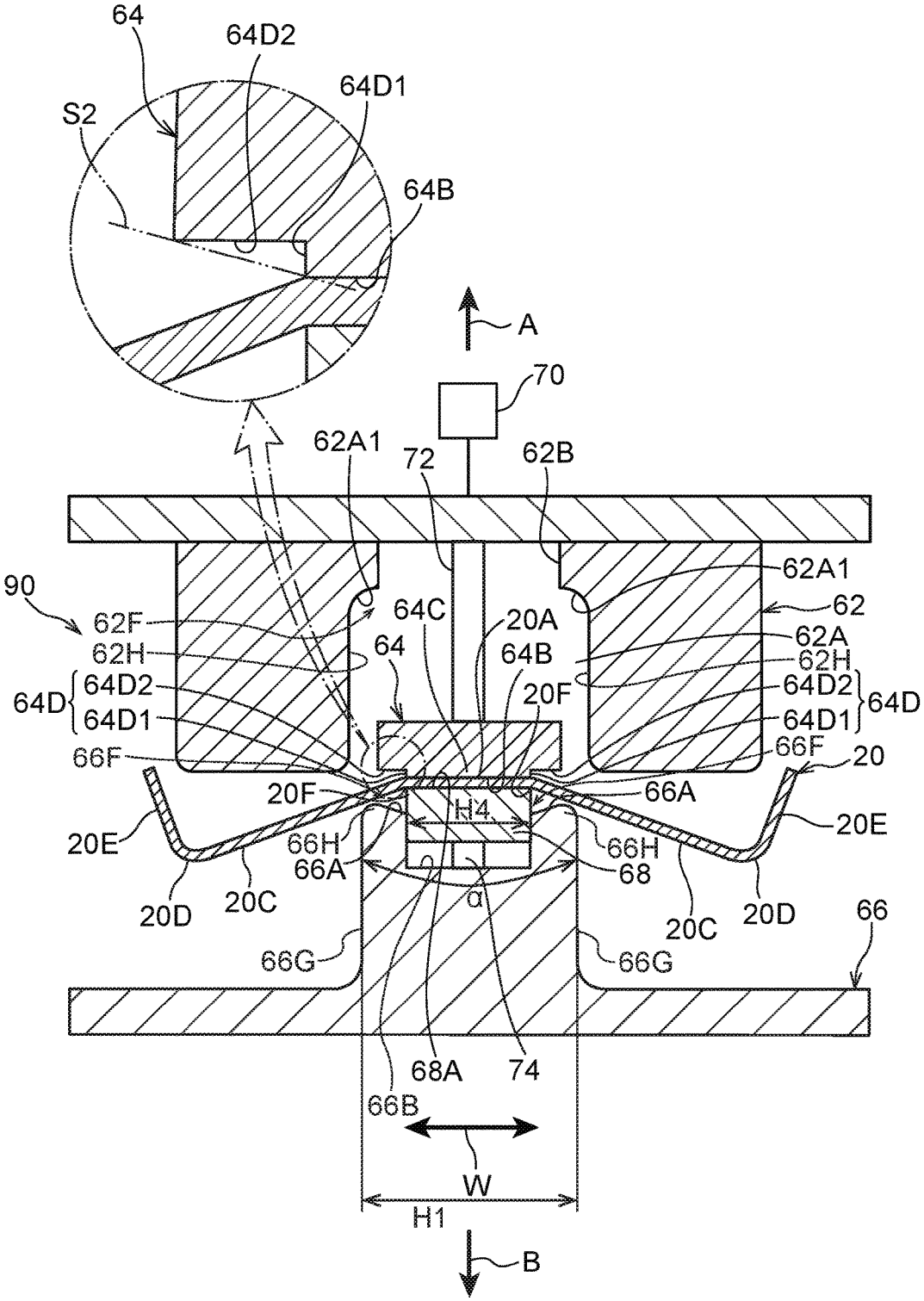
FIG. 22 is a cross-section corresponding to FIG. 16, illustrating a case in which a second modified example of the press illustrated in FIG. 16 is employed.
Figure 23A:
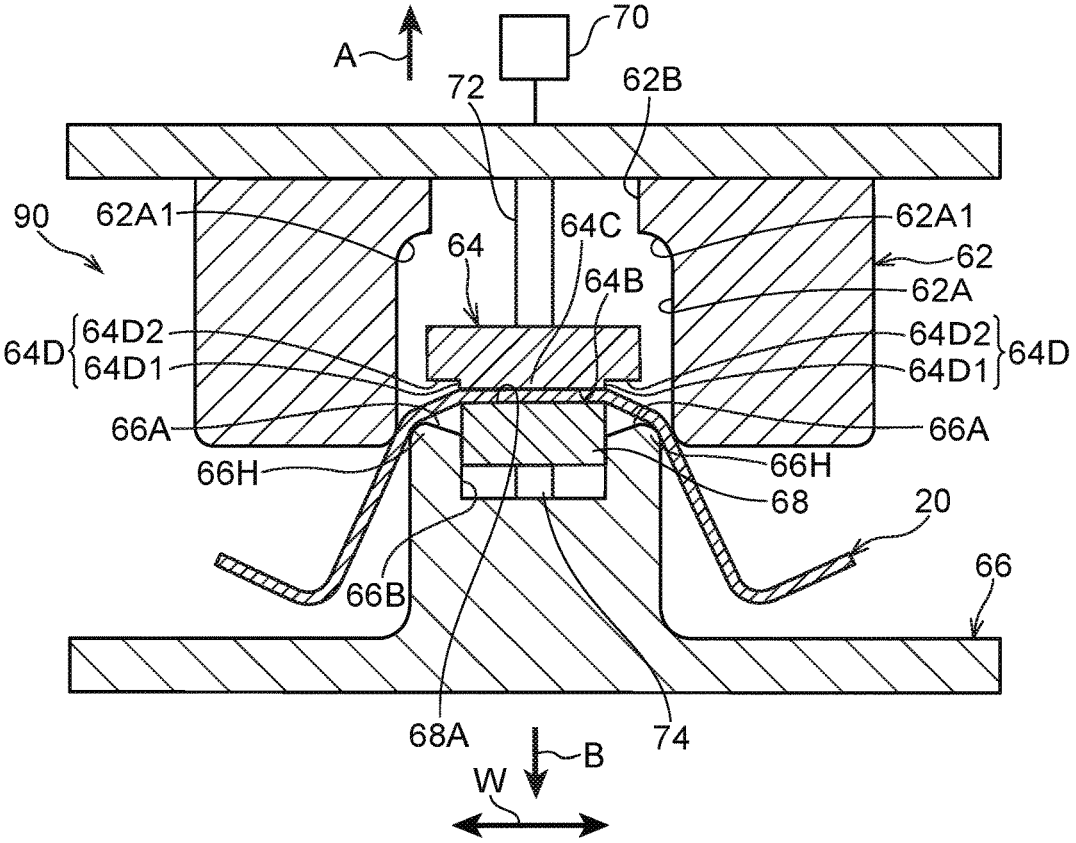
FIG. 23A is a cross-section corresponding to FIG. 17A, illustrating a case in which the second modified example of the press is employed.

A second modified example of the press 90 is similar to the third exemplary embodiment, with the exception of the following points. Namely, as illustrated in FIG. 22 to FIG. 24, in the second modified example, the width of the die pad 64 is the same as in the first exemplary embodiment. Namely, the width of the die pad 64 and the pad housing portion 62B of the die 62 is greater than in the third exemplary embodiment. An opening plane of the pad housing portion 62B of the die 62 is thus at the same pressing direction position as in the first modified example.

Moreover, a pair of steps 64D (elements that may be broadly understood as an escape portion) configuring an example of die-side recesses are formed at portions of the die pad 64 opposing the inclined faces 66A of the punch 66 (in other words, portions disposed on both width direction sides of the lower end portion 64C of the die pad 64). The steps 64D open toward the apparatus lower side and toward the apparatus width direction outsides.

Specifically, in front view cross-section, each step 64D includes a side face 64D1 extending from a width direction outside end portion of the top plate-gripping face 64B of the die pad 64 toward the apparatus upper side, and an escape face 64D2 extending from an upper end portion of the side face 64D1 toward the apparatus width direction outside. The escape faces 64D2 of the steps 64D are opposing faces opposing the inclined faces 66A of the punch 66 (apex face of the punch 66) in the pressing direction, and correspond to a "location of the die pad at an inner pad-opposing face opposing the punch apex face" in the present application.

Note that the top plate-gripping face 64B may be configured with a narrower width than the top plate-gripping face 68A, and the escape faces 64D2 of the steps 64D may be extended as far as locations opposing the top plate-gripping face 68A of the inner pad 68.

Moreover, steps linked to the steps 64D in a state in which the die pad 64 is housed inside the pad housing portion 62B may be formed at a bottom face (apparatus upper-side face) of the die bottom 62F.

The lower end portion 64C of the die pad 64 projects toward the apparatus lower side with respect to the escape faces 64D2 of the steps 64D. Note that if imaginary planes starting at width direction outside end portions of the top plate-gripping face 64B of the die pad 64 and disposed parallel to the inclined faces 66A of the punch 66 configure second imaginary planes S2, (see the enlarged portion in FIG. 22), then the escape faces 64D2 would be further to the apparatus upper side (die 62 side) than the second imaginary planes S2.

Figure 23B:
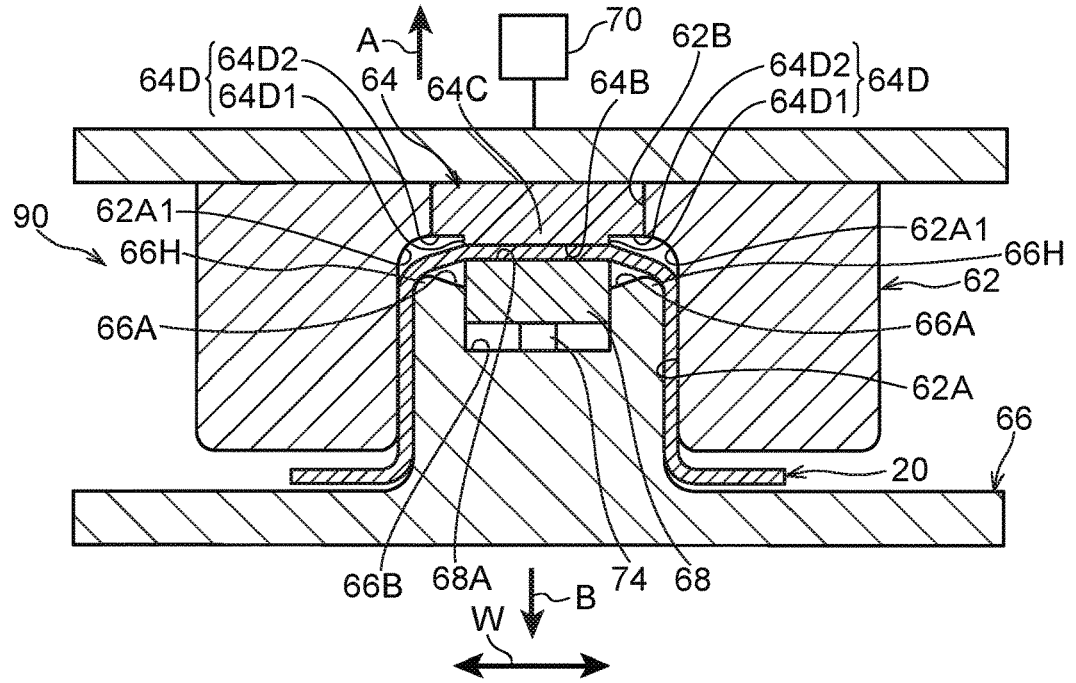
FIG. 23B is a cross-section corresponding to FIG. 17B, illustrating a case in which the second modified example of the press is employed.
Figure 24A:
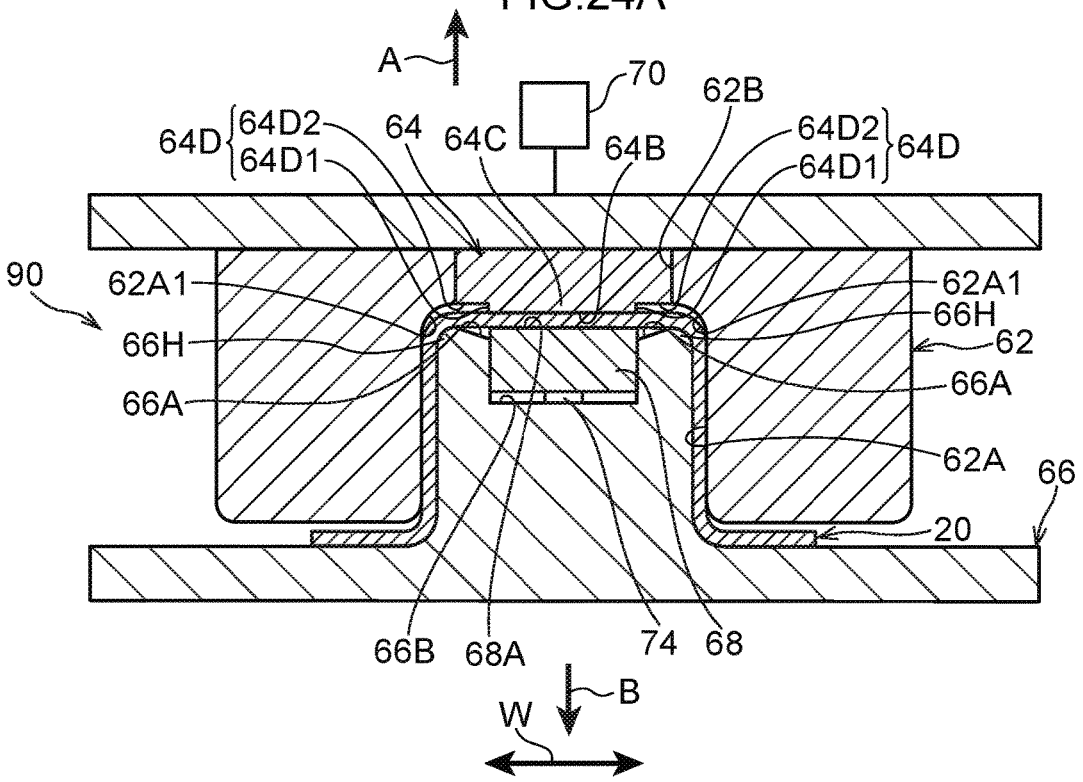
FIG. 24A is a cross-section corresponding to FIG. 18A, illustrating a case in which the second modified example of the press is employed.
Figure 24B:
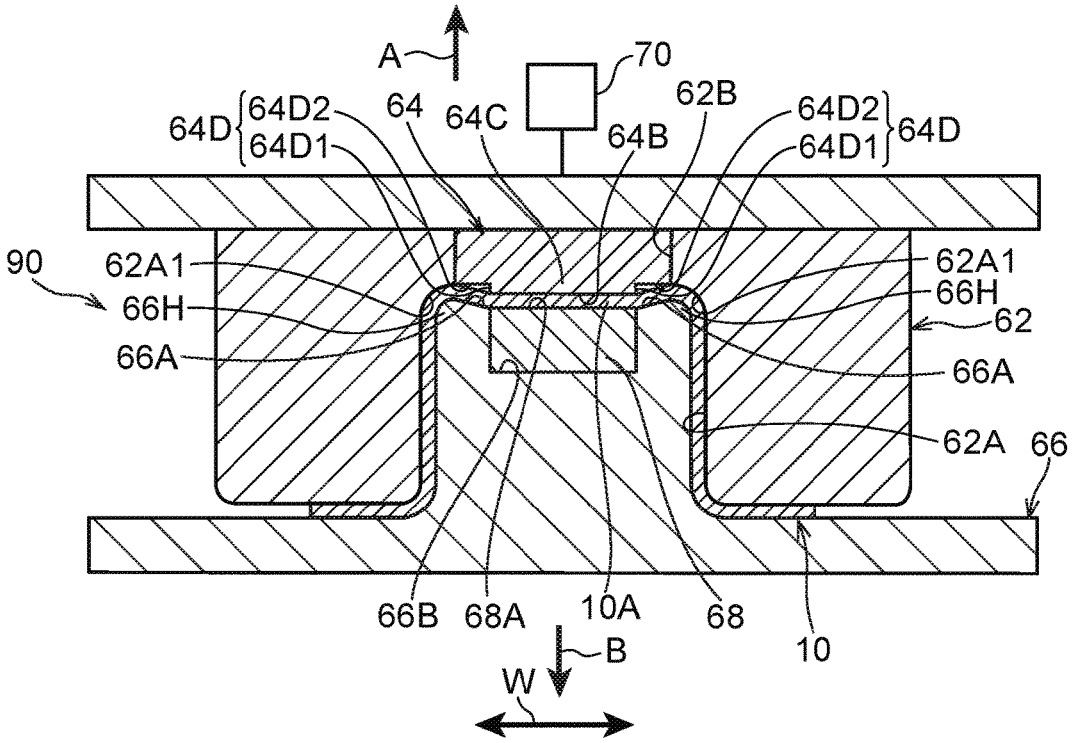
FIG. 24B is a cross-section corresponding to FIG. 18B, illustrating a case in which the second modified example of the press is employed.

Moreover, as illustrated in FIG. 23B, FIG. 24A, and FIG. 24B, at the initial position of the die pad 64, the escape faces 64D2 of the steps 64D lie in the same plane as the opening plane of the pad housing portion 62B of the die 62. Accordingly, the lower end portion 64C of the die pad 64 is disposed at the apparatus lower side of the opening plane of the pad housing portion 62B. Moreover, as described above, the escape faces 64D2 are further to the apparatus upper side (die 62 side) than the second imaginary planes S2. Accordingly, as illustrated in FIG. 24B, at the end of the third step (at the bottom dead center of the die 62 and the die pad 64), the escape face 64D2 is at the apparatus upper side of the top plate 10A of the pressed component 10, and gaps (spaces) are formed between the steps 64D (escape faces 64D2) and the top plate 10A. Specifically, similarly to in the first modified example, the gaps (spaces) between the escape faces 64D2 and the top plate 10A become larger on progression toward the apparatus width direction central side.

Accordingly, in the second modified example, at the end of the third step, the opposing-direction spacing between the escape faces 64D2 of the die pad 64 and the inclined faces 66A of the punch 66 is larger than the opposing-direction spacing between the die pad 64 (top plate-gripping face 64B) and the inner pad 68 (top plate-gripping face 68A).

Moreover, FIG. 22 illustrates a pressed component manufacturing method employing the press 90 of the second modified example. As illustrated in FIG. 22, similarly to in the third exemplary embodiment, at the first step, the top plate 20A of the intermediate formed component 20 is gripped in the pressing direction by the top plate-gripping face 64B of the die pad 64 and the top plate-gripping face 68A of the inner pad 68.

At the second step, the mover device 70 moves the die 62 from the state illustrated in FIG. 22 toward the apparatus lower side with respect to the die pad 64, the inner pad 68, and the punch 66. The die 62 approaches the die pad 64, the inner pad 68, and the punch 66 as a result. The punch 66 is thus pushed into the recess 62A of the die 62, forming the inclined walls 20C of the intermediate formed component 20 (see FIG. 23A). Then, as illustrated in FIG. 23B, at the end of the second step, the die pad 64 is housed in the pad housing portion 62B, and the lower end portion 64C of the die pad 64 projects toward the apparatus lower side with respect to the pad housing portion 62B. Note that a similar effect may be achieved by attaching a mover device to the punch 66 to move the punch 66 toward the apparatus upper side (die 62 side).

At the third step, the mover device 70 moves the single unit configured by the die 62 and the die pad 64 further toward the apparatus lower side, pressing the die 62 and the die pad 64 toward the punch 66 side. Then, as illustrated in FIG. 24A, during the third step, the inner pad 68 is housed in the pad housing portion 66B such that the portion of the intermediate formed component 20 corresponding to the top plate 10A of the pressed component 10 becomes flat. Then, as illustrated in FIG. 24B, at the end of the third step, the inner pad 68 is housed inside the pad housing portion 66B of the punch 66, and the pre-bent portions 20F of the intermediate formed component 20 are bent back by the die pad 64 and the inner pad 68. Also at the end of the third step, gaps (spaces) are formed between the escape faces 64D2 and the top plate 10A of the pressed component 10. Therefore, at the end of the third step in the second modified example too, portions at both width direction ends of the top plate 10A are not gripped by the inclined faces 66A of the punch 66 and the die pad 64. Employing the press 90 of the second modified example thus exhibits similar operation and advantageous effects to those of the third exemplary embodiment.

Third Modified Example of the Press 90

Figure 25:
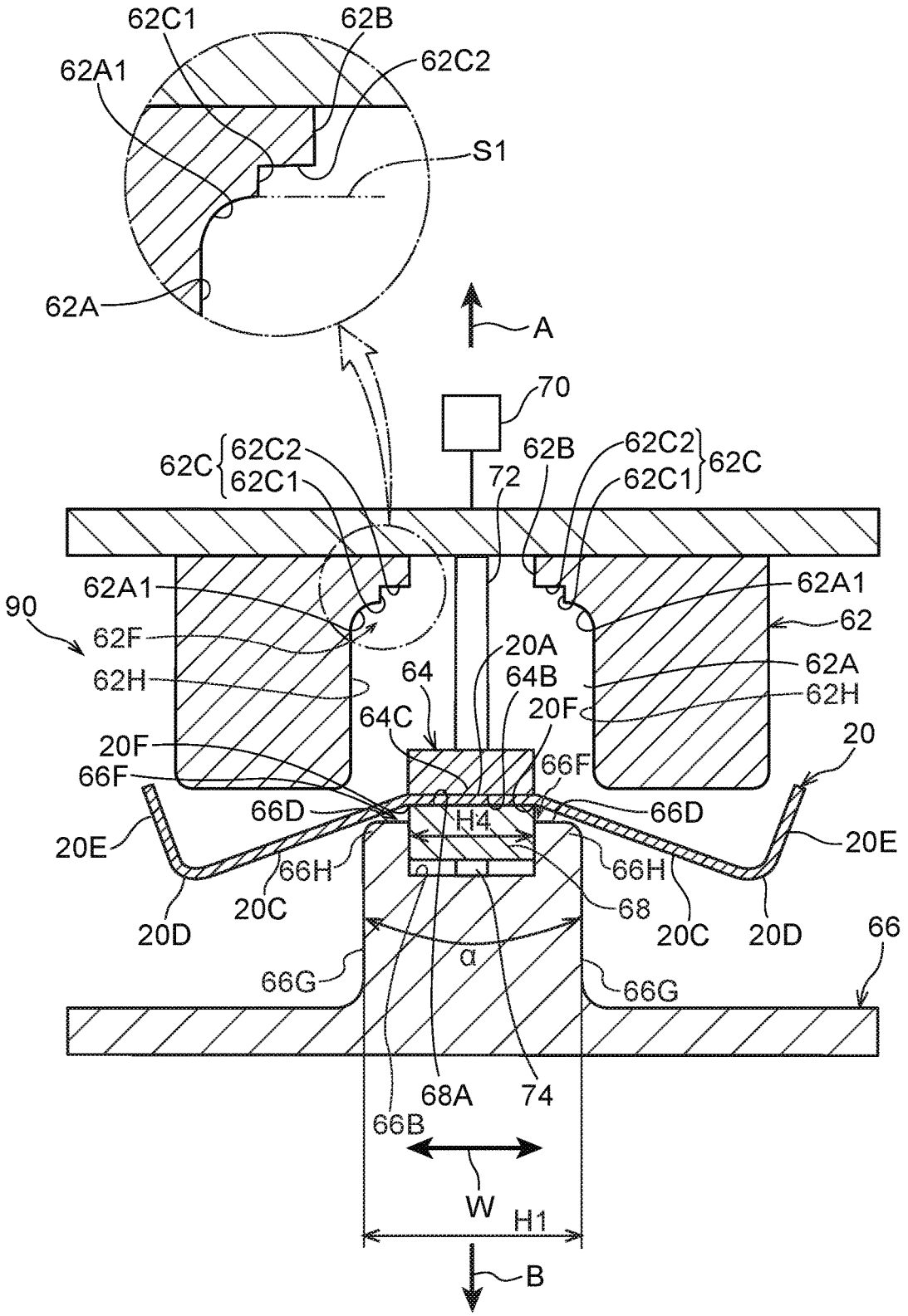
FIG. 25 is a cross-section corresponding to FIG. 16, illustrating a case in which a third modified example of the press illustrated in FIG. 16 is employed.
Figure 26A:
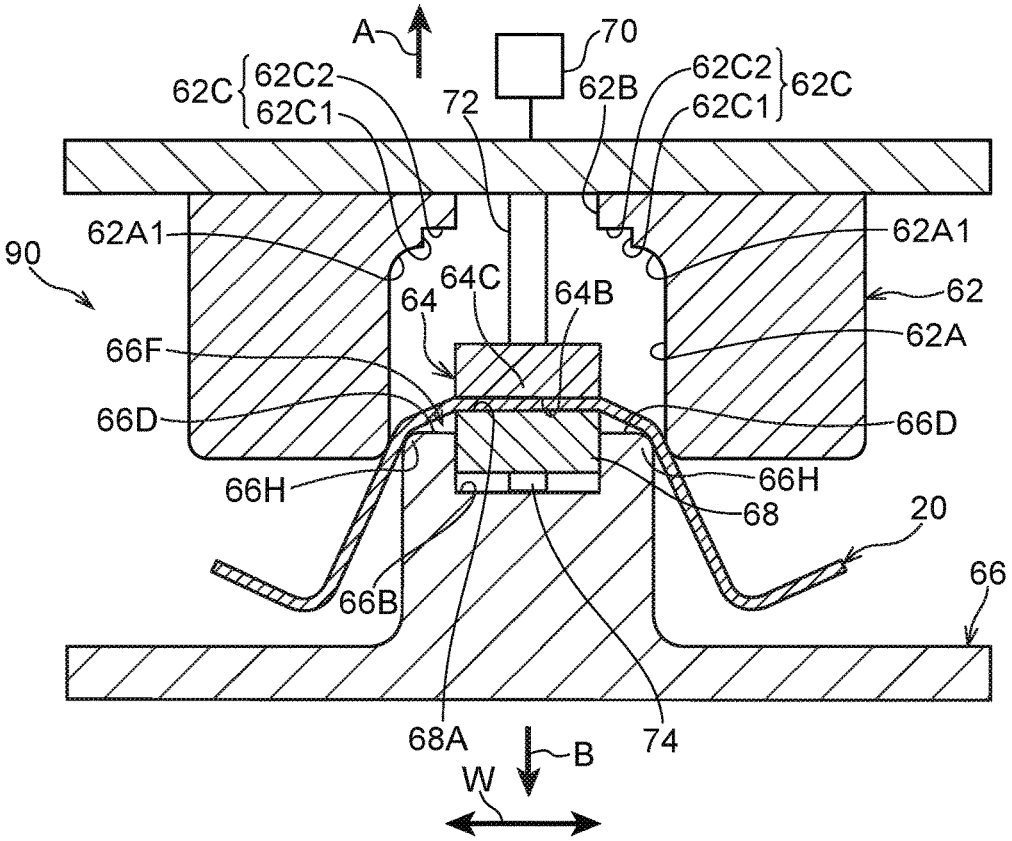
FIG. 26A is a cross-section corresponding to FIG. 17A, illustrating a case in which the third modified example of the press is employed.

A third modified example of the press 90 is similar to the third exemplary embodiment, with the exception of the following points. Namely, as illustrated in FIG. 25 to FIG. 27, in the third modified example, the inclined faces 66A are omitted from the apex portion 66F of the punch 66. In front view cross-section, the apex portion 66F of the punch 66 is formed with top plate-forming faces 66D extending from the punch shoulders 66H toward the apparatus width direction central side.

More specifically, the top plate-forming faces 66D are disposed in a plane orthogonal to the pressing direction, corresponding to the top plate 10A of the pressed component 10 after forming. A width direction outside end portion of each top plate-forming face 66D is connected so as to be tangential to the punch shoulder 66H. Accordingly, in the third modified example, the apex face (punch apex face) of the punch 66 is configured by a pair of the top plate-forming faces 66D. Moreover, the escape faces 62C2 of the steps 62C of the die 62 configure opposing faces opposing the top plate-forming faces 66D in the pressing direction, and are further to the apparatus upper side (die 62 side) than the first imaginary plane S1 (see the enlarged portion in FIG. 25).

Figure 26B:
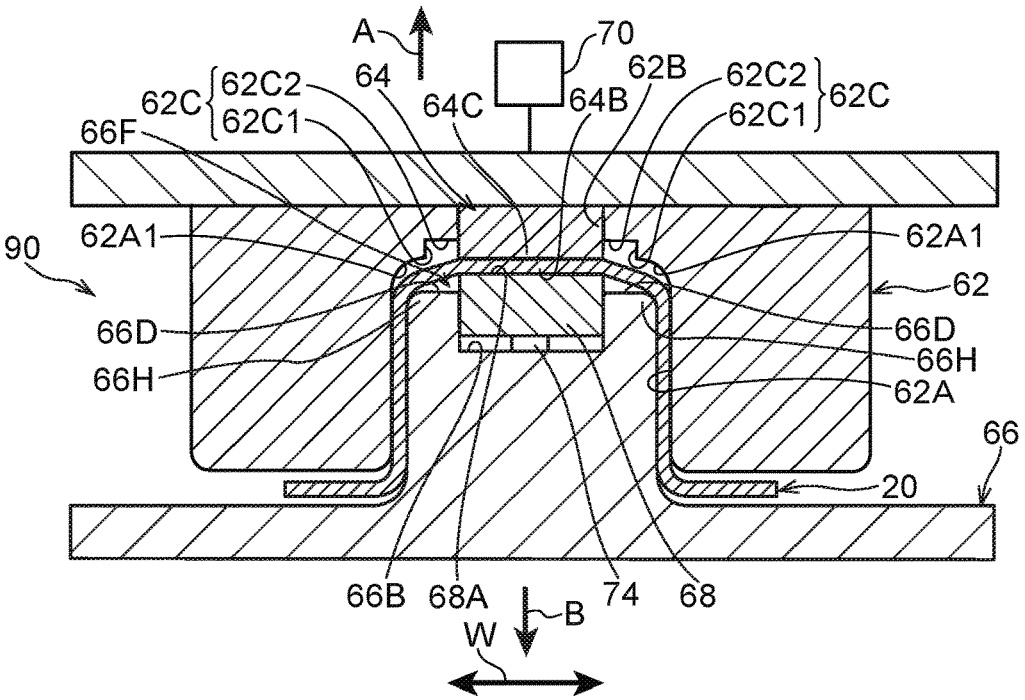
FIG. 26B is a cross-section corresponding to FIG. 17B, illustrating a case in which the third modified example of the press is employed.
Figure 27:
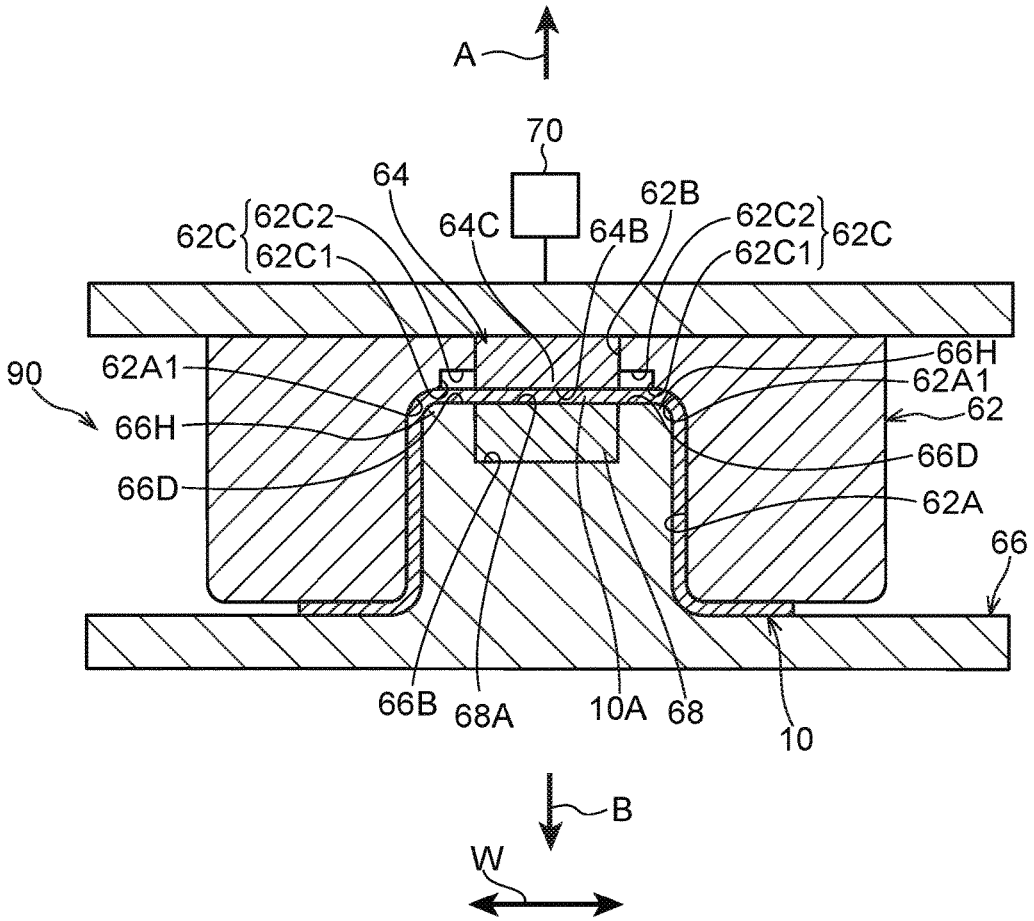
FIG. 27 is a cross-section corresponding to FIG. 18B, illustrating a case in which the third modified example of the press is employed.

Moreover, in the third modified example, as illustrated in FIG. 26B and FIG. 27, when the die pad 64 is at the initial position, the top plate-gripping face 64B of the die pad 64 is in the same plane as the opening plane of the steps 62C. Namely, in the third modified example, the up-down dimension of the die pad 64 is smaller than in the third exemplary embodiment.

Moreover, as described above, since the escape faces 62C2 are further to the apparatus upper side (die 62 side) than the first imaginary plane S1, as illustrated in FIG. 27, at the end of the third step (at the bottom dead center of the die 62 and the die pad 64), the escape faces 62C2 of the steps 62C are at the apparatus upper side of the top plate 10A of the pressed component 10, and gaps (spaces) are formed between the escape faces 62C2 and the top plate 10A. Specifically, the gaps (spaces) between the escape faces 62C2 and the top plate 10A are uniform along the width direction. Accordingly, in the third modified example, at the end of the third step, the opposing-direction spacing between the escape faces 62C2 of the die 62 and the top plate-forming faces 66D of the punch 66 is greater than the opposing-direction spacing between the die pad 64 (top plate-gripping face 64B) and the inner pad 68 (top plate-gripping face 68A).

FIG. 25 illustrates a pressed component manufacturing method employing the press 90 of the third modified example. In FIG. 25, similarly to in the third exemplary embodiment, at the first step, the top plate 20A of the intermediate formed component 20 is gripped in the pressing direction by the top plate-gripping face 64B of the die pad 64 and the top plate-gripping face 68A of the inner pad 68.

At the second step, the mover device 70 moves the die 62 toward the apparatus lower side from the state illustrated in FIG. 25. As a result, the die 62 approaches the die pad 64, the inner pad 68, and the punch 66. The punch 66 is thus pushed into the recess 62A of the die 62, forming the inclined walls 20C of the intermediate formed component 20 (see FIG. 26A). Then, as illustrated in FIG. 26B, at the end of the second step, the die pad 64 is housed in the pad housing portion 62B, and the lower end portion 64C of the die pad 64 projects to the apparatus lower side of the pad housing portion 62B and the escape faces 62C2 of the steps 62C of the die 62. Note that a similar effect may be achieved by attaching a mover device to the punch 66 to move the punch 66 toward the apparatus upper side (die 62 side).

At the third step, the mover device 70 moves the single unit configured by the die 62 and the die pad 64 further toward the apparatus lower side, pressing the die 62 and the die pad 64 toward the punch 66 side. Then, as illustrated in FIG. 27, at the end of the third step, the inner pad 68 is housed in the pad housing portion 66B of the punch 66. The pre-bent portions 20F of the intermediate formed component 20 are then bent back into a flat profile by the die pad 64 and the inner pad 68, thereby forming the top plate 10A of the pressed component 10 with a flat profile. Moreover, at the end of the third step, gaps (spaces) are formed between the escape faces 62C2 and the top plate 10A of the pressed component 10. At the end of the third step in the third modified example too, portions at both width direction ends of the top plate 10A are not gripped by the top plate-forming faces 66D of the punch 66 and the die 62. Employing the press 90 of the third modified example thus exhibits similar operation and advantageous effects to the third exemplary embodiment.

Fourth Modified Example of the Press 90

Figure 28:
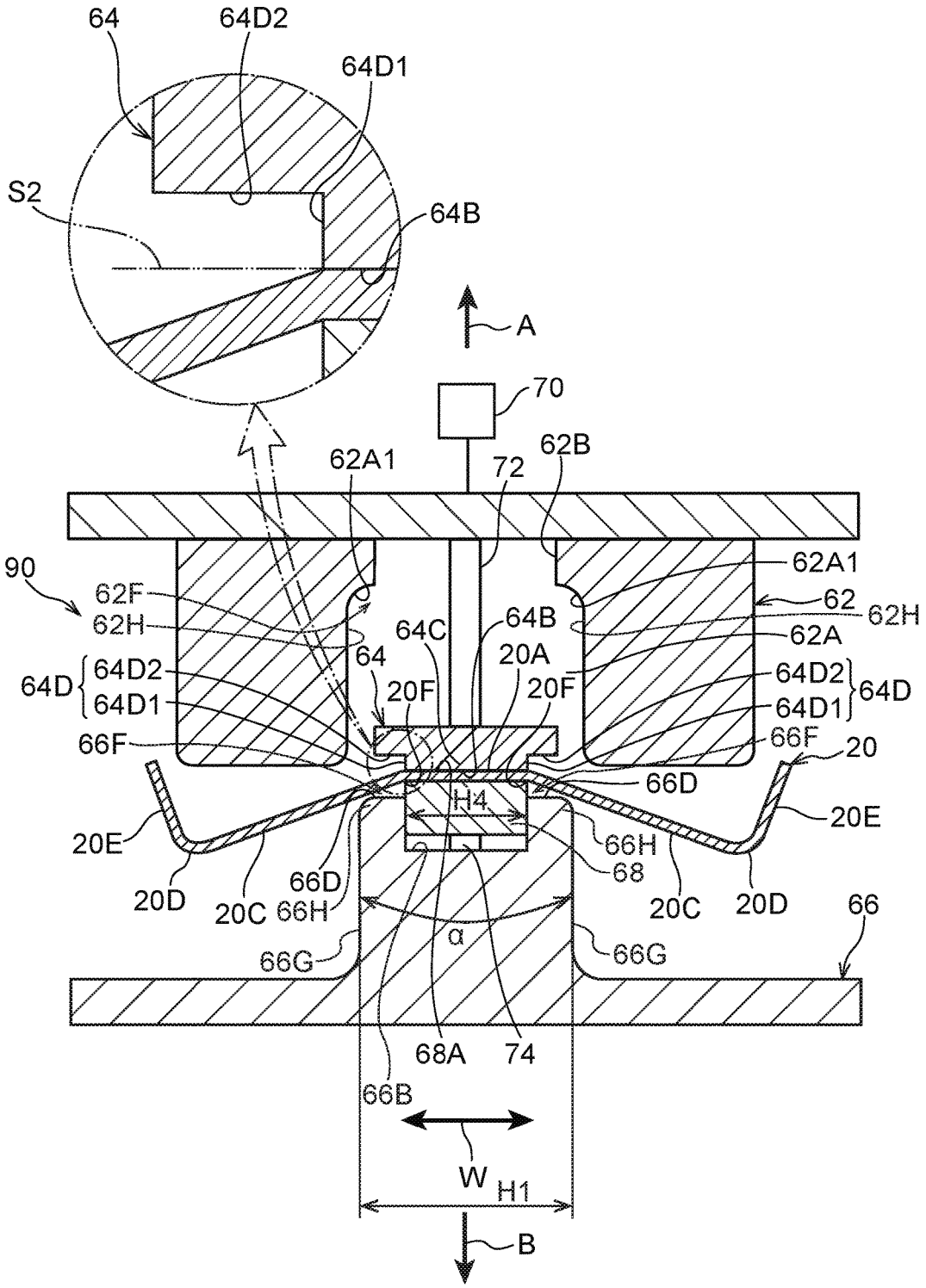
FIG. 28 is a cross-section corresponding to FIG. 16, illustrating a case in which a fourth modified example of the press illustrated in FIG. 16 is employed.
Figure 29A:
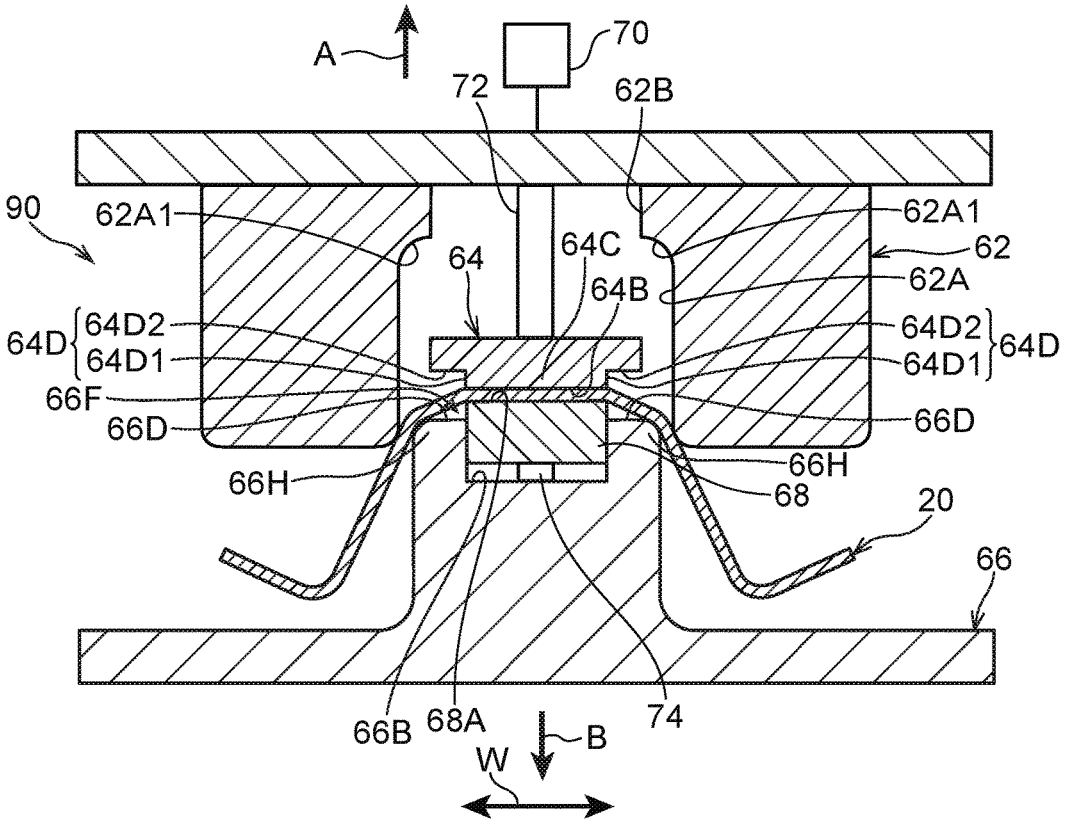
FIG. 29A is a cross-section corresponding to FIG. 17A, illustrating a case in which the fourth modified example of the press is employed.

A fourth modified example of the press 90 is similar to the third exemplary embodiment, with the exception of the following points. Namely, as illustrated in FIG. 28 to FIG. 30, in the fourth modified example, the punch 66 is configured similarly to in the third modified example. Namely, the apex portion 66F of the punch 66 is formed with the top plate-forming faces 66D extending from the punch shoulders 66H toward the apparatus width direction central side, thereby configuring the apex face of the punch 66 with the pair of top plate-forming faces 66D.

Moreover, in the fourth modified example, the die pad 64 and the die 62 are configured similarly to in the second modified example. Namely, a portion of the die pad 64 opposing the top plate-forming faces 66D of the punch 66 is formed with the steps 64D. Accordingly, similarly to in the second modified example, the escape faces 64D2 are further to the apparatus upper side (die 62 side) than the second imaginary planes S2 (see the enlarged portion in FIG. 28). Moreover, in the fourth modified example, when the die pad 64 is at the initial position, the top plate-gripping face 64B of the die pad 64 lies in the same plane as the opening plane of the pad housing portion 62B. Namely, the up-down dimension of the die pad 64 is smaller than in the second modified example.

Figure 29B:
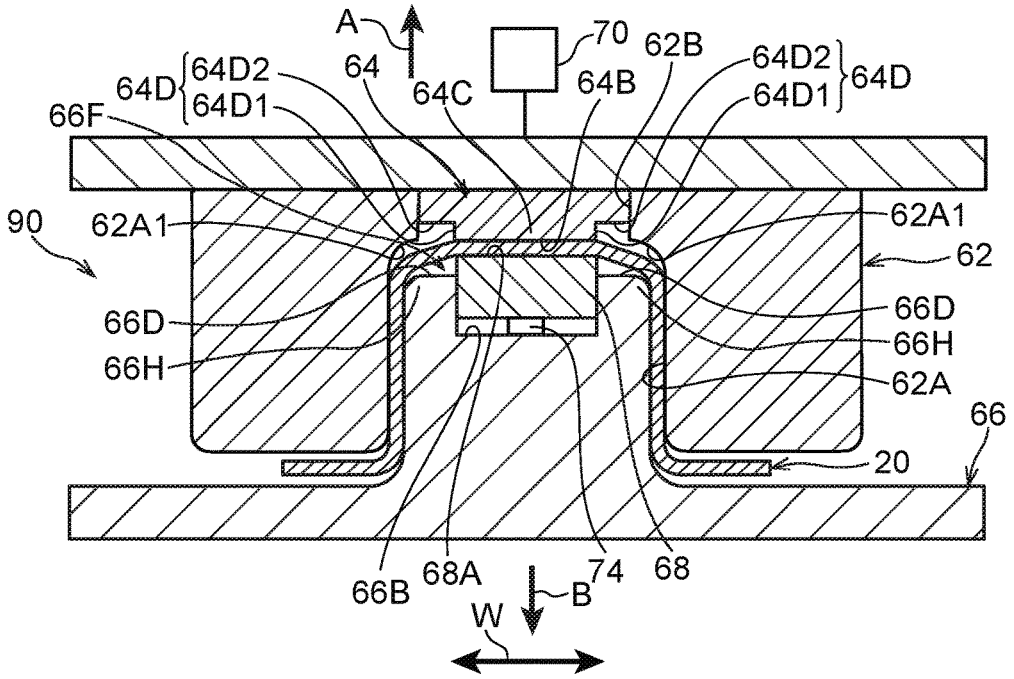
FIG. 29B is a cross-section corresponding to FIG. 17B, illustrating a case in which the fourth modified example of the press is employed.
Figure 30:
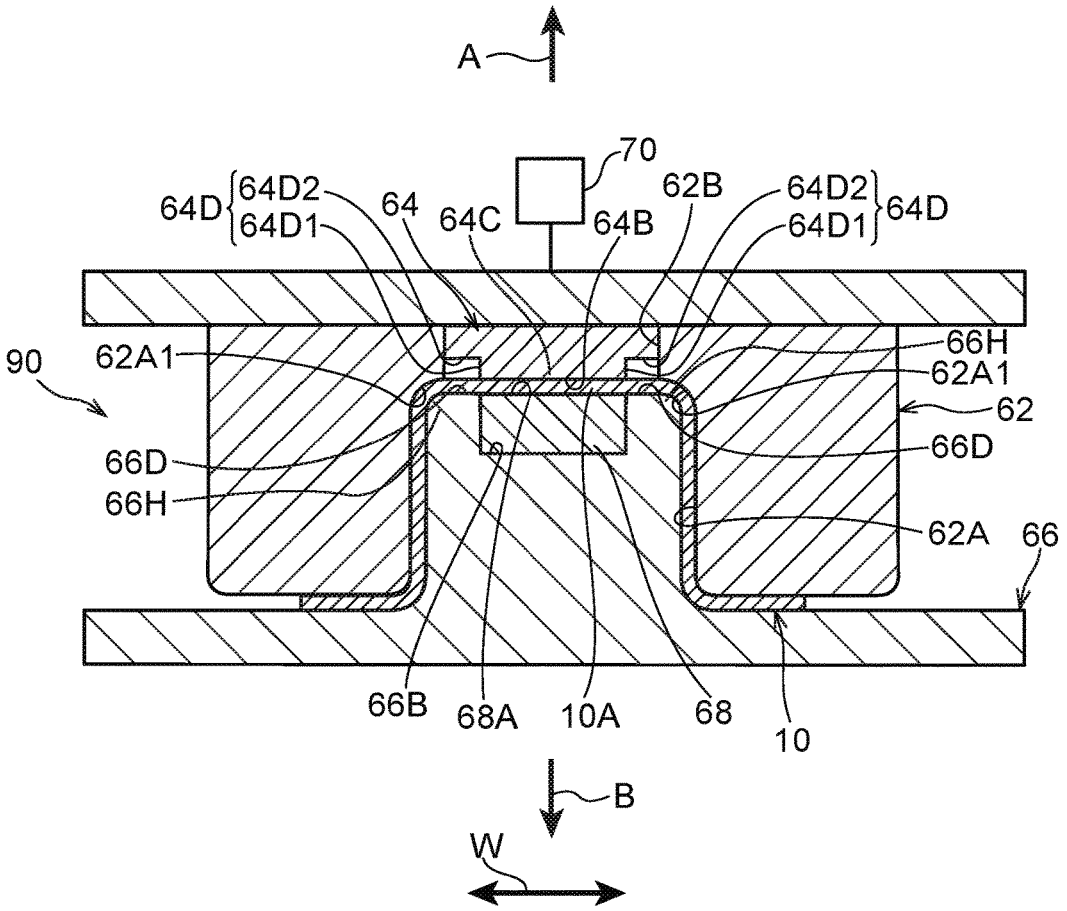
FIG. 30 is a cross-section corresponding to FIG. 18B, illustrating a case in which the fourth modified example of the press is employed.

Accordingly, as illustrated in FIG. 29B and FIG. 30, when the die pad 64 is at the initial position, the escape faces 64D2 of the steps 64D are within the pad housing portion 62B of the die 62. Moreover, as illustrated in FIG. 30, at the end of the third step (at the bottom dead center of the die 62 and the die pad 64), the escape faces 64D2 are disposed at the apparatus upper side of the top plate 10A of the pressed component 10, forming gaps (spaces) between the escape faces 64D2 and the top plate 10A. Specifically, similarly to in the third modified example, the gaps (spaces) between the escape faces 64D2 and the top plate 10A are uniform along the apparatus width direction. Accordingly, in the fourth modified example, at the end of the third step (at the bottom dead center of the die 62 and the die pad 64), the opposing-direction spacing between the escape faces 64D2 of the die pad 64 and the top plate-forming faces 66D of the punch 66 is greater than the opposing-direction spacing between the die pad 64 (top plate-gripping face 64B) and the inner pad 68 (top plate-gripping face 68A).

FIG. 28 illustrates a pressed component manufacturing method employing the press 90 of the fourth modified example. In FIG. 28, similarly to in the third exemplary embodiment, at the first step, the top plate 20A of the intermediate formed component 20 is gripped in the pressing direction by the top plate-gripping face 64B of the die pad 64 and the top plate-gripping face 68A of the inner pad 68.

At the second step, the mover device 70 moves the die 62 toward the apparatus lower side (punch 66 side) from the state illustrated in FIG. 28. As a result, the die 62 approaches the die pad 64, the inner pad 68, and the punch 66. The punch 66 is thus pushed into the recess 62A of the die 62, forming the inclined walls 20C of the intermediate formed component 20 (see FIG. 29A). Then, as illustrated in FIG. 29B, at the end of the second step, the die pad 64 is housed in the pad housing portion 62B, and the top plate-gripping face 64B of the die pad 64 is disposed in the same plane as the opening plane of the pad housing portion 62B. Note that a similar effect may be achieved by attaching a mover device to the punch 66 to move the punch 66 toward the apparatus upper side (die 62 side).

At the third step, the mover device 70 moves the single unit configured by the die 62 and the die pad 64 further toward the apparatus lower side, pressing the die 62 and the die pad 64 toward the punch 66 side. Then, as illustrated in FIG. 30, at the end of the third step, the inner pad 68 is housed in the pad housing portion 66B of the punch 66. The pre-bent portions 20F of the intermediate formed component 20 are then bent back into a flat profile by the die pad 64 and the inner pad 68, thereby forming the top plate 10A of the pressed component 10 with a flat profile. Moreover, at the end of the third step, gaps (spaces) are formed between the escape faces 64D2 and the top plate 10A of the pressed component 10. At the end of the third step in the fourth modified example too, portions at both width direction ends of the top plate 10A are therefore not gripped by the top plate-forming faces 66D of the punch 66 and the die pad 64. The fourth modified example thus exhibits similar operation and advantageous effects to the third exemplary embodiment.

Note that in the first exemplary embodiment to the third exemplary embodiment (including cases in which the press 90 of the first modified example to the fourth modified example is employed), the pressed component 10 is formed with a hat-shaped cross-section profile. However, the pressed component 10 may also be formed with a U-shaped (gutter-shaped) cross-section profile opening toward the lower side. Namely, the pressed component manufacturing method of the first exemplary embodiment to the third exemplary embodiment (including cases in which the press 90 of the first modified example to the fourth modified example is employed) may also be applied in cases in which the pair of ridge line portions 10D and flanges 10E are omitted from the pressed component 10.

Moreover, the pressed component manufacturing methods of the first exemplary embodiment to the third exemplary embodiment (including cases in which the press 90 of the first modified example to the fourth modified example is employed) may also be applied in cases in which one of the ridge line portions 10D and one of the flanges 10E are omitted from the pressed component 10. The pressed component manufacturing method of the first exemplary embodiment to the third exemplary embodiment (including cases in which the press 90 of the first modified example to the fourth modified example is employed) may also be applied in cases in which one ridge line portion 10B, vertical wall 10C, ridge line portion OD, and flange 10E are omitted from the pressed component 10.

Moreover, in the first exemplary embodiment to the third exemplary embodiment (including cases in which the press 90 of the first modified example to the fourth modified example is employed), the top plate 10A and the vertical walls 10C of the pressed component 10 are formed in flat plate shapes. However, the top plate 10A and the vertical walls 10C of the pressed component 10 may be formed with gently curving profiles, stepped profiles, or the like. Moreover, in plan view, the pressed component 10 may be slightly curved such that a length direction intermediate portion of the pressed component 10 is convex toward one width direction side or the other width direction side. Moreover, in side view, the pressed component 10 may be slightly curved such that a length direction intermediate portion of the pressed component 10 is convex toward the upper side or toward the lower side.

Moreover, in the first exemplary embodiment and the second exemplary embodiment, the lower face of the die pad 64 is formed with the pair of inclined faces 64A, and the apex portion 66F of the punch 66 is formed with the pair of inclined faces 66A. However, the inclined faces 64A and the inclined faces 66A may be omitted. Namely, the lower face of the die pad 64 may be configured with a flat profile instead of a convex profile, and the face of the apex portion 66F of the punch 66 may be configured with a flat profile with no recess. In such cases, at the third step of the pressed component manufacturing method, the pre-bent portions 20F are not bent back toward the back face side of the top plate 10A. However, in cases in which high-strength sheet steel having comparatively low tensile strength is employed, creases at the pre-bent portions 20F can be removed by bending back the pre-bent portions 20F into a flat plane profile. This thereby enables the top plate 10A of the pressed component 10 to be configured within the tolerance after demolding.

Moreover, in the third modified example and the fourth modified example of the third exemplary embodiment, the inclined faces 66A are omitted from the apex portion 66F of the punch 66. In such cases, again the pre-bent portions 20F are not bent back toward the back face side of the top plate 10A in the third step of the pressed component manufacturing method. However, in cases in which high-strength sheet steel having comparatively low tensile strength is employed, creases at the pre-bent portions 20F can be removed by bending back the pre-bent portions 20F into a flat plane profile. This thereby enables the top plate 10A of the pressed component 10 to be configured within the tolerance after demolding.

Figure 31:
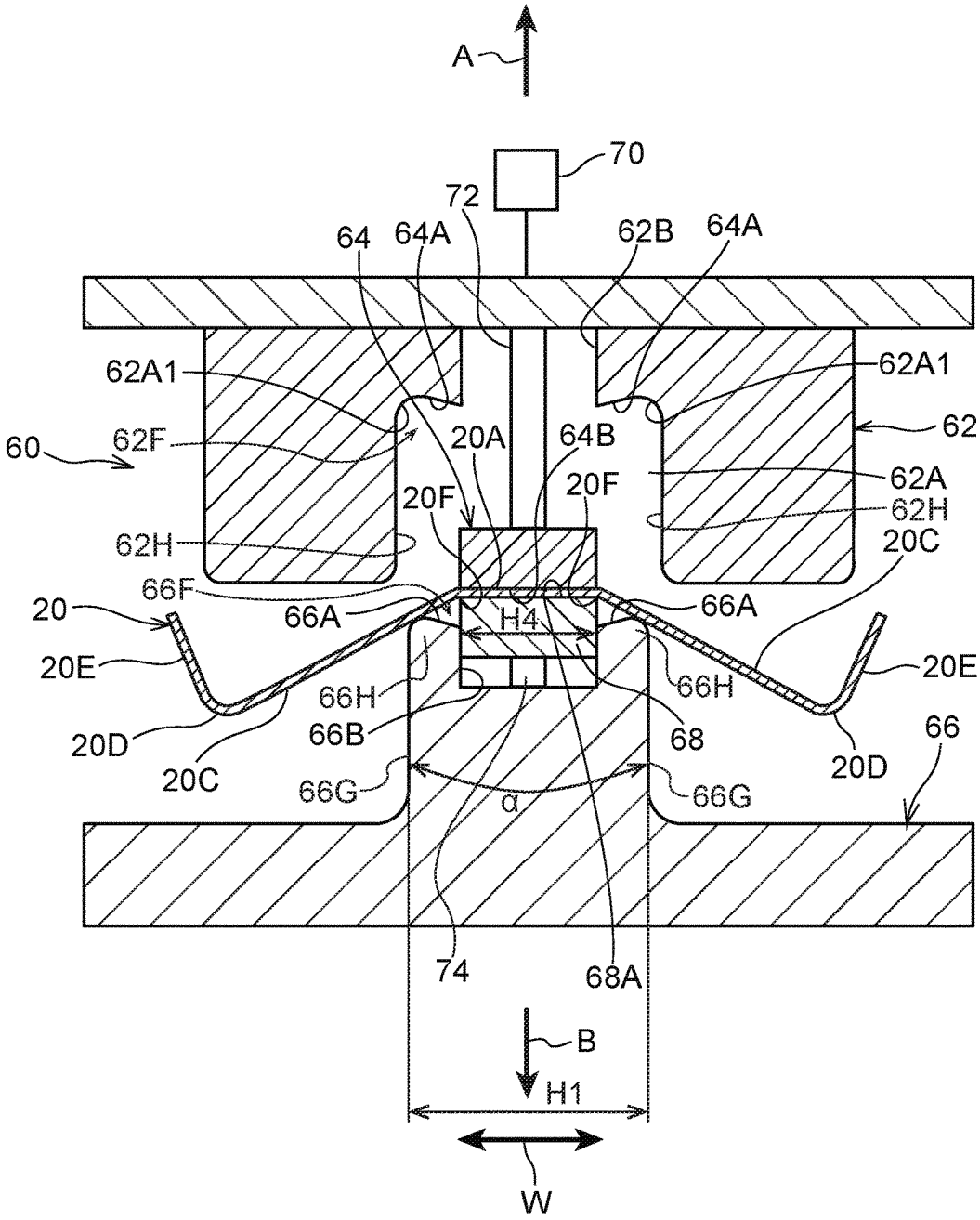
FIG. 31 is a cross-section corresponding to FIG. 1, illustrating a modified example of the press illustrated in FIG. 1.

Moreover, in the first exemplary embodiment and the second exemplary embodiment, the die pad 64 is formed with the inclined faces 64A opposing the inclined faces 66A of the punch 66. However, the inclined faces 64A may be formed to the die 62. For example, as illustrated in FIG. 31, the width of the die pad 64 may be set to the same width as the width of the inner pad 68, and the inclined faces 64A may be formed to the die 62. Moreover, although not illustrated in the drawings, the width of the top plate-gripping face 64B of the die pad 64 may be set slightly smaller than, or slightly larger than, the width W2 of the top plate 20A of the intermediate formed component 20.

In the first exemplary embodiment to the third exemplary embodiment (including cases in which the press 90 of the first modified example or the second modified example is employed), the apex portion 66F of the punch 66 is formed with a profile recessed progressively from the punch shoulders 66H on progression toward the width direction central side of the punch 66. Moreover, the profile of the apex portion 66F of the punch 66 is recessed in relation to the intended shape of the top plate 10A of the pressed component 10. Accordingly, in cases in which the intended shape of the top plate 10A of the pressed component 10 is, for example, a convex profile on progression from the ridge line portions 10B toward the width direction central side of the top plate 10A, the recessed profile of the apex portion 66F of the punch 66 may, in effect, be formed with a flat profile, a convex profile, or the like. Moreover, not only the apex portion 66F of the punch 66, but also the inner pad 68 has a profile corresponding to the intended shape of the top plate 10A.

The pressed component 10 may have an inclined top plate 10A, or the top plate 10A may have localized undulations. Moreover, the vertical walls 10C of the pressed component 10 may also have localized undulations.

Moreover, in the third modified example and the fourth modified example of the third exemplary embodiment, the apex portion 66F of the punch 66 is formed with the top plate-forming faces 66D. Accordingly, at the top plate-forming faces 66D, the apex portion 66F extends from the punch shoulders 66H toward the apparatus width direction central side and lies in a plane orthogonal to the pressing direction. Moreover, the profiles of the top plate-forming faces 66D are relative to the intended shape of the top plate 10A of the pressed component 10. Accordingly, in cases in which the intended shape of the top plate 10A of the pressed component 10 is, for example, a convex profile or a concave profile on progression from the ridge line portions 10B toward the width direction central side of the top plate 10A, the profile of the top plate-forming faces 66D may in effect be formed as a convex profile or a concave profile corresponding to the intended shape of the top plate 10A.

Moreover, in the third exemplary embodiment (including cases in which the press 90 of the first modified example to the fourth modified example is employed), the width of the top plate-gripping face 64B of the die pad 64 and the width of the top plate-gripping face 68A of the inner pad 68 match the width W2 of the top plate 20A of the intermediate formed component 20. Alternatively, similarly to in the second exemplary embodiment, the width of the top plate-gripping face 68A of the inner pad 68 may be set smaller than the width of the top plate 20A of the intermediate formed component 20.

First Modified Example of the Intermediate Forming Press 30

Figure 32A:
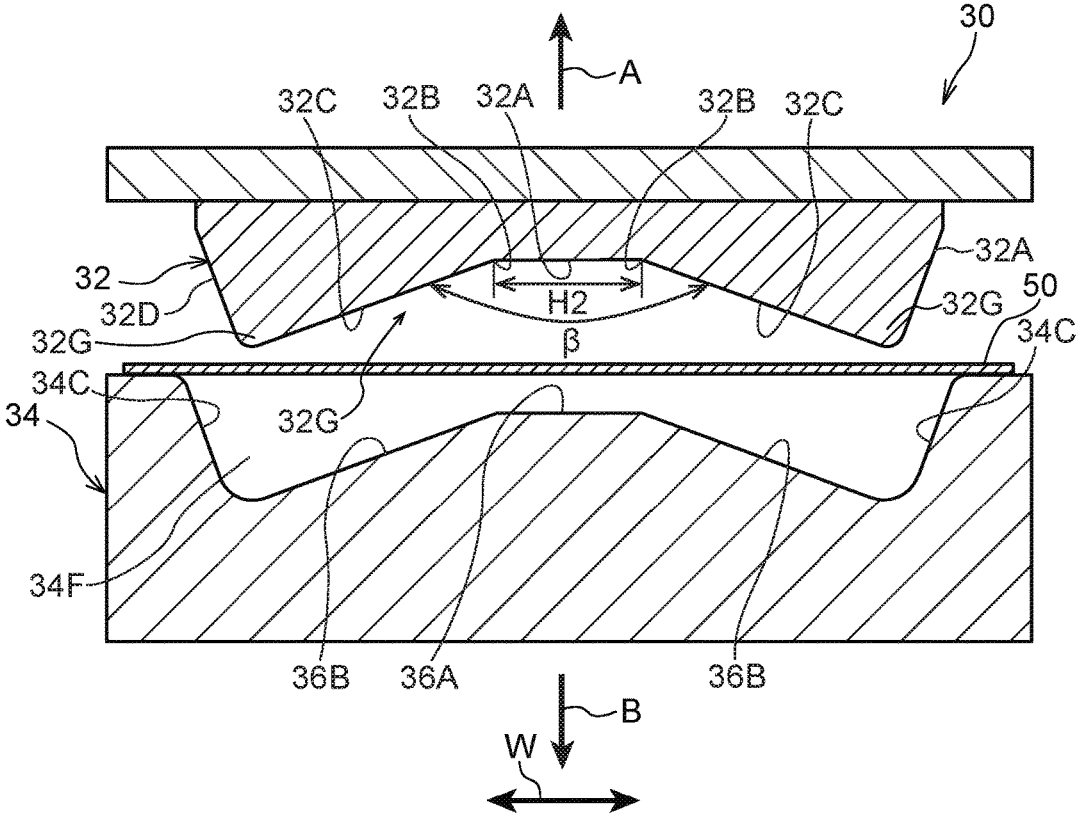
FIG. 32A is a front view cross-section illustrating a first modified example of an intermediate forming press used to manufacture an intermediate formed component by pre-processing a metal stock sheet illustrated in FIG. 6.
Figure 32B:
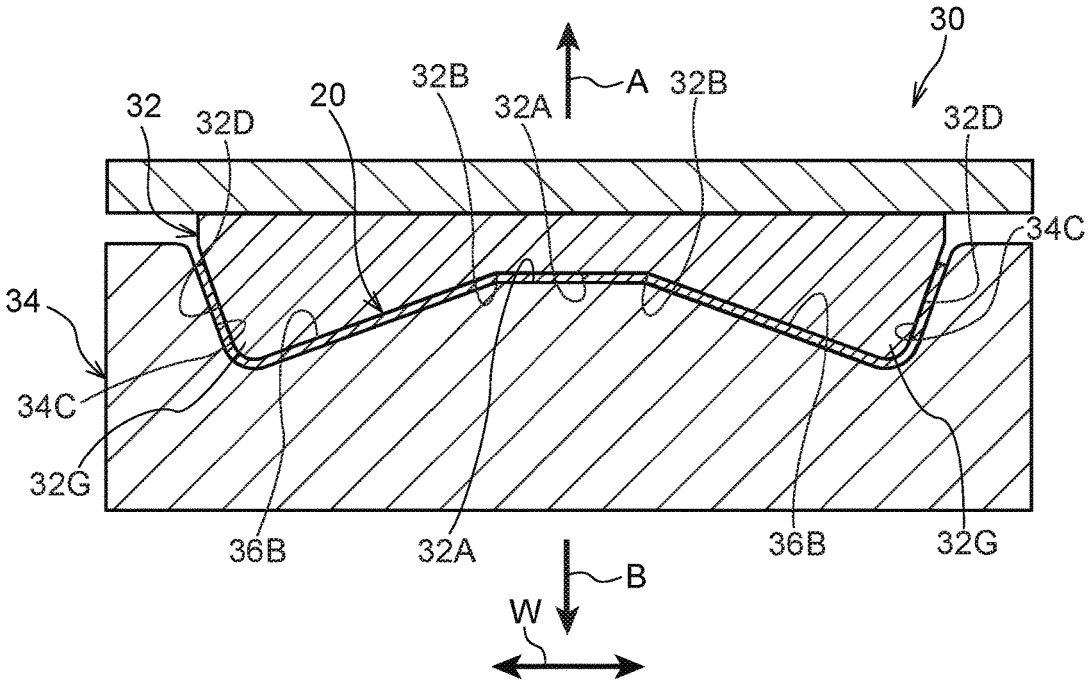
FIG. 32B is a cross-section illustrating a state in which an intermediate formed component has been formed by the press illustrated in FIG. 32A.

Moreover, in the first exemplary embodiment to the third exemplary embodiment (including cases in which the press 90 of the first modified example to the fourth modified example is employed), the pre-forming die 34 and the pad 36 of the intermediate forming press 30 are divided as illustrated in FIG. 6. However, as illustrated in FIG. 32A, the pre-forming die 34 may be configured with the pre-forming die 34 and the pad 36 formed as a single unit. In such cases, as illustrated in FIG. 32A, the blank 50 is placed on both width direction end portions of the pre-forming die 34, and from this state, the pre-forming punch 32 is moved toward the lower side relative to the pre-forming die 34 to form the intermediate formed component 20 (see FIG. 32B).

Second Modified Example of the Intermediate Forming Press 30

Figure 34:
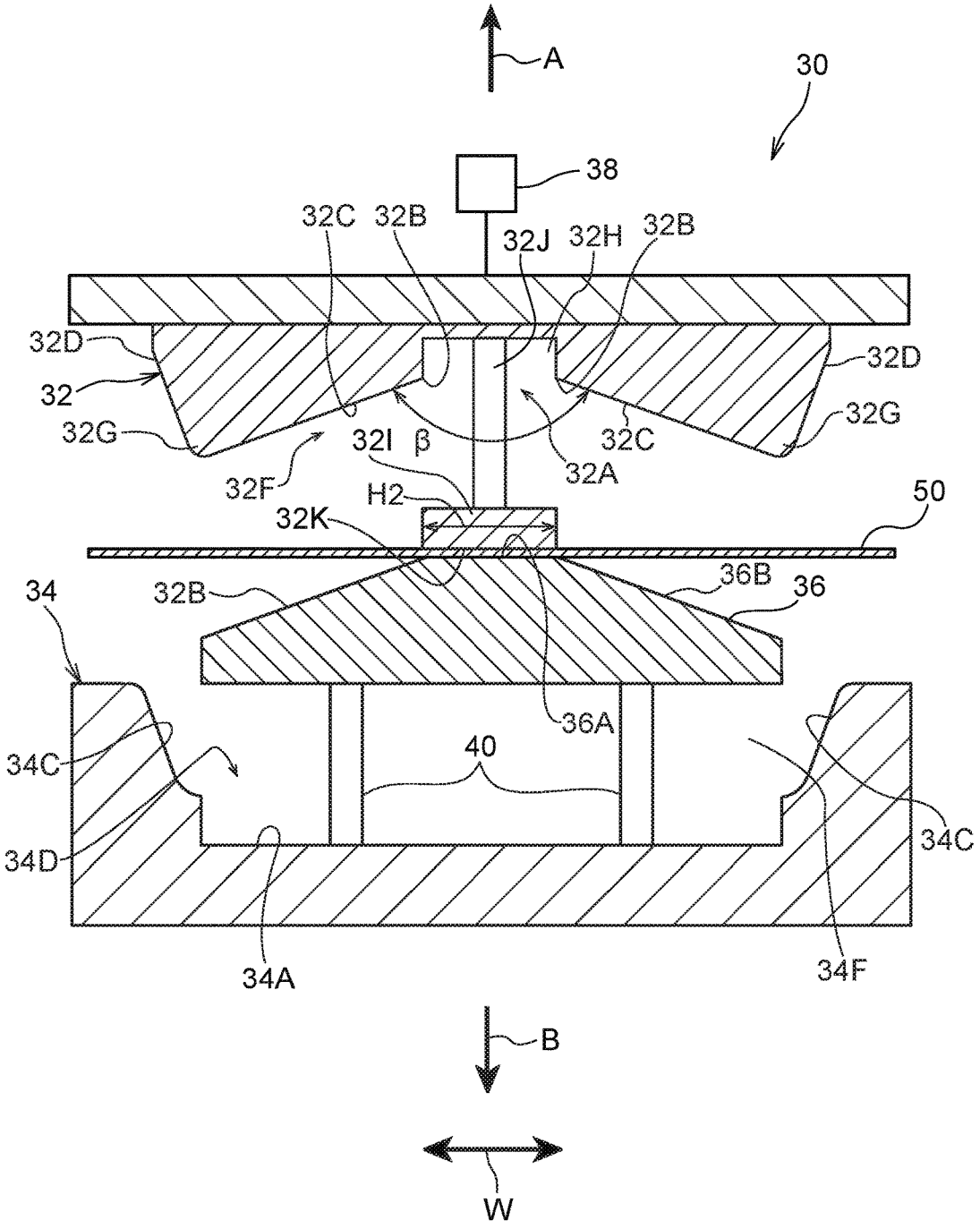
FIG. 34 is a front view cross-section illustrating a second modified example of an intermediate forming press.

Moreover, as illustrated in FIG. 34, the pre-forming punch recess bottom face 32A of the intermediate forming press 30 may be formed with a pre-forming inner pad housing portion 32H (referred to as the recess 32H hereafter), and the recess 32H may be provided capable of housing a pre-forming inner pad 32I. The pre-forming inner pad 32I is moved in the pre-forming pressing direction by a pad pressurizer 32J. The pad pressurizer 32J includes, for example, a gas cushion, a hydraulic device, a spring, or an electrically driven device. The pre-forming inner pad 32I includes a pad apex face 32K that intersects the pre-forming pressing direction.

Moreover, in the first exemplary embodiment to the third exemplary embodiment, and in the first modified example to the fourth modified example of the press 60, 80, 90, the pre-bend angle θ2 is set such that the inclined walls 20C of the intermediate formed component 20 contact the punch shoulders 66H at the first step. However, the pre-bend angle θ2 may be set such that the inclined walls 20C of the intermediate formed component 20 do not contact the punch shoulders 66H.

Supplement

The following aspects are summarized from the present specification.

Namely, a pressed component manufacturing method according to a first aspect is a method to manufacture a pressed component from an intermediate stock by employing a press including a die that is provided with a die pad, and a punch that is disposed opposing the die and that is provided with an inner pad, the pressed component including a top plate, a pair of ridge line portions positioned on both width direction sides of the top plate, and a pair of vertical walls extending from the ridge line portions toward one plate thickness direction side of the top plate, and the intermediate stock including a pair of bent portions inflected toward the one plate thickness direction side, with a spacing between the pair of bent portions set as a narrower spacing than a width of the top plate, the pressed component manufacturing method comprising: a first step of gripping a portion of the intermediate stock between the pair of bent portions with the inner pad and the die pad, with the one plate thickness direction side of the intermediate stock on the side of the inner pad, in a state in which the inner pad projects from the punch toward the die side and the die pad projects from the die toward the punch side; a second step of moving the die toward the punch side relative to the die pad, the inner pad, and the punch, and forming the pair of vertical walls with the die and the punch; and a third step of integrating the die and the die pad into a single unit, and then moving the die and the die pad, and the inner pad, toward the punch side relative to the punch to form the top plate.

A pressed component manufacturing method according to a second aspect is the first aspect, wherein: an apex portion of the punch is formed with a punch-side inclined face set back from the apex portion progressively from a shoulder of the punch toward a width direction central side of the punch; and an opposing face of the die pad that opposes the apex portion of the punch is formed with a die-side inclined face as a counterpart to the punch-side inclined face.

A pressed component manufacturing method according to a third aspect is the first aspect, wherein: an apex portion of the punch is formed with a punch-side inclined face set back from the apex portion progressively from a shoulder of the punch toward a width direction central side of the punch; and an opposing face of the die that opposes the apex portion of the punch is formed with a die-side inclined face as a counterpart to the punch-side inclined face.

A pressed component manufacturing method according to a fourth aspect is the first aspect, wherein: an apex portion of the punch is formed with a punch-side inclined face set back from the apex portion progressively from a shoulder of the punch toward a width direction central side of the punch; and at an end of the third step, a location of the die pad or the die opposing the punch-side inclined face is disposed at a separation from the top plate.

A pressed component manufacturing method according to a fifth aspect is the first aspect, wherein: an apex portion of the punch is formed with a top plate-forming face extending from a shoulder of the punch toward a width direction central side of the punch and corresponding to a profile of the top plate; and at an end of the third step, a location of the die pad or the die opposing the top plate-forming face is disposed at a separation from the top plate.

A pressed component manufacturing method according to a sixth aspect is any one of the second aspect to the fifth aspect, wherein: a width of the inner pad and a spacing between the pair of bent portions of the intermediate stock are the same as each other; and at the first step, the intermediate stock is gripped by the inner pad and the die pad in a state in which a shoulder of the inner pad has been positioned so as to align with the bent portions of the intermediate stock.

A pressed component manufacturing method according to a seventh aspect is any one of the second aspect to the fourth aspect, wherein: a width of the inner pad is set narrower than a spacing between the pair of bent portions of the intermediate stock; an apex portion of the punch is for with a top plate intermediate forming face extending from a width direction inside end of the punch-side inclined face toward the width direction central side of the punch; and at the first step, when the intermediate stock has been gripped by the inner pad and the die pad, the width direction inside end of the punch-side inclined face is disposed opposing the bent portion.

A pressed component manufacturing method according to an eighth aspect is any one of the first aspect to the seventh aspect, wherein at the first step, when the intermediate stock has been gripped by the inner pad and the die pad, the intermediate stock contacts a shoulder of the punch.

A press according to a ninth aspect is a press for manufacturing a pressed component including a top plate, a pair of ridge line portions positioned on both width direction sides of the top plate, and a pair of vertical walls extending from the ridge line portions toward one plate thickness direction side of the top plate, the press comprising: a die that is provided with a die pad; and a punch that is disposed opposing the die and that is provided with an inner pad, an apex portion of the punch having a punch-side inclined face set back from the apex portion progressively from a shoulder of the punch toward a width direction central side of the punch, and an opposing face of the die pad, opposing the apex portion of the punch, having a die-side inclined face as a counterpart to the punch-side inclined face.

A press according to a tenth aspect is a press for manufacturing a pressed component including a top plate, a pair of ridge line portions positioned on both width direction sides of the top plate, and a pair of vertical walls extending from the ridge line portions toward one plate thickness direction side of the top plate, the press comprising: a die that is provided with a die pad; and a punch that is disposed opposing the die and that is provided with an inner pad, an apex portion of the punch having a punch-side inclined face set back from the apex portion progressively from a shoulder of the punch toward a width direction central side of the punch, and an opposing face of the die opposing the apex portion of the punch having a die-side inclined face as a counterpart to the punch-side inclined face.

A press according to an eleventh aspect is a press for manufacturing a pressed component including a top plate, a pair of ridge line portions positioned on both width direction sides of the top plate, and a pair of vertical walls extending from the ridge line portions toward one plate thickness direction side of the top plate, the press comprising: a punch that includes an inner pad, and that includes an apex portion provided with a pad housing portion that houses the inner pad and a punch apex face configuring the apex portion from a shoulder to the pad housing portion; and a die that is disposed opposing the punch, that includes a die pad, and that includes a bottom corner as a counterpart to the shoulder of the punch, wherein, with respect to a first imaginary plane starting from an end portion of the bottom corner on a width direction central side of the die and disposed parallel to the punch apex face, a location of the die opposing the punch apex face is further to a die side than the first imaginary plane.

A press according to a twelfth aspect is a press for manufacturing a pressed component including a top plate, a pair of ridge line portions positioned on both width direction sides of the top plate, and a pair of vertical walls extending from the ridge line portions toward one plate thickness direction side of the top plate, the press comprising: a punch that includes an inner pad, and that includes an apex portion provided with a pad housing portion that houses the inner pad and a punch apex face configuring the apex portion from a shoulder to the pad housing portion; and a die that is disposed opposing the punch and that includes a die pad, wherein an opposing portion of the die pad that opposes the inner pad projects further toward a punch side than a location of the die pad opposing the punch apex face, and wherein, with respect to a second imaginary plane starting from a width direction outside end portion of the opposing portion and disposed parallel to the punch apex face, a location of the die pad opposing the punch apex face is further to a die side than the second imaginary plane.

A press according to a thirteenth aspect is either the eleventh aspect or the twelfth aspect, wherein the punch apex face is further to a punch side than an orthogonal plane tangential to the shoulder of the punch and orthogonal to a direction in which the punch and the die oppose each other.

A press according to a fourteenth aspect is the thirteenth aspect, wherein the punch apex face configures a punch-side inclined face that is set back from the punch apex face progressively from the shoulder of the punch toward a width direction central side of the punch.

A press according to a fifteenth aspect is either the eleventh aspect or the twelfth aspect, wherein the punch apex face lies in an orthogonal plane tangential to the shoulder of the punch and orthogonal to a direction in which the punch and the die oppose each other.

A press according to a sixteenth aspect is a press including a punch that is provided with an apex portion intersecting a pressing direction, an inner pad housing portion formed in the apex portion, punch shoulders disposed at both sides of the apex portion, and punch wall faces extending from the respective punch shoulders; an inner pad that includes an inner pad apex face intersecting the pressing direction, that is housed in the inner pad housing portion, and that moves in the pressing direction; a die that includes a die bottom opposing the apex portion, a die pad housing portion formed in the die bottom, bottom corners disposed at both sides of the die bottom as counterparts to the punch shoulders, die-side recesses between the bottom corners and the die pad housing portion and set back in the pressing direction from the bottom corners, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction.

A press according to a seventeenth aspect is the sixteenth aspect, wherein the bottom corners have a profile inverted in contour from that of the punch shoulders.

A press according to an eighteenth aspect is a press including a punch that is provided with an apex portion intersecting a pressing direction, an inner pad housing portion formed in the apex portion, punch shoulders disposed at both sides of the apex portion, punch-side inclined faces disposed at the apex portion between the punch shoulders and the inner pad housing portion and set back from the apex portion progressively from the punch shoulders toward the inner pad housing portion, and punch wall faces extending from the respective punch shoulders; an inner pad that includes an inner pad apex face intersecting the pressing direction, that is housed in the inner pad housing portion, and that moves in the pressing direction; a die that includes a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction.

A press according to a nineteenth aspect is the eighteenth aspect, wherein the bottom corners have a profile inverted in contour from that of the punch shoulders.

A press according to a twentieth aspect is either the eighteenth aspect or the nineteenth aspect, wherein die-side inclined faces have a profile inverted in contour from that of the punch-side inclined faces and are disposed at locations opposing the punch-side inclined faces.

A press according to a twenty-first aspect is the twentieth aspect, wherein: the punch-side inclined faces and other faces having a gentler incline than the punch-side inclined faces are provided between the punch shoulders and the inner pad housing portion; and the other faces are provided on an inner pad housing portion side.

A press according to a twenty-second aspect is the twenty-first aspect, wherein the die pad and locations of the die bottom opposing the punch-side inclined faces and the other faces have a profile inverted in contour from that of the punch-side inclined faces and the other faces.

A press according to a twenty-third aspect includes: a punch that includes an apex portion intersecting a pressing direction, an inner pad housing portion formed in the apex portion, punch shoulders disposed at both sides of the apex portion, and punch wall faces extending from the respective punch shoulders; an inner pad that includes an inner pad apex face intersecting the pressing direction, that is housed in the inner pad housing portion, and that moves in the pressing direction; a die that includes a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face and an escape portion adjacent to the inner pad-opposing face and at a greater separation than the inner pad-opposing face from the inner pad apex face in the pressing direction, that is housed in the die pad housing portion, and that moves in the pressing direction.

A press according to a twenty-fourth aspect is the twenty-third aspect, further comprising a punch-side inclined face that is provided at an apex portion between the punch shoulder and the inner pad housing portion and that is set back from the apex portion progressively from the punch shoulder toward the inner pad housing portion.

A press according to a twenty-fifth aspect is either the twenty-third or the twenty-fourth aspect, wherein the die pad housing portion is adjacent to the bottom corners.

A press according to a twenty-sixth aspect is any one of the twenty-third aspect to the twenty-fifth aspect, wherein the escape portion is configured by a step.

A press according to a twenty-seventh aspect is any one of the twenty-third aspect to the twenty-fifth aspect, wherein the escape portion is configured by an inclined face.

A press according to a twenty-eighth aspect is any one of the sixteenth aspect to the twenty-seventh aspect, wherein an end portion of the inner pad-opposing face and an end portion of the inner pad apex face are superimposed in the pressing direction.

A press line according to a twenty-ninth aspect includes a press and a pre-forming apparatus. A press line comprising: a press including: a punch that includes: an apex portion intersecting a pressing direction, an inner pad housing portion formed in the apex portion, punch shoulders disposed at both sides of the apex portion, and punch wall faces extending from the respective punch shoulders; an inner pad that includes an inner pad apex face intersecting the pressing direction, that is housed in the inner pad housing portion, and that moves in the pressing direction; a die that includes a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction; and a pre-forming apparatus including: a pre-forming punch that includes: a pre-forming punch recess including: a pre-forming punch recess bottom face intersecting a pre-forming pressing direction and having a narrower width than the apex portion of the punch and a width of no less than a width of the inner pad apex face, pre-forming punch recess corners disposed at both sides of the pre-forming punch recess bottom face, and two pre-forming punch recess inclined faces adjacent to the pre-forming punch recess corners and forming a larger angle with respect to each other than an angle formed between the two punch wall faces; pre-forming punch shoulders disposed at both sides of the pre-forming punch recess; and pre-forming punch side-wall faces adjacent to the pre-forming punch shoulders; and a pre-forming die that is disposed opposing the pre-forming punch, and that includes a pre-faulting die cavity having a profile inverted in contour from that of the pre-forming punch.

A press line according to a thirtieth aspect includes a press and a pre-forming apparatus. A press line comprising: a press including: a punch that includes: an apex portion intersecting a pressing direction, an inner pad housing portion formed in the apex portion, punch shoulders disposed at both sides of the apex portion, and punch wall faces extending from the respective punch shoulders;

an inner pad that includes an inner pad apex face intersecting the pressing direction, that is housed in the inner pad housing portion, and that moves in the pressing direction; a die that includes: a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction; and a pre-forming apparatus including: a pre-forming punch that includes: a pre-forming punch recess including: a pre-forming punch recess bottom face intersecting a pre-forming pressing direction and having a width that is narrower than a width of the apex portion of the punch and is a width of no less than a width of the inner pad apex face, pre-forming punch recess corners disposed at both sides of the pre-forming punch recess bottom face, and two pre-forming punch recess inclined faces adjacent to the pre-forming punch recess corners and forming a larger angle with respect to each other than an angle formed between the two punch wall faces; pre-forming punch shoulders disposed at both sides of the pre-forming punch recess; and pre-forming punch side-wall faces adjacent to the pre-forming punch shoulders; a pre-forming die that is disposed opposing the pre-forming punch, and that has a die cavity including: pre-forming die cavity wall faces as counterparts to the pre-forming punch side-wall faces, a pre-forming die bottom disposed between the pre-forming die cavity wall faces, and a pre-forming die pad housing portion formed in the pre-forming die bottom; and a pre-forming die pad that is housed in the pre-forming die pad housing portion, that moves in the pre-forming pressing direction, and that includes: a punch bottom face counterpart face as a counterpart to the pre-forming punch recess bottom face, and punch inclined face counterpart faces as counterparts to the pre-forming punch recess inclined faces.

A press line according to a thirty-first aspect is either the twenty-ninth aspect or the thirtieth aspect, wherein the press is the press of any one of the sixteenth aspect to the twenty-eighth aspect.

A press line according to a thirty-second aspect includes the press of either the twenty-first aspect or the twenty-second aspect in which the punch-side inclined faces and the other faces are each disposed at both sides of the inner pad housing portion; and a pre-forming apparatus including: a pre-forming punch that includes: a pre-forming punch recess including: a pre-forming punch recess bottom face intersecting a pre-forming pressing direction and having a width that is the same as a width encompassing the other faces of the inner pad housing portion that are on the outside of the inner pad housing portion, pre-forming punch recess corners disposed at both sides of the pre-forming punch recess bottom face, and two pre-forming punch recess inclined faces adjacent to the pre-forming punch recess corners and forming a larger angle than an angle formed by the two punch wall faces with respect to each other; pre-forming punch shoulders disposed at both sides of the pre-forming punch recess; and pre-forming punch side-wall faces adjacent to the pre-forming punch shoulders; and a pre-forming die that is disposed opposing the pre-forming punch, and that includes a pre-forming die cavity having a profile inverted in contour from that of the pre-forming punch.

A press line according to a thirty-third aspect includes the press of either the twenty-first aspect or the twenty-second aspect in which the punch-side inclined faces and the other faces are each disposed at both sides of the inner pad housing portion; and a pre-forming apparatus including: a pre-forming punch that includes: a pre-forming punch recess including: a pre-forming punch recess bottom face intersecting a pre-forming pressing direction and having a width the same as a width encompassing the other faces of the inner pad housing portion that are on the outside of the inner pad housing portion, pre-forming punch recess corners disposed at both sides of the pre-forming punch recess bottom face, and two pre-forming punch recess inclined faces adjacent to the pre-forming punch recess corners and forming a larger angle with respect to each other than an angle formed between the two punch wall faces; pre-forming punch shoulders disposed at both sides of the pre-forming punch recess; and pre-forming punch side-wall faces adjacent to the pre-forming punch shoulders; a pre-forming die that is disposed opposing the pre-forming punch, and that has a die cavity including: pre-forming die cavity wall faces as counterparts to the pre-forming punch side-wall faces, a pre-forming die bottom disposed between the pre-forming die cavity wall faces, and a pre-forming die pad housing portion provided in the pre-forming die bottom; and a pre-forming die pad that is housed in the pre-forming die pad housing portion, that moves in the pre-forming pressing direction, and that includes: a punch bottom face counterpart face as a counterpart to the pre-forming punch recess bottom face, and punch inclined face counterpart faces as counterparts to the pre-forming punch recess inclined faces.

A press line according to a thirty-fourth aspect is any one of the twenty-ninth aspect to the thirty-third aspect, further including a pre-forming inner pad housing portion formed in the pre-forming punch recess bottom face; and a pre-forming inner pad that is housed in the pre-forming inner pad housing portion and that moves in the pre-forming pressing direction.

A press line according to a thirty-fifth aspect is any one of the twenty-ninth aspect to the thirty-fourth aspect, wherein a width of the inner pad apex face is a width that is the same as a width of the pre-forming punch recess bottom face.

The disclosure of Japanese Patent Application No. 2015-239425, filed on Dec. 8, 2015, is incorporated in its entirety by reference herein.

The disclosure of Japanese Patent Application No. 2016-061993, filed on Mar. 25, 2016, is incorporated in its entirety by reference herein.

All cited documents, patent applications, and technical standards mentioned in the present specification are incorporated by reference in the present specification to the same extent as if the individual cited document, patent application, or technical standard was specifically and individually indicated to be incorporated by reference.

The invention claimed is:

1. A method to manufacture a pressed component from an intermediate stock by employing a press including a die that is provided with a die pad that moves in a pressing direction, and a punch that is disposed opposing the die and that is provided with an inner pad that moves in the pressing direction, the pressed component including a top plate having a top surface and a bottom surface, and a thickness in the pressing direction and a width extending along a direction intersecting the pressing direction, a pair of ridge line portions, each of the pair of ridge line portions positioned on a respective end of the top plate in the width direction, and a pair of vertical walls, each of the pair of vertical walls extending from the respective one of the pair of ridge line portions in a direction from the top surface towards the bottom surface of the top plate, and the pressed component manufacturing method comprising:

providing the intermediate stock having a top surface and a bottom surface, a width extending along the direction intersecting the pressing direction, and a pair of bent portions, each of the pair of bent portions positioned on a respective side of the intermediate stock in the width direction, and inflected in a direction from the top surface towards the bottom surface of the top plate, with a spacing between the pair of bent portions set as a narrower spacing than the width of the top plate;

gripping a portion of the intermediate stock between the pair of bent portions with the inner pad and the die pad, with the bottom surface of the intermediate stock facing toward the inner pad, by projecting the inner pad from the punch toward the die and the die pad from the die toward the punch, respectively;

moving the die toward the punch relative to the die pad, the inner pad, and the punch, thereby forming the pair of vertical walls with the die and the punch; and moving the die and the die pad, and the inner pad, relatively toward the punch after the die pad is at a closest position to the die thereby forming the top plate.

2. The pressed component manufacturing method of claim 1, wherein:

an apex portion of the punch includes punch shoulders disposed at both sides of the apex portion along the direction intersecting the pressing direction that is formed with punch-side inclined faces that set back from the apex portion progressively from the punch shoulders toward a center of the punch; and an opposing face of the die pad that opposes the apex portion of the punch includes die-side inclined faces as counterparts to the punch-side inclined faces.

3. The pressed component manufacturing method of claim 1, wherein:

an apex portion of the punch includes punch shoulders disposed at both sides of the apex portion along the direction intersecting the pressing direction that is formed with a-punch-side inclined faces that set back from the apex portion progressively from the punch shoulders toward a center of the punch; and an opposing face of the die that opposes the apex portion of the punch includes die-side inclined faces as counterparts to the punch-side inclined faces.

4. The pressed component manufacturing method of claim 1, wherein:

an apex portion of the punch includes punch shoulders disposed at both sides of the apex portion along the direction intersecting the pressing direction that is formed with punch-side inclined faces that set back from the apex portion progressively from the punch shoulders toward a center of the punch; and after moving the die and the die pad, and the inner pad, relatively toward the punch, a location of the die pad or the die opposing the punch-side inclined faces is disposed at a position separation from the top plate.

5. The pressed component manufacturing method of claim 1, wherein:

an apex portion of the punch includes a top plate-forming face and punch shoulders disposed at both sides of the top plate-forming face extending along the direction intersecting the pressing direction, wherein the top plate-forming face is formed corresponding to a profile of the top plate; and after moving the die and the die pad, and the inner pad, relatively toward the punch, a location of the die pad or the die opposing the top plate-forming face is disposed at a position separation from the top plate.

6. The pressed component manufacturing method of claim 2, wherein:

a width of the inner pad along the direction intersecting the pressing direction and a spacing between the pair of bent portions of the intermediate stock along the direction intersecting the pressing direction are the same as each other;

the inner pad includes shoulders disposed at both sides of the inner pad along the direction intersecting the pressing direction; and in the gripping of the portion of the intermediate stock between the pair of bent portions with the inner pad and the die pad, when the intermediate stock is gripped by the inner pad and the die pad the shoulders of the inner pad are positioned so as to align with the pair of bent portions of the intermediate stock.

7. The pressed component manufacturing method of claim 2, wherein:

a width of the inner pad along the direction intersecting the pressing direction is set narrower than a spacing between the pair of bent portions of the intermediate stock along the direction intersecting the pressing direction;

the apex portion of the punch is formed with a top plate intermediate forming face extending from an inside end of the punch-side inclined faces toward the center of the punch along the direction intersecting the pressing direction; and in the gripping of the portion of the intermediate stock between the pair of bent portions with the inner pad and the die pad, when the intermediate stock is gripped by the inner pad and the die pad, the inside end of the punch-side inclined faces is disposed opposing the bent portion.

8. The pressed component manufacturing method of claim 1, wherein an apex portion of the punch includes punch shoulders disposed at both sides of the apex portion along the direction intersecting the pressing direction; and in the gripping of the portion of the intermediate stock between the pair of bent portions with the inner pad and the die pad, when the intermediate stock is gripped by the inner pad and the die pad, the intermediate stock contacts the punch shoulders.

9. The pressed component manufacturing method of claim 3, wherein:

a width of the inner pad along the direction intersecting the pressing direction and a spacing between the pair of bent portions of the intermediate stock along the direction intersecting the pressing direction are the same as each other; and the inner pad includes shoulders disposed at both sides of the inner pad along the direction intersecting the pressing direction; and in the gripping of the portion of the intermediate stock between the pair of bent portions with the inner pad and the die pad, the intermediate stock is gripped by the inner pad and the die pad in which both sides of the inner pad along the direction intersecting the pressing direction are positioned so as to align with the bent portions of the intermediate stock.

10. The pressed component manufacturing method of claim 4, wherein:

a width of the inner pad along the direction intersecting the pressing direction and a spacing between the pair of bent portions of the intermediate stock along the direction intersecting the pressing direction are the same as each other;

the inner pad includes shoulders disposed at both sides of the inner pad along the direction intersecting the pressing direction; and in the gripping of the portion of the intermediate stock between the pair of bent portions with the inner pad and the die pad, when the intermediate stock is gripped by the inner pad and the die pad the shoulders of the inner pad are positioned so as to align with the pair of bent portions of the intermediate stock.

11. The pressed component manufacturing method of claim 5, wherein:

a width of the inner pad along the direction intersecting the pressing direction and a spacing between the pair of bent portions of the intermediate stock along the direction intersecting the pressing direction are the same as each other;

the inner pad includes shoulders disposed at both sides of the inner pad along the direction intersecting the pressing direction; and in the gripping of the portion of the intermediate stock between the pair of bent portions with the inner pad and the die pad, when the intermediate stock is gripped by the inner pad and the die pad the shoulders of the inner pad are positioned so as to align with the bent portions of the intermediate stock.

12. The pressed component manufacturing method of claim 3, wherein:

a width of the inner pad along the direction intersecting the pressing direction is set narrower than a spacing between the pair of bent portions of the intermediate stock along the direction intersecting the pressing direction;

the apex portion of the punch is formed with a top plate intermediate forming face extending from an inside end of the punch-side inclined faces toward the center of the punch along the direction intersecting the pressing direction; and in the gripping of the portion of the intermediate stock between the pair of bent portions with the inner pad and the die pad, when the intermediate stock is gripped by the inner pad and the die pad, the inside end of the punch-side inclined faces is disposed opposing the bent portion.

13. The pressed component manufacturing method of claim 4, wherein:

a width of the inner pad along the direction intersecting the pressing direction is set narrower than a spacing between the pair of bent portions of the intermediate stock along the direction intersecting the pressing direction;

the apex portion of the punch is formed with a top plate intermediate forming face extending from an inside end of the punch-side inclined faces toward the center of the punch along the direction intersecting the pressing direction; and in the gripping of the portion of the intermediate stock between the pair of bent portions with the inner pad and the die pad, when the intermediate stock is gripped by the inner pad and the die pad, the inside end of the punch-side inclined faces is disposed opposing the bent portion.

14. A press comprising:

a punch that is provided with an apex portion intersecting a pressing direction, an inner pad housing portion formed in the apex portion, punch shoulders disposed at both sides of the apex portion along the direction intersecting the pressing direction, and punch wall faces extending from the respective punch shoulders along the pressing direction;

an inner pad that includes an inner pad apex face intersecting the pressing direction, that is housed in the inner pad housing portion, and that moves in the pressing direction;

a die that includes a die bottom opposing the apex portion, a die pad housing portion formed in the die bottom, bottom corners disposed at both sides of the die bottom as counterparts to the punch shoulders, die-side recesses between the bottom corners and the die pad housing portion and set back in the pressing direction from the bottom corners, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction.

15. A press comprising:

a punch that is provided with an apex portion intersecting a pressing direction, an inner pad housing portion formed in the apex portion along the direction intersecting the pressing direction, punch shoulders disposed at both sides of the apex portion, punch-side inclined faces intersecting the pressing direction disposed at the apex portion between the punch shoulders and the inner pad housing portion that set back from the apex portion progressively from the punch shoulders toward the inner pad housing portion, and punch wall faces extending from the respective punch shoulders along the pressing direction;

an inner pad that includes an inner pad apex face intersecting the pressing direction, that is housed in the inner pad housing portion, and that moves in the pressing direction;

a die that includes a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction.

16. A press comprising:

a punch that includes an apex portion intersecting a pressing direction, an inner pad housing portion formed in the apex portion, punch shoulders disposed at both sides of the apex portion along the direction intersecting the pressing direction, and punch wall faces extending from the respective punch shoulders along the pressing direction;

an inner pad that includes an inner pad apex face intersecting the pressing direction, that is housed in the inner pad housing portion, and that moves in the pressing direction;

a die that includes a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face and an escape portion adjacent to the inner pad-opposing face disposed opposing the punch shoulders with a greater separation than a distance between the inner pad-opposing face and the inner pad apex face in the pressing direction, that is housed in the die pad housing portion, and that moves in the pressing direction.

17. A press line comprising:

a press including:

a punch that includes:

an apex portion intersecting a pressing direction, an inner pad housing portion formed in the apex portion, punch shoulders disposed at both sides of the apex portion, and punch wall faces extending from the respective punch shoulders;

an inner pad that includes an inner pad apex face intersecting the pressing direction, that is housed in the inner pad housing portion, and that moves in the pressing direction;

a die that includes:

a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction; and a pre-forming apparatus including:

a pre-forming punch that includes:

a pre-forming punch recess including:

a pre-forming punch recess bottom face intersecting a pre-forming pressing direction and having a narrower width than the apex portion of the punch and a width of no less than a width of the inner pad apex face, pre-forming punch recess corners disposed at both sides of the pre-forming punch recess bottom face, and two pre-forming punch recess inclined faces adjacent to the pre-forming punch recess corners and forming a larger angle with respect to each other than an angle formed between the two punch wall faces;

pre-forming punch shoulders disposed at both sides of the pre-forming punch recess; and pre-forming punch side-wall faces adjacent to the pre-forming punch shoulders; and a pre-forming die that is disposed opposing the pre-forming punch, and that includes a pre-forming die cavity having a profile inverted in contour from that of the pre-forming punch.

18. A press line comprising:

a press including:

a punch that includes:

an apex portion intersecting a pressing direction, an inner pad housing portion formed in the apex portion, punch shoulders disposed at both sides of the apex portion, and punch wall faces extending from the respective punch shoulders;

an inner pad that includes an inner pad apex face intersecting the pressing direction, that is housed in the inner pad housing portion, and that moves in the pressing direction;

a die that includes:

a die bottom as a counterpart to the apex portion, a die pad housing portion formed in the die bottom, bottom corners disposed at both sides of the die bottom as counterparts to the punch shoulders, and die cavity wall faces extending from the respective bottom corners as counterparts to the punch wall faces; and a die pad that includes an inner pad-opposing face opposing the inner pad apex face, that is housed in the die pad housing portion, and that moves in the pressing direction; and a pre-forming apparatus including:

a pre-forming punch that includes:

a pre-forming punch recess including:

a pre-forming punch recess bottom face intersecting a pre-forming pressing direction and having a width that is narrower than a width of the apex portion of the punch and is a width of no less than a width of the inner pad apex face, pre-forming punch recess corners disposed at both sides of the pre-forming punch recess bottom face, and two pre-forming punch recess inclined faces adjacent to the pre-forming punch recess corners and forming a larger angle with respect to each other than an angle formed between the two punch wall faces;

pre-forming punch shoulders disposed at both sides of the pre-forming punch recess; and pre-forming punch side-wall faces adjacent to the pre-forming punch shoulders;

a pre-forming die that is disposed opposing the pre-forming punch, and that has a die cavity including:

pre-forming die cavity wall faces as counterparts to the pre-forming punch side-wall faces, a pre-forming die bottom disposed between the pre-forming die cavity wall faces, and a pre-forming die pad housing portion formed in the pre-forming die bottom; and a pre-forming die pad that is housed in the pre-forming die pad housing portion, that moves in the pre-forming pressing direction, and that includes:

a punch bottom face counterpart face as a counterpart to the pre-forming punch recess bottom face, and punch inclined face counterpart faces as counterparts to the pre-forming punch recess inclined faces.

* * * * *